US005714705A

United States Patent [19]

Kishimoto et al.

[11] Patent Number: 5,714,705

[45] Date of Patent: Feb. 3, 1998

[54] ARPEGGIATOR

[75] Inventors: Tetsushi Kishimoto; Tsuyoshi Sakata, both of Osaka, Japan

[73] Assignee: Roland Corporation, Osaka, Japan

[21] Appl. No.: 652,368

[22] Filed: May 23, 1996

[30] Foreign Application Priority Data

| | | | |
|---|---|---|---|
| Sep. 19, 1995 | [JP] | Japan | 7-240375 |
| Sep. 19, 1995 | [JP] | Japan | 7-240376 |
| Sep. 20, 1995 | [JP] | Japan | 7-241056 |

[51] Int. Cl.[6] ..... G10H 1/00; G10H 1/40

[52] U.S. Cl. ..... 84/651; 84/611; 84/635; 84/650

[58] Field of Search ..... 84/609–611, 634, 84/635, 638, 649–651, 666, 667

[56] References Cited

U.S. PATENT DOCUMENTS

| | | | |
|---|---|---|---|
| 3,991,646 | 11/1976 | Kakehashi | 84/1.24 |
| 4,158,978 | 6/1979 | Hiyoshi et al. | 84/1.03 |
| 4,217,804 | 8/1980 | Yamaga et al. | 84/1.03 |

FOREIGN PATENT DOCUMENTS

| | | |
|---|---|---|
| 51-40118 | 4/1976 | Japan . |
| 51-68218 | 6/1976 | Japan . |
| 53-47219 | 4/1978 | Japan . |
| 55-76395 | 6/1980 | Japan . |
| 56-145093 | of 1981 | Japan . |
| 3-73998 | 7/1991 | Japan . |
| 4-17987 | 4/1992 | Japan . |

*Primary Examiner*—William M. Shoop, Jr.
*Assistant Examiner*—Marlon T. Fletcher
*Attorney, Agent, or Firm*—Kubovcik & Kubovcik

[57] ABSTRACT

An arpeggiator scans key-pushing data and produces in sequence a plurality of playing data according to results of the scanning. The arpeggiator includes a rhythm pattern table having at least one step which stores therein a time interval of a rhythm, a sound generation continuing time and a sound generation strength coefficient. The arpeggio playing is performed according to the rhythm pattern table. The arpeggiator further includes a scan mode table having at least one step which stores one of a plurality of scan functions. The key-pushing data is scanned by sequentially referring to the stored scan function so as to produce playing data based on which the arpeggio playing is performed. The arpeggiator has a mode where the key-pushing data is erased based on key-releasing data and another mode where erasure of the key-pushing data is prohibited based on given hold data.

31 Claims, 53 Drawing Sheets

Fig. 3

[Rhythm Pattern Table]

RHY_XXX_TBL[n]

| Step Time | Duration | Velo. Coef. |
|---|---|---|
| Step Time | Duration | Velo. Coef. |
| Step Time | Duration | Velo. Coef. |
| Step Time | Duration | Velo. Coef. |
| : | : | : |
| Step Time | Duration | Velo. Coef. |

RHY_XXX_SIZE

| Step Size |
|---|

Fig. 4

RHY__4__TBL

| 96 | 92 | 127 |
|---|---|---|

RHY__4__SIZE

| 1 |
|---|

Fig. 5

RHY_16_TBL

| | | |
|---|---|---|
| 24 | 22 | 127 |
| 24 | 22 | 100 |
| 24 | 22 | 100 |
| 24 | 22 | 100 |

RHY_16_SIZE

| |
|---|
| 4 |

Fig. 6

RHY_WALTZ_TBL

| | | |
|---|---|---|
| 96 | 20 | 127 |
| 96 | 20 | 100 |
| 96 | 20 | 100 |

RHY_WALTZ_SIZE

| |
|---|
| 3 |

Fig. 7

RHY_SHUFFLE_TBL

| | | |
|---|---|---|
| 32 | 30 | 127 |
| 16 | 14 | 80 |
| 32 | 30 | 100 |
| 16 | 14 | 80 |

RHY_SHUFFLE_SIZE

| |
|---|
| 4 |

Fig. 8

RHY_DIM_TBL

| | | |
|---|---|---|
| 24 | 22 | 127 |
| 24 | 22 | 110 |
| 24 | 22 | 95 |
| 24 | 22 | 80 |
| 24 | 22 | 60 |
| 24 | 22 | 40 |
| 24 | 22 | 30 |
| 24 | 22 | 20 |

RHY_DIM_SIZE

| |
|---|
| 8 |

Fig. 9

RHY_REGGAE_TBL

| | | |
|---|---|---|
| 94 | 1 | 85 |
| 68 | 8 | 127 |
| 30 | 4 | 96 |
| 94 | 10 | 80 |
| 98 | 6 | 117 |

RHY_REGGAE_SIZE

| |
|---|
| 5 |

Fig. 10

[Scan Mode Table]

| | |
|---|---|
| SMODE_XXX_TBL[n] | Scan Function # |
| | Scan Function # |
| | Scan Function # |
| | : |
| | Scan Function # |
| SMODE_XXX_SIZE | Scan Table Size |

Fig. 19

SMODE_SHAMI_TBL

| |
|---|
| SCAN_U_WO_T |
| SCAN_U_WO_T |
| SCAN_T |
| SCAN_T |
| SCAN_T |
| SCAN_T |
| SCAN_U_WO_T |
| SCAN_U_WO_T |
| SCAN_U_WO_T |
| SCAN_U_WO_T |
| SCAN_T |
| SCAN_T |
| SCAN_T |
| SCAN_T |
| SCAN_U_WO_T |
| SCAN_U_WO_T |
| SCAN_T |
| SCAN_T |
| SCAN_U_WO_T |
| SCAN_U_WO_T |
| SCAN_T |
| SCAN_T |
| SCAN_U_WO_T |
| SCAN_U_WO_T |

SMODE_SHAMI_SIZE

| |
|---|
| 24 |

Fig. 20

[Rhythm Pattern Parameter]

| | |
|---|---|
| PRM_RHYTHM | ptn. # |

Fig. 21

[Scan Mode Parameter]

| | |
|---|---|
| PRM_SMODE | mode # |

Fig. 22

[Groove Rate Parameter]

| | |
|---|---|
| PRM_GROOVE | value |

Fig. 23

[Note Buffer]

| Note# | 0 | 1 | 2 | 3 ··· | 126 | 127 |
|---|---|---|---|---|---|---|
| NOTEBUF[n] | velo. | velo. | velo. | ··· | velo. | velo. |

Fig. 24

[Play Buffer]

| Note# | 0 | 1 | 2 | 3 ··· | 126 | 127 |
|---|---|---|---|---|---|---|
| PLAYBUF[n] | velo. | velo. | velo. | ··· | velo. | velo. |

Fig. 25

[Current Playing Note# Buffer]

| | |
|---|---|
| CUR_NOTE | note # |

Fig. 26

[Hold Buffer]

| | |
|---|---|
| HOLD | value |

Fig. 27

[Order Buffer]

| | | |
|---|---|---|
| ORDER[n] | note # | velo. |
| | note # | velo. |
| | : | : |
| | note # | velo. |

Fig. 32

[Clock]

| | |
|---|---|
| CLOCK | clock |

Fig. 33

[Next Clock Buffer]

| | |
|---|---|
| NEXTCLK | next clock |

Fig. 34

[Note Off Reservation Buffer]

| | | |
|---|---|---|
| OFFRSV[n] | note # | note off clock |
| | note # | note off clock |
| | note # | note off clock |
| | : | : |
| | note # | note off clock |

Fig. 65

RHY_USER1_TBL

| Step Time | Duration | Velo. Coef. |
|---|---|---|
| Step Time | Duration | Velo. Coef. |
| Step Time | Duration | Velo. Coef. |
| : | : | : |
| Step Time | Duration | Velo. Coef. |

RHY_USER1_SIZE

| Step Size |
|---|

Fig. 66

SMODE_USER1_TBL

| Scan Function # |
|---|
| Scan Function # |
| Scan Function # |
| : |
| Scan Function # |

SMODE_USER1_SIZE

| Step Size |
|---|

Fig. 76

[Rhythm Pattern Table]

| | | | | |
|---|---|---|---|---|
| Step Time | Duration1 | Velo. Coef. 1 | Duration2 | Velo. Coef. 2 |
| Step Time | Duration1 | Velo. Coef. 1 | Duration2 | Velo. Coef. 2 |
| Step Time | Duration1 | Velo. Coef. 1 | Duration2 | Velo. Coef. 2 |
| : | : | : | : | : |
| Step Time | Duration1 | Velo. Coef. 1 | Duration2 | Velo. Coef. 2 |

RHY_XXX_SIZE

| |
|---|
| Step Size |

ARPEGGIATOR

BACKGROUND OF THE INVENTION

1. Field of the Invention

The present invention relates to an arpeggiator which scans key-pushing data and produces in sequence a plurality of playing data according to results of the scanning.

2. Description of the Related Art

Some of the conventional electronic musical instruments are equipped with a function called an arpeggiator. The arpeggiator scans key-pushing data per lapse of a given time, for example, from the lower pitch to the higher pitch in order, and outputs in sequence playing data according to results of the scanning.

With this function, the arpeggiation which would be otherwise difficult for a player can be achieved by a simple playing operation of pushing a plurality of keys simultaneously.

However, the conventional arpeggiator scans the key-pushing data at predetermined constant time intervals and outputs in sequence the playing data at such constant time intervals. Thus, sound producing timings are fully equalized so that the arpeggio playing tends to lack the touch of humanity and the musical amusingness.

Further, the properties of the tone, such as a sound continuing time and a sound volume, are also equalized so that the arpeggio playing tends to lack the touch of humanity and the musical amusingness also from this aspect.

Some of the conventional arpeggiators employ a scan function, other than the foregoing up-scan function for scanning the key-pushing data from the lower pitch to the higher pitch, such as a down-scan function for scanning the key-pushing data from the higher pitch to the lower pitch, an up/down-scan function for repeating the up-scan and the down-scan of the key-pushing data, or a random scan function for scanning the key-pushing data at random. However, only with this arrangement, it is difficult to achieve the musical significance so that there are so many players feeling something lacking.

Some of the arpeggiators employing the foregoing scan function have a function called a key-pushing order arpeggiator. This key-pushing order arpeggiator scans the pushed keys in order of key pushing per lapse of a given time, and produces playing data according to results of the scanning. With this arrangement, a simple melody can be played.

Japanese Second (examined) Patent Publication No. 61-60439 discloses an example of the key-pushing order arpeggiator.

In the publication, the arpeggio playing in key-pushing order is achieved by storing key-pushing data in a storage device in key-pushing order and reading out the stored key-pushing data from the storage device in order. In the disclosed key-pushing order arpeggiator, key-pushing data of a pushed key is not erased from the storage device even when the pushed key is released so that the arpeggio playing is continued endlessly. On the other hand, when the number of the pushed keys exceeds a capacity of the storage device, new key-pushing data is stored by returning to the head of the storage device so as to substitute the old key-pushing data.

SUMMARY OF THE INVENTION

In view of the foregoing, it is an object of the present invention to provide an improved arpeggiator capable of achieving more musical arpeggio playing, which can not be achieved by the conventional arpeggiators, with a simple operation.

It is another object of the present invention to provide an improved arpeggiator which can achieve more musical arpeggio playing of a higher level with a simple operation.

It is another object of the present invention to provide an improved arpeggiator which can include tones corresponding to the same key in plural times in a melody during key-pushing order arpeggio playing so as to realize the complicated key-pushing order arpeggio playing and which can stop the arpeggio playing at a desired timing.

According to one aspect of the present invention, an arpeggiator comprises key-pushing data storing means, having storage regions corresponding to a plurality of keys, respectively, for erasably writing key-pushing data, representing that the key is pushed, in the storage region corresponding to the pushed key; rhythm pattern table storing means for storing a rhythm pattern table having at least one step which records therein a time interval between a certain step and a subsequent step for every step of a rhythm; and playing data producing means for sequentially referring to the at least one step of the rhythm pattern table, scanning the storage regions corresponding to the at least one step, and producing playing data at a timing pursuant to the time interval recorded in the step, corresponding to the scanning of the storage regions, of the rhythm pattern table, the playing data representing a tone based on the key-pushing data detected by the scanning.

According to another aspect of the present invention, an arpeggiator comprises key-pushing data storing means, having storage regions corresponding to a plurality of keys, respectively, for erasably writing key-pushing data, representing that the key is pushed, in the storage region corresponding to the pushed key; rhythm pattern table storing means for storing a rhythm pattern table having at least one step which records therein data defining a property of a tone for every step of a rhythm; and playing data producing means for sequentially referring to the at least one step of the rhythm pattern table, scanning the storage regions corresponding to the at least one step, and producing playing data representing a tone based on the key-pushing data detected by the scanning of the storage regions and the data recorded in the step, corresponding to the scanning, of the rhythm pattern table and defining the property of the tone.

It may be arranged that the data defining the property of the tone is data defining a sound generation continuing time of the tone.

It may be arranged that the data defining the property of the tone is data defining a strength of sound generation of the tone.

It may be arranged that the key-pushing data storing means erasably writes the key-pushing data in the storage region corresponding to the pushed key, the key-pushing data representing that the key is pushed and including data for a strength of the key pushing, and that the playing data producing means produces the playing data including data for a strength of sound generation corresponding to the data for the key-pushing strength included in the key-pushing data detected by the scanning.

It may be arranged that the key-pushing data storing means erasably writes the key-pushing data in the storage region corresponding to the pushed key, the key-pushing data representing that the key is pushed and including data for a strength of the key pushing, and that the playing data producing means produces the playing data including data for a strength of sound generation determined based on the data for the key-pushing strength included in the key-pushing data detected by the scanning and the data defining the strength of sound generation of the tone recorded in the step, corresponding to the scanning, of the rhythm pattern table.

It may be arranged that the rhythm pattern table storing means stores a plurality of rhythm pattern tables, and that the playing data producing means refers to one rhythm pattern table selected from the plurality of rhythm pattern tables.

It may be arranged that the rhythm pattern table storing means stores the rhythm pattern tables such that at least a portion of the rhythm pattern tables is rewritable or a new rhythm pattern table is addable.

It may be arranged that the playing data producing means produces the playing data representing the tone changed based on data which defines a change depth of the property of the tone.

It may be arranged that an operator is provided for producing the data defining the change depth, the change depth determined depending on an operation degree of the operator.

It may be arranged that the data defining the change depth is data which defines a degree of change of a sound generation continuing time of the tone.

It may be arranged that the data defining the change depth is data which defines a degree of change of a strength in sound generation of the tone.

It may be arranged that the key-pushing data storing means erasably writes the key-pushing data in the storage region corresponding to the pushed key, the key-pushing data representing that the key is pushed and including data for a strength of the key pushing, and that the playing data producing means produces the playing data including data for a strength of sound generation determined based on the data for the key-pushing strength included in the key-pushing data detected by the scanning, the data defining the strength of sound generation of the tone recorded in the step, corresponding to the scanning, of the rhythm pattern table and data defining a degree of change in strength of sound generation of the tone.

According to another aspect of the present invention, an arpeggiator comprises key-pushing data storing means, having storage regions corresponding to a plurality of keys, respectively, for erasably writing key-pushing data, representing that the key is pushed, in the storage region corresponding to the pushed key; scan mode table storing means for storing a scan mode table which records at one step or a plurality of steps thereof one scan function or a plurality of scan functions of the same kind allowed to overlap with each other, the one scan function or the plurality of the scan functions selected from plural kinds of scan functions each defining a manner of scanning the storage regions; and playing data producing means for sequentially referring to the step/steps of the scan mode table, scanning the storage regions according to the scan function recorded in the step, and producing playing data representing a tone based on the key-pushing data detected by the scanning of the storage regions.

It may be arranged that the scan mode table storing means stores a plurality of scan mode tables, and that the playing data producing means refers to one scan mode table selected from the plurality of scan mode tables.

It may be arranged that the scan mode table storing means stores the scan mode tables such that at least a portion of the scan mode tables is rewritable or a new scan mode table is addable.

It may be arranged that the key-pushing data represents at least a pitch of the tone.

According to another aspect of the present invention, an arpeggiator comprises key-pushing data storing means, having storage regions corresponding to a plurality of keys, respectively, for erasably writing key-pushing data, representing that the key is pushed, in the storage region corresponding to the pushed key; rhythm pattern table storing means for storing a rhythm pattern table having at least one step which records therein a time interval between a certain step and a subsequent step for every step of a rhythm; scan mode table storing means for storing a scan mode table which records at one step or a plurality of steps thereof one scan function or a plurality of scan functions of the same kind allowed to overlap with each other, the one scan function or the plurality of the scan functions selected from plural kinds of scan functions each defining a manner of scanning the storage regions; and playing data producing means for sequentially referring to the at least one step of the rhythm pattern table and the step/steps of the scan mode table, scanning the storage regions according to the scan function recorded in the step of the scan mode table, and producing playing data at a timing pursuant to the time interval recorded in the step, corresponding to the scanning of the storage regions, of the rhythm pattern table, the playing data representing a tone based on the key-pushing data detected by the scanning.

According to another aspect of the present invention, an arpeggiator comprises key-pushing data storing means, having storage regions corresponding to a plurality of keys, respectively, for erasably writing key-pushing data, representing that the key is pushed, in the storage region corresponding to the pushed key; rhythm pattern table storing means for storing a rhythm pattern table having at least one step which records therein data defining a property of a tone for every step of a rhythm; scan mode table storing means for storing a scan mode table which records at one step or a plurality of steps thereof one scan function or a plurality of scan functions of the same kind allowed to overlap with each other, the one scan function or the plurality of the scan functions selected from plural kinds of scan functions each defining a manner of scanning the storage regions; and playing data producing means for sequentially referring to the at least one step of the rhythm pattern table and the step/steps of the scan mode table, scanning the storage regions according to the scan function recorded in the step of the scan mode table, and producing playing data representing a tone based on the key-pushing data detected by the scanning of the storage regions and the data recorded in the step, corresponding to the scanning, of the rhythm pattern table and defining the property of the tone.

It may be arranged that the rhythm pattern table storing means and the scan mode table storing means store a plurality of rhythm pattern tables and a plurality of scan mode tables, respectively, that style storing means is provided for storing plural kinds of styles each in combination of one of the rhythm pattern tables and one of the scan mode tables, and that the playing data producing means refers to the rhythm pattern table and the scan mode table corresponding to one of the styles selected based on given style selection data.

According to another aspect of the present invention, an arpeggiator comprises key-pushing data storing means having a storage region of a given storage capacity for storing key-pushing data in order of key-pushing, the key-pushing data identifying a pushed key among a plurality of keys; key-pushing data erasing means, based on key-releasing data identifying a released key among the plurality of keys, for erasing the key-pushing data of the key corresponding to the key-releasing data from the storage region; key-pushing data holding means for, responsive to given hold-on data, prohibiting erasure of the key-pushing data from the storage region by the key-pushing data erasing means and for, responsive to given hold-off data, releasing the prohibition of erasure of the key-pushing data from the storage region by the key-pushing data erasing means and causing the key-pushing data erasing means to erase the key° pushing data, except the key-pushing data of the key-pushed upon receipt of the given hold-off data, from the storage region; and playing data producing means for sequentially scanning the storage region and producing playing data representing a tone based on the key-pushing data detected by the scanning of the storage region.

It may be arranged that an operator which outputs the hold-on data and the hold-off data depending on an operation thereof, is provided.

It may be arranged that the operator is a pedal.

It may be arranged that hold data input means is provided for receiving the hold-on data and the hold-off data from the exterior and feeding them to the key-pushing data holding means.

It may be arranged that key-pushing data excess storage prohibiting means is provided for prohibiting storage of new key-pushing data into the storage region in a state where the key-pushing data are stored over all the storage region.

BRIEF DESCRIPTION OF THE DRAWINGS

FIG. 3 is a diagram showing a basic pattern of a rhythm pattern table;

FIG. 4 is a diagram showing a rhythm pattern table and the number of its steps for a quarter note;

FIG. 5 is a diagram showing a rhythm pattern table and the number of its steps for a sixteenth note;

FIG. 6 is a diagram showing a rhythm pattern table and the number of its steps for waltz;

FIG. 7 is a diagram showing a rhythm pattern table and the number of its steps for shuffle;

FIG. 8 is a diagram showing a rhythm pattern table and the number of its steps for diminish;

FIG. 9 is a diagram showing a rhythm pattern table and the number of its steps for reggae;

FIG. 10 is a diagram showing a basic pattern of a scan mode table;

FIG. 19 is a diagram showing a scan mode table and the number of its steps for shamisen;

FIG. 20 is a diagram showing a rhythm pattern parameter;

FIG. 21 is a diagram showing scan mode parameter;

FIG. 22 is a diagram showing a groove rate parameter;

FIG. 23 is a diagram showing a note buffer;

FIG. 24 is a diagram showing a play buffer;

FIG. 25 is a diagram showing a current playing note number buffer;

FIG. 26 is a diagram showing a hold buffer;

FIG. 27 is a diagram showing an order buffer;

FIG. 32 is a showing a clock counter;

FIG. 33 is a diagram showing a next clock buffer;

FIG. 34 is a diagram showing a note off reservation buffer;

FIG. 65 is a diagram showing a rhythm pattern table which is desirably definable by a player;

FIG. 66 is a diagram showing a scan mode table which is desirably definable by a player;

FIG. 76 is a diagram showing a rhythm pattern table;

DETAILED DESCRIPTION OF THE PREFERRED EMBODIMENTS

Now, preferred embodiments of the present invention will be described hereinbelow with reference to the accompanying drawings.

Figure 1:
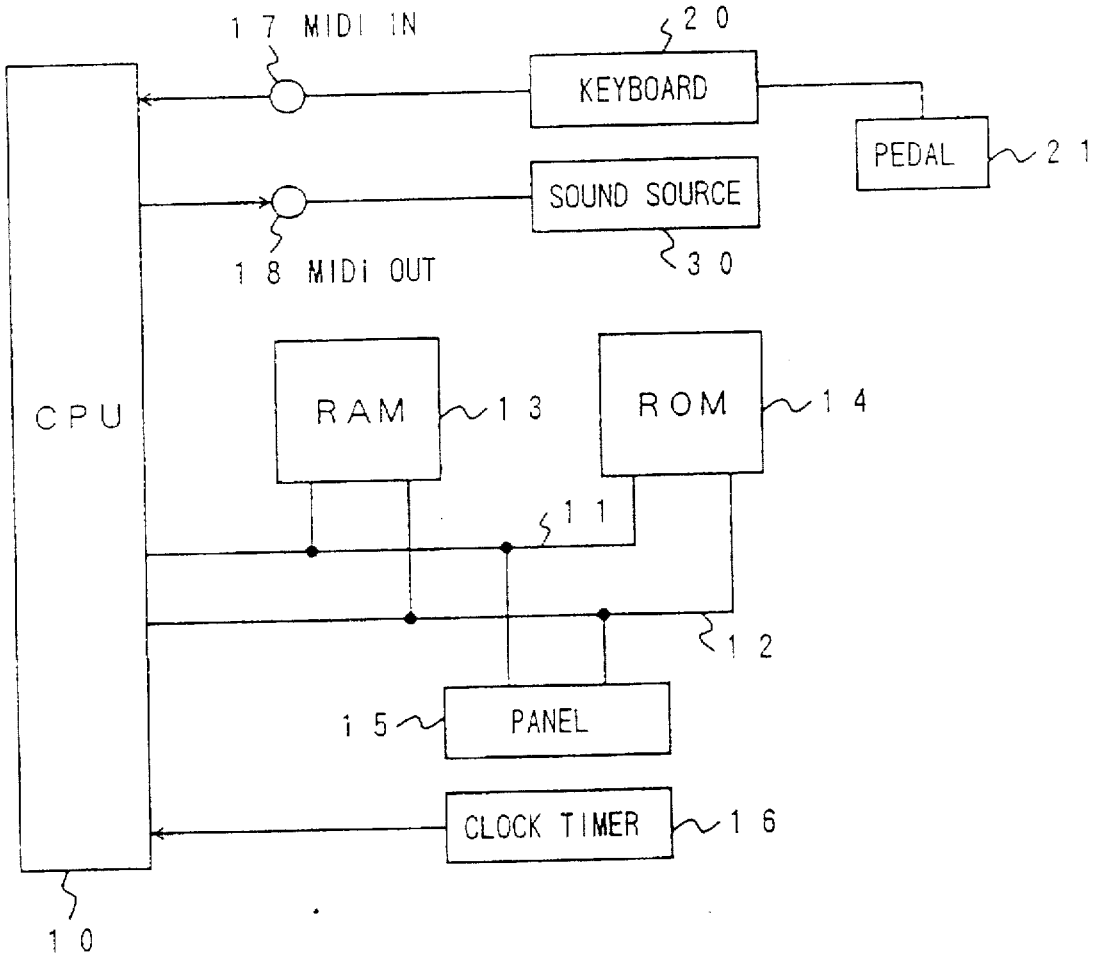
FIG. 1 is a circuit diagram of an arpeggiator according to a preferred embodiment of the present invention.

FIG. 1 is a circuit diagram of an arpeggiator according to a preferred embodiment of the present invention.

In the figure, the arpeggiator includes a CPU 10, and a RAM 13, a ROM 14 and a panel 15 which are connected to the CPU 10 via an address bus 11 and a data bus 12, respectively. The arpeggiator further includes a clock timer 16 for feeding a clock to the CPU 10, a data input terminal (MIDI IN) 17 pursuant to the MIDI standard for inputting data, and a data output terminal (MIDI OUT) 18 pursuant to the MIDI standard for outputting data.

The ROM 14 is a read only memory area for storing programs to be executed by the CPU 10 and various tables to be referred to in the programs. Details of the programs and the tables will be described later.

The RAM 13 is used as a working area for execution of the programs by the CPU 10. In this embodiment, the RAM 13 is backed up by a battery so that the memory contents are maintained even when the power is off. The memory contents will be described later.

The panel 15 has operation switches and indicators. The panel 15 can independently select a parameter and set a value to the parameter. The set value is stored in a memory within the RAM 13.

Figure 2:
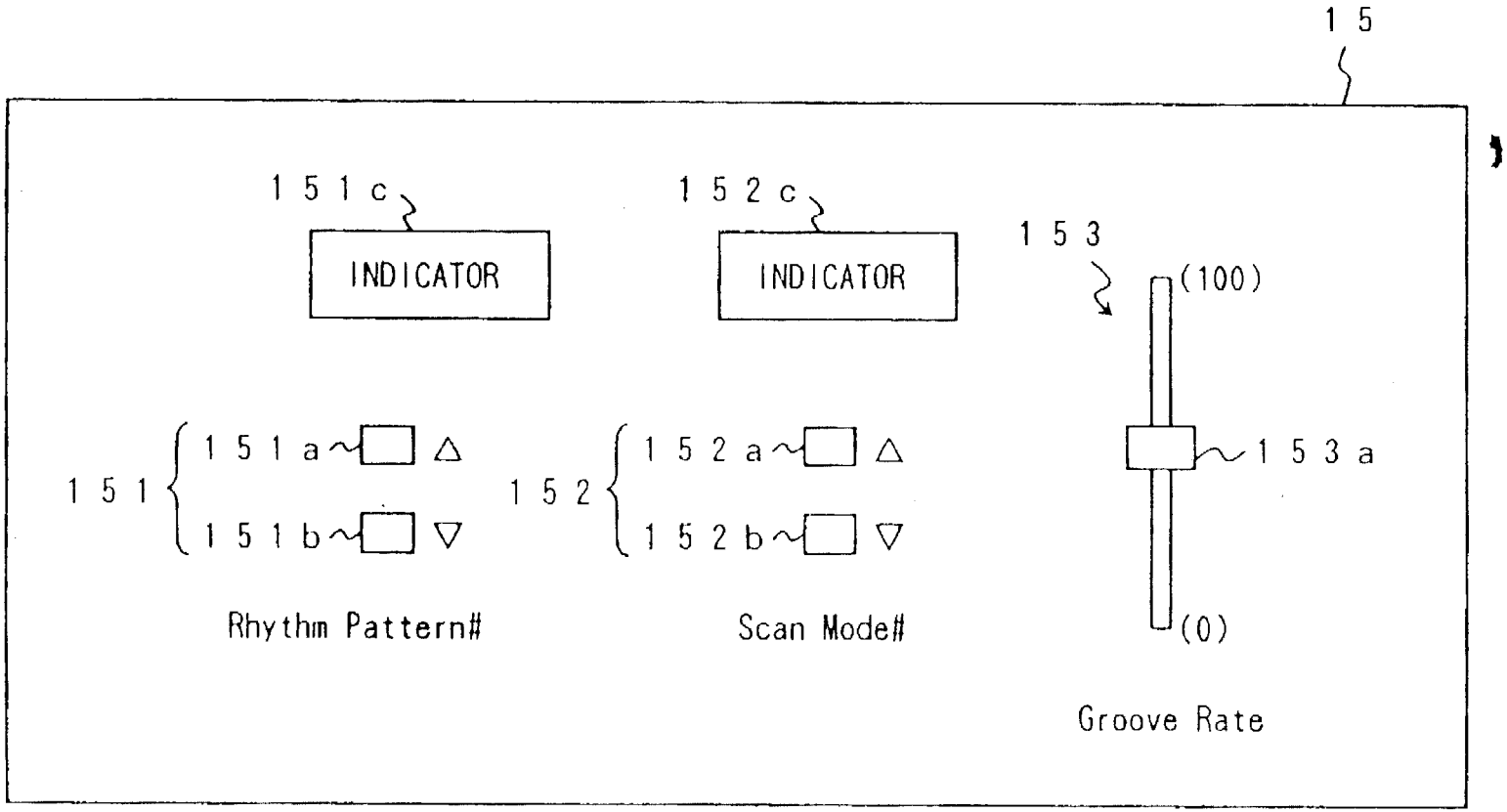
FIG. 2 is a diagram showing a structure of a panel.

FIG. 2 is a diagram showing the panel 15.

Using the panel 15, a rhythm pattern number (Rhythm Pattern #), a scan mode number (Scan Mode #) and a groove rate (Groove Rate) can be set.

In this embodiment, the rhythm pattern is in the form of a combination of a sound producing timing, a duration and a velocity coefficient. A rhythm pattern setting operator 151 includes an operation button 151*a* for incrementing a value and an operation button 151*b* for decrementing a value. The value set by the operation buttons 151*a* and 151*b* is displayed on an indicator 151*c*, and as described above, stored in the RAM 13.

The scan mode determines one of scan functions for scanning key-pushing data. A scan mode setting operator 152 includes, like the rhythm pattern setting operator 151, an operation button 152*a* for incrementing a value and an operation button 151*b* for decrementing a value. The value set by the operation buttons 151*a* and 151*b* is displayed on an indicator 152*c* and stored in the RAM 13.

The groove rate determines a degree of what is called "grooviness". A groove rate setting operator 153 is in the form of a slider having a slide button 153*a*. By moving the slide button 153*a*to a lowermost position, a groove rate parameter is set to a value "0". By moving the slide button 153*a*to an uppermost position, the groove rate parameter is set to a value "100". By moving the slide button 153*a*to an intermediate position between the lowermost and uppermost positions, a value between "0" and "100" is set depending on the position. The set value is stored in the RAM 13.

Details of each parameter will be described later.

Referring back to FIG. 1, the clock timer 16 generates a clock at every given period for feeding it to the CPU 10. In this embodiment, a time corresponding to 96 clocks is determined to be a tone continuing time of a quarter note, and the tempo of an arpeggio is determined by this clock period.

To the data input terminal (MIDI IN) 17 is connected, for example, as shown in the figure, a keyboard 20. Key-pushing (note-on) data and key-releasing (note-off) data produced by playing on the keyboard 20 are inputted to the CPU 10 via the data input terminal 17. Further, a hold pedal 21 is connected to the keyboard 20. Hold-on data and hold-off data (hereinafter referred to as "hold data" altogether) produced by operating the hold pedal 21 are also inputted to the CPU 10 via the data input terminal 17 as one kind of the MIDI data.

The CPU 10 receives the key-pushing data and the key-releasing data inputted via the data input terminal 17 so as to produce playing data for the arpeggio playing in sequence and outputs the playing data to the external via the data output terminal 18.

To the data output terminal 18 is connected, for example, as shown in the figure, a sound source 30 where a tone signal is produced based on the received playing data. The tone signal is emitted to the space as a musical sound, for example, via a sound system including amplifiers, speakers and the like incorporated in or connected to the sound source 30.

Hereinbelow, various tables stored in the ROM and referred to in the later-described programs will be first explained, then various memories provided in the RAM will be explained, and thereafter, the programs using those tables and memories will be explained.

FIG. 3 is a diagram showing a basic pattern of a rhythm pattern table.

In the rhythm pattern table, each step corresponds to a step of a rhythm and records therein a time interval or a step time (Step Time) between that step and the subsequent step, a continuing time or a duration (Duration) of a rhythm sound of that step, and a velocity coefficient (Velo. Coef.) which defines a strength of sound generation of a rhythm sound of that step. Further, the rhythm pattern table finally records therein the number of steps or a size (Step Size) of the rhythm pattern table. Each step has a memory capacity of 5 bytes in total including a step time of 2 bytes, a duration of 2 bytes and a velocity coefficient of 1 byte. The number of steps has 1 byte. A step time and a duration are identified by the number of the foregoing clocks (quarter note=96 clocks). A sound producing or generating timing is defined by a step time.

Plural kinds of the rhythm pattern tables are stored in the ROM and each rhythm pattern table is assigned its own number. Thus, by operating the rhythm pattern setting operator 151 shown in FIG. 2 to set one of the rhythm pattern numbers, the player can select a desired rhythm pattern table.

In this embodiment, the rhythm pattern table and the number of its steps are expressed as RHY_XXX_TBL [n] and RHY_XXX_SIZE, respectively, wherein XXX represents a title of the rhythm pattern table and n in [n] represents a step number (0<n<RHY_XXX_SIZE) in the rhythm pattern table.

Further, a step time, a duration and a velocity coefficient recorded in an n-th step of a rhythm pattern table XXX are expressed as follows, respectively:

RHY_XXX_TBL [n]. stepTime

RHY_XXX_TBL [n]. duration

RHY_XXX_TBL [n]. veloCoef

Now, examples of the rhythm pattern tables will be explained.

FIG. 4 is a diagram showing a rhythm pattern table and the number of its steps for a quarter note.

This rhythm pattern table has a title of "4" representing that this table is for a quarter note, and is expressed as RHY_4_TBL. RHY_4_TBL [0]. stepTime, RHY_4_TBL [0]. duration and RHY_4_TBL [0]. veloCoef are 96 (the number of clocks corresponding to a quarter note), 92 and 127, respectively. The number of steps is expressed as RHY_4_SIZE. Since the rhythm pattern table RHY_4_TBL includes only one step, the number of steps RHY_4_SIZE is "1".

The rhythm pattern table RHY_4_TBL and the following rhythm pattern tables RHY_XXX_TBLs are assigned their own rhythm pattern numbers. A rhythm pattern number of the rhythm pattern table RHY_4_TBL is set to "0".

FIGS. 5, 6, 7, 8 and 9 are diagrams showing rhythm pattern tables and the numbers of their steps for a sixteenth note (title: 16), waltz (WALTZ), shuffle (SHUFFLE), diminish (DIM) and reggae (REGGAE), respectively. Rhythm pattern numbers are assigned 1, 2, 3, 4 and 5 in the order named. Since structures of them are obvious from the foregoing explanation, detailed explanation thereof are omitted.

FIG. 10 is a diagram showing a basic pattern of a scan mode table.

Each step of the scan mode table records therein a scan function number (Scan Function #) identifying a scan function (Scan Function) for scanning the key-pushing data.

Each step of the scan mode table has a memory capacity of 1 byte, and the number of steps also has 1 byte.

Plural kinds of the scan mode tables are stored in the ROM 14. By operating the scan mode setting operator 152 shown in FIG. 2, the player can select a desired scan mode table.

In this embodiment, the scan mode table and the number of steps are expressed as SMODE_XXX_TBL [n] and SMODE_XXX_SIZE, respectively, wherein XXX represents a title of the scan mode table and n in [n] represents a step number (0<n<SMODE_XXX_SIZE) in the scan mode table.

The scan functions in this embodiment are as follows:

(1) Up-Scan Function

This scan function scans the key-pushing data from the lower pitch to the higher pitch. In this embodiment, this scan function expressed as SCAN_U.

(2) Down-Scan Function

This scan function scans the key-pushing data from the higher pitch to the lower pitch. In this embodiment, this scan function is expressed as SCAN_D.

(3) Up/Down-Scan Function

This scan function scans the key-pushing data from the lower pitch to the higher pitch until the scan reaches the highest-pitched tone, and then from the higher pitch to the lower pitch. In this embodiment, this scan function is expressed as SCAN_UD.

(4) Random Scan Function

This scan function scans the key-pushing data at random. In this embodiment, this scan function is expressed as SCAN_R.

(5) Key-Pushing Order Scan Function

This scan function scans the key-pushing data in order of inputs of the key-pushing data. In this embodiment, this scan function is expressed as SCAN_O.

(6) Chord Scan Function

This scan function scans the key-pushing data of all the currently-pushed keys. In this embodiment, this scan function is expressed as SCAN_C.

(7) Lowest-Pitched Tone Scan Function

This scan function only scans the key-pushing data of the smallest note number (lowest-pitched tone) among the currently-pushed keys. In this embodiment, this scan function is expressed as SCAN_B.

(8) Highest-Pitched Tone Scan Function

This scan function only scans the key-pushing data of the greatest note number (highest-pitched tone) among the currently-pushed keys. In this embodiment, this scan function is expressed as SCAN_T.

(9) Up-Scan Function Without Lowest-Pitched Tone

This scan function scans the key-pushing data from the lower pitch to the higher pitch without the lowest-pitched tone. In this embodiment, this scan function is expressed as SCAN_U_WO_B (scan up without bass).

(10) Random Scan Function Without Lowest-Pitched Tone This scan function scans the key-pushing data at random without the lowest-pitched tone. In this embodiment, this scan function is expressed as SCAN_R_WO_B.

(11) Chord Scan Function Without Lowest-Pitched Tone

This scan function scans the key-pushing data of all the currently-pushed keys without the lowest-pitched tone. In this embodiment, this scan function is expressed as SCAN_C_WO_B.

(12) Up-Scan Function Without Highest-Pitched Tone

This scan function scans the key-pushing data from the lower pitch to the higher pitch without the highest-pitched tone. In this embodiment, this scan function is expressed as SCAN_U_WO_T.

Now, examples of the scan mode tables will be explained.

Figure 11:
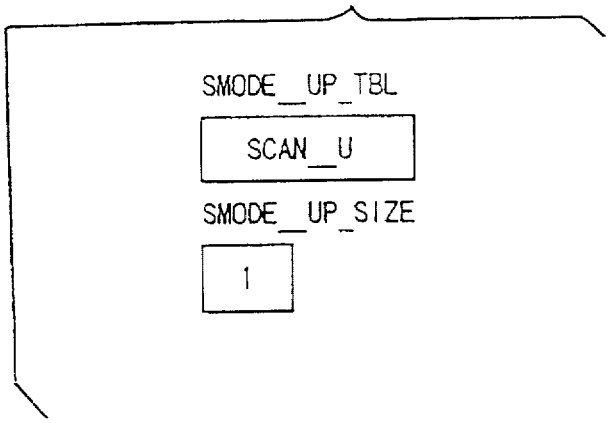
FIG. 11 is a diagram showing a scan mode table and the number of its steps for up-scan.
Figure 12:
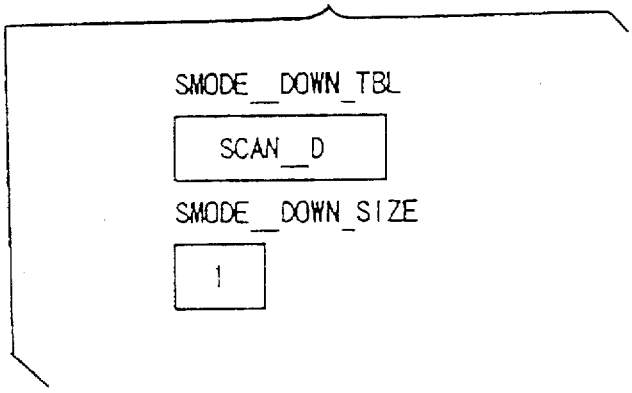
FIG. 12 is a diagram showing a scan mode table and the number of its steps for down-scan.
Figure 13:
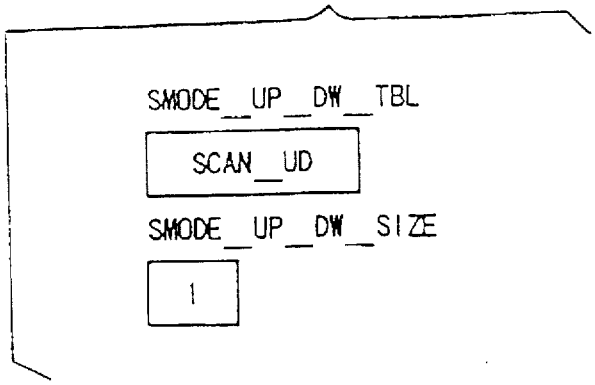
FIG. 13 is a diagram showing a scan mode table and the number of its steps for up/down-scan.
Figure 14:
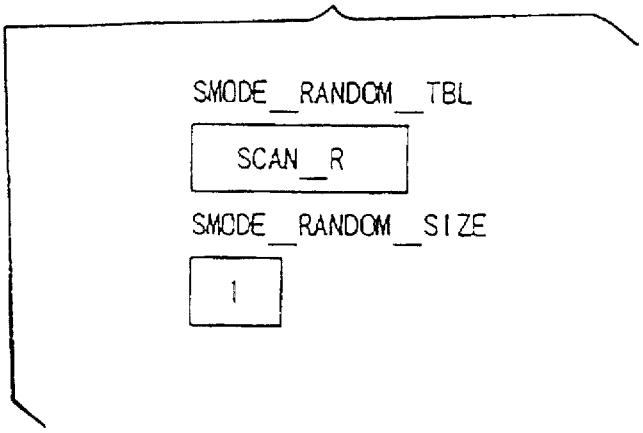
FIG. 14 is a diagram showing a scan mode table and the number of its steps for random scan.
Figure 15:
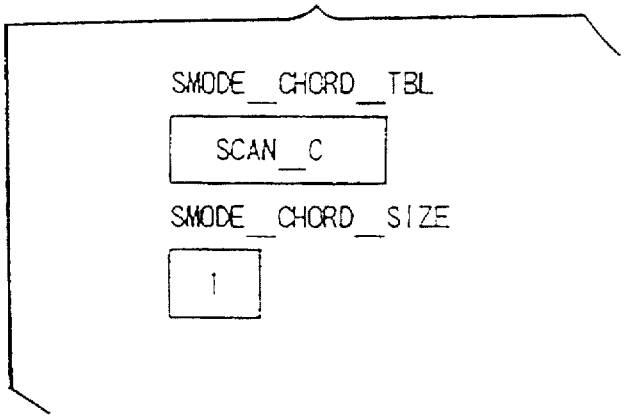
FIG. 15 is a diagram showing a scan mode table and the number of its steps for chord scan.
Figure 16:
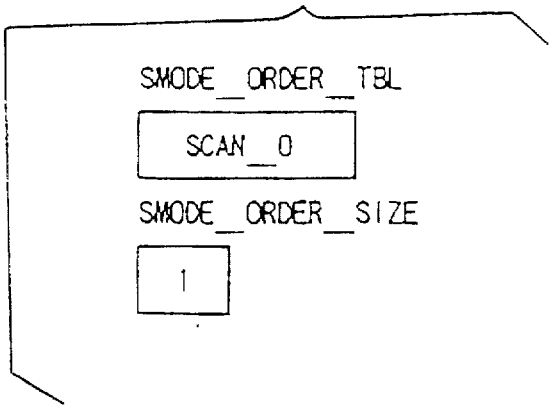
FIG. 16 is a diagram showing a scan mode table and the number of its steps for key-pushing order scan.
Figure 17:
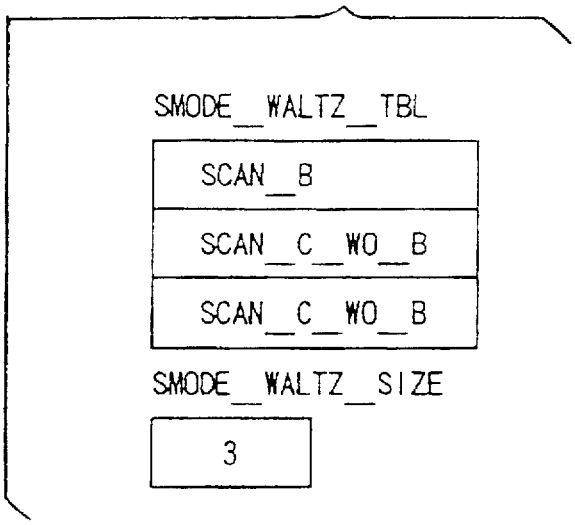
FIG. 17 is a diagram showing a scan mode table and the number of its steps for waltz.
Figure 18:
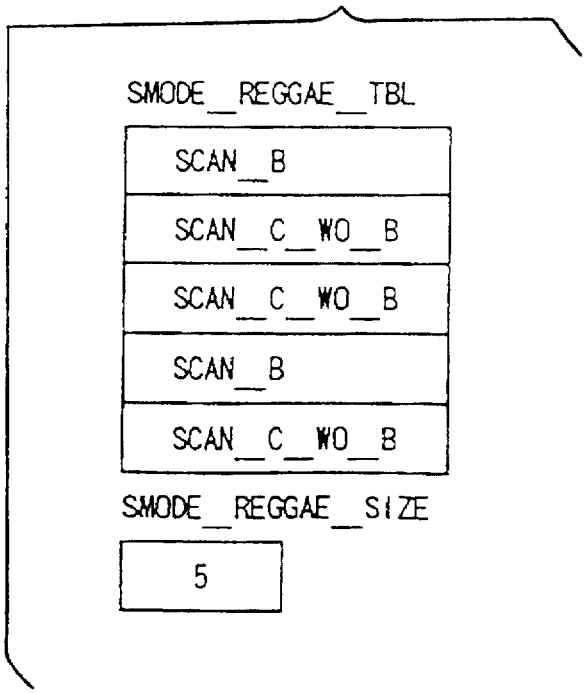
FIG. 18 is a diagram showing a scan mode table and the number of its steps for reggae.

FIG. 11 is a diagram showing a scan mode table and the number of its steps for the up-scan.

This scan mode table has a title of "UP" representing that this table is for the up-scan, and is expressed as SMODE_UP_TBL. The number of steps is expressed as SMODE_UP_SIZE. Since the scan mode table SMODE_UP_TBL includes only one step recording therein the up-scan function SCAN_U, the number of steps SMODE_UP_SIZE is "1".

The scan mode table SMODE_UP_TBL and the following scan mode tables SMODE_XXX_TBLs are assigned their own scan mode numbers. A scan mode number of the scan mode table SMODE_UP_TBL is set to "0".

FIGS. 12, 13, 14, 15, 16, 17, 18 and 19 are diagrams showing scan mode tables and the numbers of their steps for the down-scan (DOWN), the up/down-scan (UP_DW), the random scan (RANDOM), the chord scan (CHORD), the key-pushing order scan (ORDER), waltz (WALTZ), reggae (REGGAE) and shamisen (SHAMI), respectively. Scan mode numbers are assigned 1, 2, 3, 4, 5, 6, 7 and 8 in the order named. Since structures of them are obvious from the foregoing explanation, detailed explanation thereof are omitted.

Now, memories in the RAM storing various parameter values and the like will be explained.

FIG. 20 is a diagram showing a rhythm pattern parameter. The rhythm pattern parameter is a memory of 1 byte, wherein a rhythm pattern number set by operating the rhythm pattern setting operator 151 of the panel 15 shown in FIG. 2 is stored. In this embodiment, this is expressed as PRM_RHYTHM.

FIG. 21 is a diagram showing a scan mode parameter. The scan mode parameter is also a memory of 1 byte, wherein a scan mode number set by operating the scan mode setting operator 152 of the panel 15 shown in FIG. 2 is stored. In this embodiment, this is expressed as PRM_SMODE.

FIG. 22 is a diagram showing a groove rate parameter. The groove rate parameter is also a memory of 1 byte, wherein a groove rate value set by operating the groove rate setting operator 153 of the panel 15 shown in FIG. 2 is stored. As described before, this value is set in the range of 0~100. In this embodiment, this is expressed as PRM_GROOVE.

FIG. 23 is a diagram showing a note buffer. The note buffer has 128 bytes, and each byte corresponds to one key (note number) of the keyboard 20 (see FIG. 1 ). When the key-pushing data is received, data representing a key-pushing strength (note-on velocity) in the key-pushing data is stored in a region corresponding to a note number in the key-pushing data. When a key is held released (note off) or is released after being pushed up to then, "−1" is stored in a corresponding region.

In this embodiment, each region of the note buffer is expressed as NOTEBUF [n], wherein n represents a note number.

FIG. 24 is a diagram showing a play buffer. Like the note buffer shown in FIG. 23, the play buffer has 128 bytes, and each byte corresponds to one note number. On the other hand, as different from the note buffer shown in FIG. 23, the play buffer stores a note-on velocity including the hold data. Specifically, when the hold pedal 21 connected to the keyboard 20 shown in FIG. 1 is depressed, the hold-on data is inputted to the CPU 10 via the data input terminal 17, and when the hold pedal 21 is released, the hold-off data is inputted to the CPU 10 via the data input terminal 17. When the hold-on data is received, erasure of the key-pushing data stored in the play buffer shown in FIG. 24 is prohibited until the hold-off data is received. When the hold-off data is inputted, the contents of the note buffer at that time are copied into the play buffer. Thereafter until the hold-on data is inputted subsequently, the play buffer constantly maintains the same contents as the note buffer. When performing the arpeggio playing, the play buffer storing the velocities including the hold data is scanned. In this embodiment, each region of the play buffer is expressed as PLAYBUF[n], wherein n represents a note number.

FIG. 25 is a diagram showing a current playing note number buffer. The current playing note number buffer is a memory of 1 byte, wherein a note number of the current step during the arpeggio playing is stored. In this embodiment, this is expressed as CUR_NOTE.

FIG. 26 is a diagram showing a hold buffer. The hold buffer is a memory of 1 byte, wherein the hold data having a numeric value in the range of 0~127 is stored. When the hold pedal 21 shown in FIG. 1 is operated, the hold data represented by a numeric value of 0~127 is inputted via the data input terminal 17 depending on an operation magnitude of the hold pedal 21 and stored in the hold buffer. In this embodiment, if this numeric value is equal to or greater than 64, it is determined to be the hold-on data, while if less than 64, it is determined to be the hold-off data. Here, this is expressed as HOLD.

FIG. 27 is a diagram showing an order buffer. The order buffer includes 16 steps each having 2 bytes, and each step stores a note number and a velocity of that note number. In the order buffer, the note numbers of the pushed keys and the velocities upon key-pushing are stored in order of key-pushing. When the key is released, the note number and the velocity of that released key are erased and the stored note numbers and velocities are packed forward so as to fill the step whose data are erased. In this embodiment, this is expressed as ORDER [n], wherein n represents a step number (n=0~15). When designating a note number and a velocity of an n-th step, they are expressed as ORDER [n]. note and ORDER [n]. velo, respectively.

Figure 28:
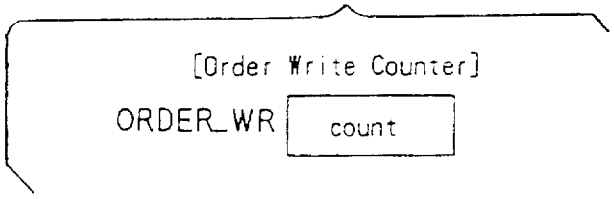
FIG. 28 is a diagram showing an order write counter.

FIG. 28 is a diagram showing an order write counter. The order write counter is a memory of 1 byte. When the key-pushing data is received, a value representing a step number of the order buffer ORDER [ ] shown in FIG. 27 into which the received key-pushing data is to be stored, is stored in the order write counter. This value is set in the range of 0~16, wherein 0~15 correspond to the respective steps of the order buffer ORDER [ ] and 16 represents that the order buffer ORDER [ ] is full. In this embodiment, this is expressed as ORDER_WR.

Figure 29:
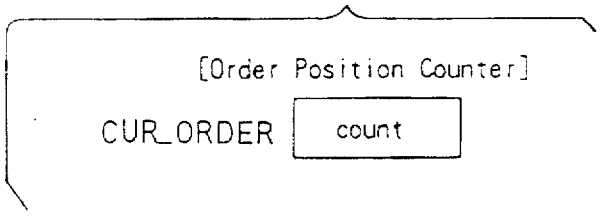
FIG. 29 is a diagram showing an order position counter.

FIG. 29 is a diagram showing an order position counter. The order position counter is a memory of 1 byte. A value representing a step number of the order buffer ORDER [ ] shown in FIG. 27 to which a tone of the current step during the arpeggio playing corresponds, is stored in the order position counter. This value is set in the range of −1~15, wherein 0~15 correspond to the respective steps of the order buffer ORDER [ ] and −1 represents that it is a timing to start a series of steps of the arpeggio playing (a timing when a previous series of steps ended). In this embodiment, this is expressed as CUR_ORDER.

Figure 30:
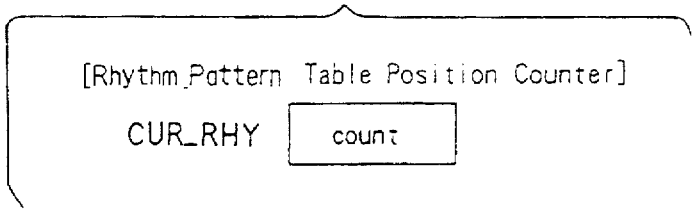
FIG. 30 is a diagram showing a rhythm pattern table position counter.

FIG. 30 is a diagram showing a rhythm pattern table position counter. The rhythm pattern table position counter is a memory of 1 byte. This memory is a pointer for indicating a step in the currently-selected rhythm pattern table (see FIGS. 3~9). This pointer corresponds to a current rhythm step during the arpeggio playing. The value of the rhythm pattern table position counter is set equal to or greater than 0 and less than the number of steps RHY_XXX_SIZE of the currently-selected rhythm pattern table. In this embodiment, this is expressed as CUR_RHY.

Figure 31:
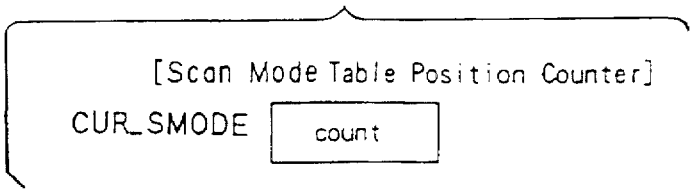
FIG. 31 is a diagram showing a scan mode table position counter.

FIG. 31 is a diagram showing a scan mode table position counter. The scan mode table position counter is a memory of 1 byte. This memory is a pointer for indicating a step in the currently-selected scan mode table (see FIGS. 10~19). This pointer also corresponds to a current rhythm step during the arpeggio playing. The value of the scan mode table position counter is set equal to or greater than 0 and less than the number of steps SMODE_XXX_SIZE of the currently-selected scan mode table. In this embodiment, this is expressed as CUR_SMODE.

FIG. 32 is a diagram showing a clock counter. The clock counter is a memory of 2 bytes (16 bits). A value of the clock counter is incremented by "1" every time the clock timer 16 shown in FIG. 1 produces one clock. The value of the clock counter is set in the range of 0000h~FFFFh. Subsequent to FFFFh, the value returns to 0000h. This is repeated endlessly while the power is on. The arpeggio playing, advances based on increment of the counter value. In this embodiment, this is expressed as CLOCK.

FIG. 33 is a diagram showing a next clock buffer. The next clock buffer is a memory of 2 bytes (16 bits), wherein a time of the next step of the arpeggio playing is stored. Specifically, when CLOCK shown in FIG. 32 is incremented to reach a value stored in the next clock buffer, the key-pushing data is scanned to send the note-on data. When the process of one step is finished, the value of the next clock buffer is updated to a time of the subsequent step. The value of the next clock buffer is set in the range of 0000h~FFFFh. In this embodiment, this is expressed as NEXTCLK.

FIG. 34 is a diagram showing a note off reservation buffer. The note off reservation buffer is arranged in 3 bytes×16. In the note off reservation buffer, note numbers to be note-off and timings for actually sending them as note-off data are stored in pairs. The sending timing is represented by the value of CLOCK in FIG. 32. When CLOCK is incremented to reach one of the sending timings stored in the note off reservation buffer, the note-off data is sent for the note number stored in a pair with that sending timing. "−1 " is stored in a region of the note off reservation buffer where no effective data is stored or in a region for which the sending of the note-off data is finished.

In this embodiment, this is expressed as OFFRSV [n], wherein n represents an n-th storage region for a pair of a note number and a sending timing thereof. When designating a note number and a sending timing in OFFRSV [n], they are expressed as OFFRSV [n]. note and OFFRSV [n], clock, respectively.

Figure 35:
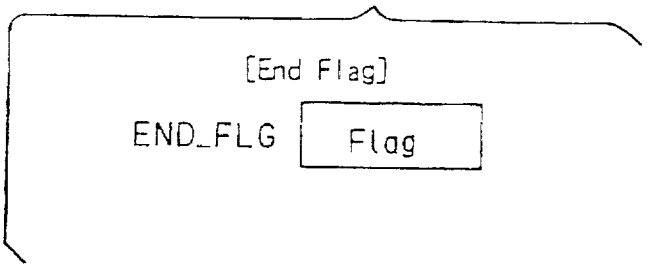
FIG. 35 is a diagram showing an end flag.

FIG. 35 is a diagram showing an end flag. The end flag is in the form of a memory of 1 byte, but may be of 1 bit in view of a function of the flag. The end flag takes a value of "0" or "1". "0" represents that the scan for sound generation of one step during the arpeggio playing is not finished, while "1" represents that the scan for sound generation of one step is finished. In this embodiment, this is expressed as END_FLG.

Figure 36:
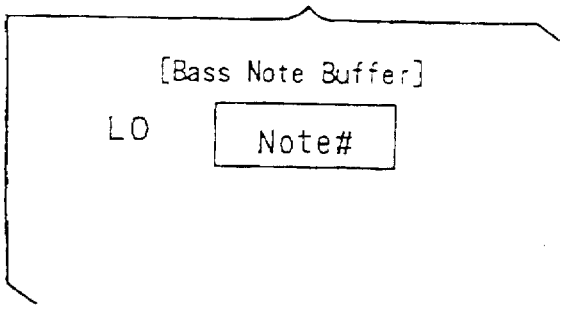
FIG. 36 is a diagram showing a bass note buffer.

FIG. 36 is a diagram showing a bass note buffer. The bass note buffer is a memory of 1 byte, wherein a note number of a key of the lowest-pitched tone among the pushed keys, including the hold data, is stored. In this embodiment, this is expressed as LO.

Figure 37:
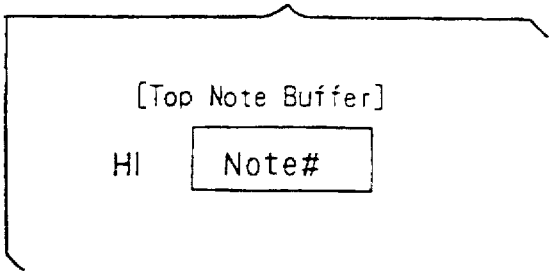
FIG. 37 is a diagram showing a top note buffer.

FIG. 37 is a diagram showing a top note buffer. The top note buffer is a memory of 1 byte, wherein a note number of a key of the highest-pitched tone among the pushed keys, including the hold data, is stored. In this embodiment, this is expressed as HI.

Although further memories other than the foregoing memories are provided to be used as working areas, the later program explanation will be sufficient for those further memories so that independent explanation thereof is omitted.

Hereinbelow, the programs to be executed by the CPU using the foregoing tables and memories will be explained.

Figure 38:
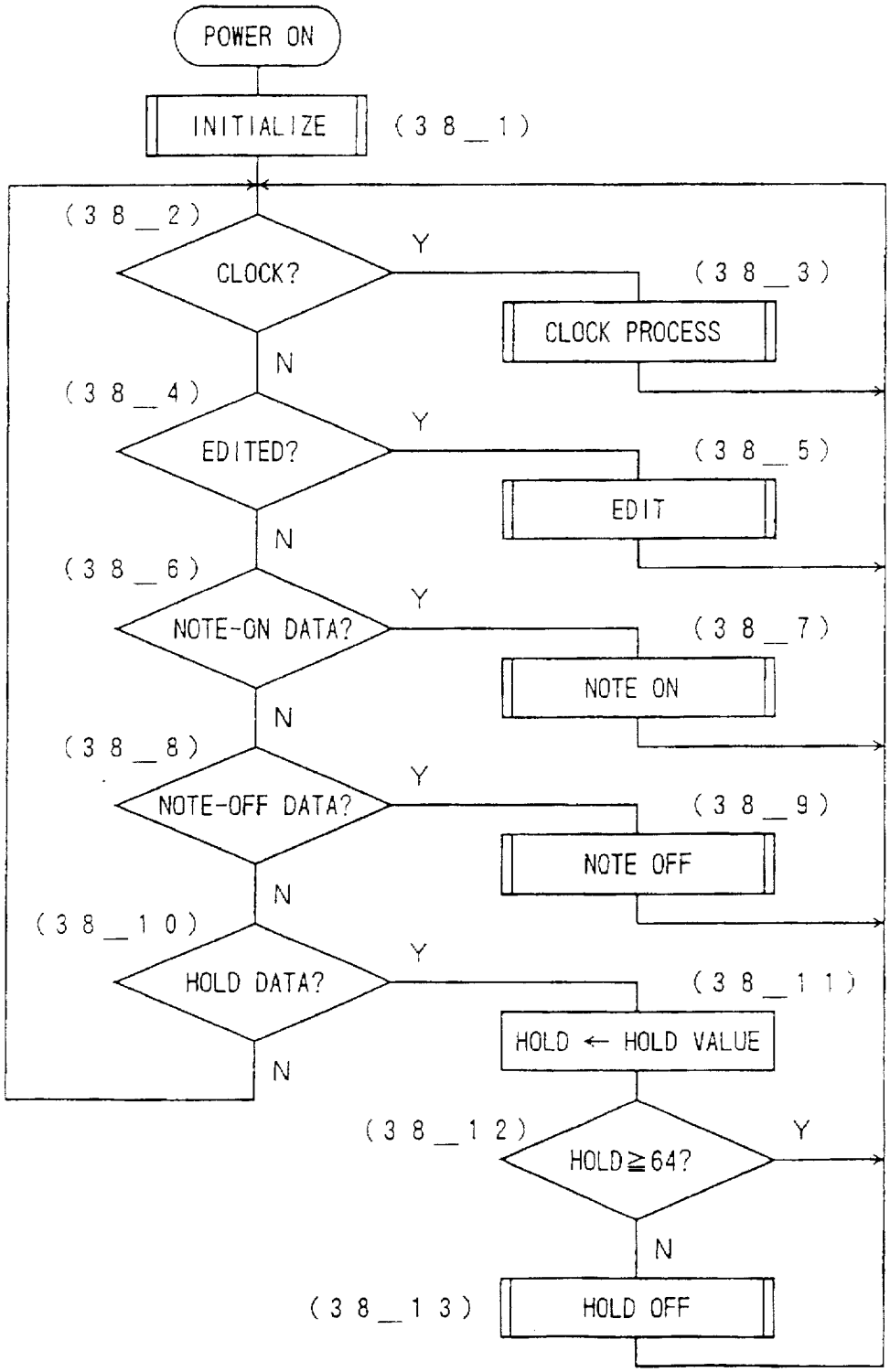
FIG. 38 is a flowchart of a general program.

FIG. 38 is a flowchart of a general program which starts to be operated when the power is on, and continues to be operated until the power is off.

When the power is on, the predetermined initialization is first performed (step 38_1). Thereafter, it is monitored in order in a cyclic fashion whether a clock is fed from the clock timer 16 (see FIG. 1) (step 38_2), whether the panel 15 (see FIGS. 1 and 2) is operated to edit any parameter (step 38_4), whether the note-on data (key-pushing data) is inputted (step 38_6), whether the note-off data (key-releasing data) is inputted (step 38_8) and whether the hold data is inputted (step 38_10). If steps 38_2, 38_4, 38_6, 38_8 and 38_10 yield positive answers, a clock process (step 38_3), an edit process (step 38_5), a note-on process (step 38_7), a note-off process (step 38_9) and a hold data process (steps 38_11, 38_12, 38_13) are executed, respectively.

In the hold data process, a hold value is first stored in HOLD (see FIG. 26) (step 38_11). Then, it is determined whether the hold value is equal to or greater than 64 representing the hold-on (step 38_12). If the hold value is equal to or less than 63 representing the hold-off, a hold-off process is executed (step 38_13).

Figure 39:
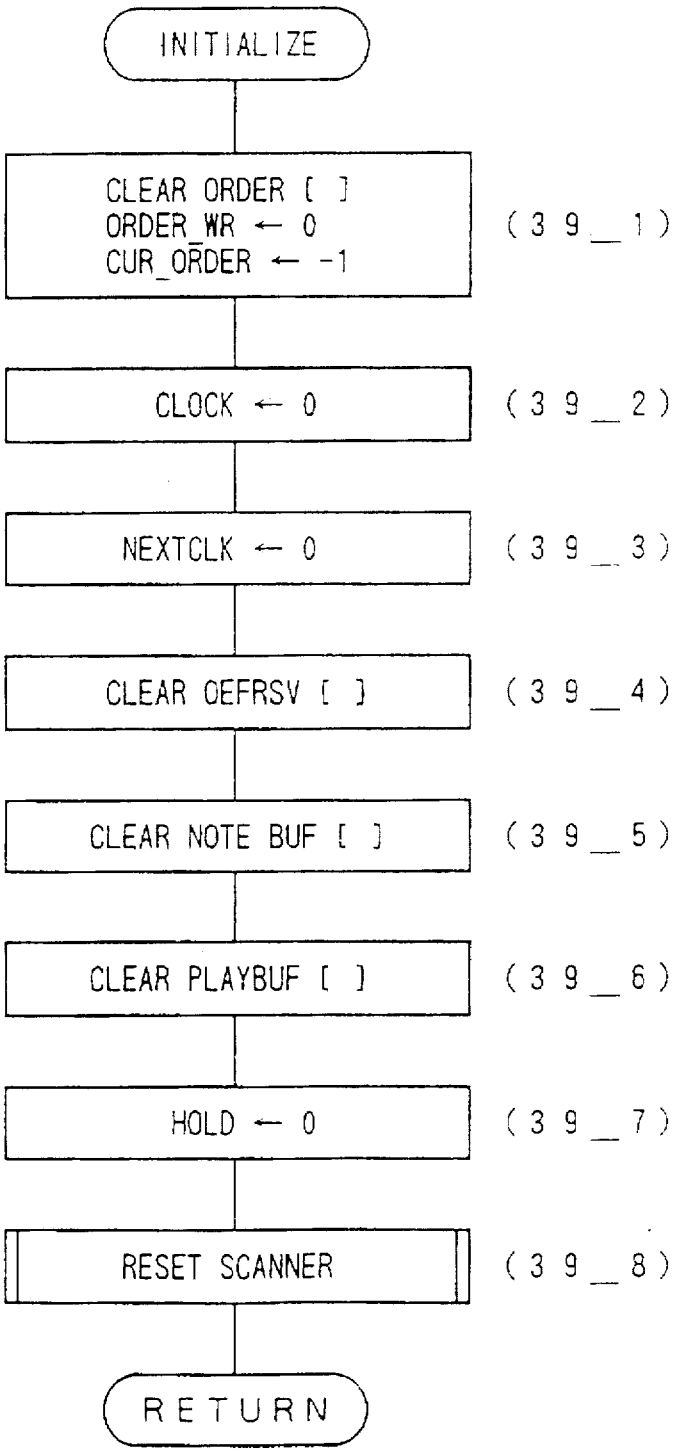
FIG. 39 is a flowchart of an initialization routine.

FIG. 39 is a flowchart of an initialization routine. This initialization routine is executed at step 38_1 of the general program shown in FIG. 38.

In the initialization routine, first, the order buffer ORDER [ ] (see FIG. 27), where the velocities upon key-pushing are stored in order of key-pushing, is cleared, the storage pointer ORDER_WR (see FIG. 28) of the order buffer ORDER [ ] is initialized to "0" (head of ORDER [ ]), and further, the order position counter CUR_ORDER (see FIG. 29) is initialized to "−1" representing that it is a timing to start a series of steps of the arpeggio playing (step 39_1).

Subsequently, the clock counter CLOCK (see FIG. 32) for counting the clocks generated by the clock timer 16 (see FIG. 1) is initialized to "0" (step 39_2), and the next clock buffer NEXTCLK (see FIG. 33) for storing a timing of generation of the next playing data is also initialized to "0" (step 39_3). Further, the note off reservation buffer OFFRSV [ ] (see FIG. 34) for storing note numbers to be note-off and timings for the note-off is cleared (step 39_4). Then, the note buffer NOTEBUF [ ] (see FIG. 23) having an arrangement corresponding to the key arrangement of the keyboard 20 (see FIG. 1) for storing the velocities of the pushed keys is cleared (step 39_5). Further, the play buffer PLAYBUF [ ] (see FIG. 24) for storing the velocities including the hold data is cleared (step 39_6). Then, the hold buffer HOLD (see FIG. 26) for storing the hold value is cleared to "0" (step 39_7), and further, a reset scanner routine for resetting a scanner is executed (step 39_8).

Figure 40:
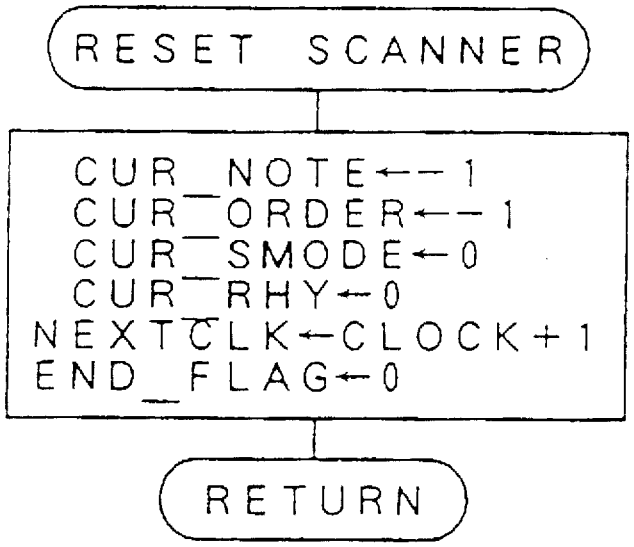
FIG. 40 is a flowchart of a reset scanner routine.

FIG. 40 is a flowchart of the reset scanner routine. The reset scanner routine is executed at step 39_8 of the initialization routine shown in FIG. 39.

In this routine, the current playing note number buffer CUR_NOTE (see FIG. 25) for storing the current note number during the arpeggio playing stores "−1" representing "vacant", and the order position counter CUR_ORDER (see FIG. 29) for indicating the current step of the order buffer ORDER [ ] (see FIG. 27) during the arpeggio playing also stores "−1 " representing "vacant". Further, the scan mode table position counter CUR_SMODE (see FIG. 31) and the rhythm pattern table position counter CUR_RHY (see FIG. 30) working as pointers for the scan mode table and the rhythm pattern table are initialized to "0" representing the heads thereof, respectively. Further, a value obtained by adding "1" to CLOCK (see FIG. 32) is stored in the next clock buffer NEXTCLK (see FIG. 33).

The reason why NEXTCLK is set to the value obtained by adding "1" to CLOCK is as follows: As described later, a tone is generated (note-on data is sent) when NEXTCLK=CLOCK. Accordingly, the foregoing reason is for preventing a possibility that CLOCK is incremented during execution of this program so as to exceed NEXTCLK representing the sound generation start timing to disable the sound generation.

Further, in the reset scanner routine shown in FIG. 40, the end flag END_FLG representing whether the operation for sound generation of one step during the arpeggio playing is finished or nonfinished, stores "0" which represents "nonfinished".

Figure 41:
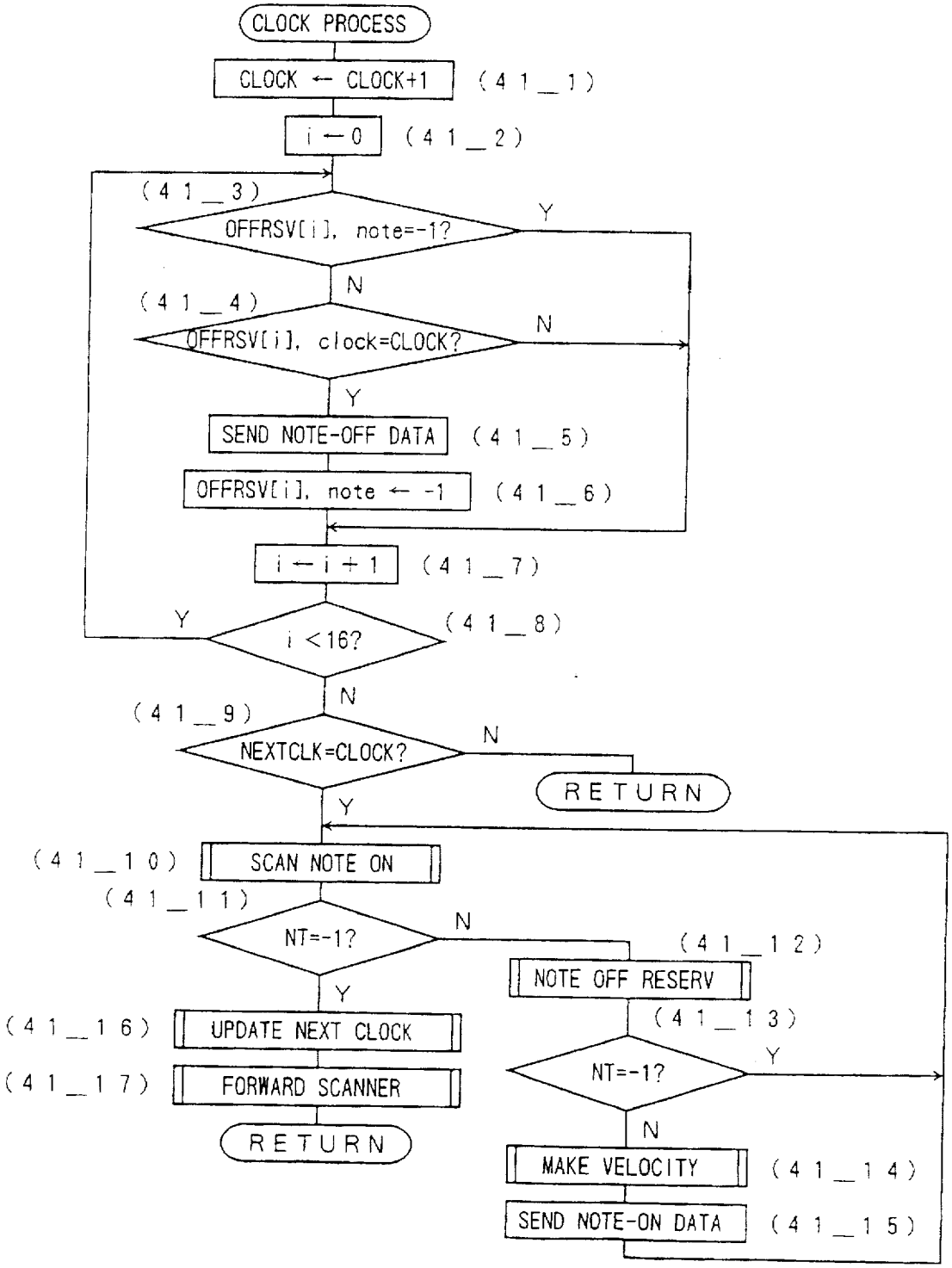
FIG. 41 is a flowchart of a clock process routine.

FIG. 41 is a flowchart of a clock process routine. The clock process routine is executed at step 38_3 of the general program shown in FIG. 38.

In this clock process routine, CLOCK (see FIG. 32) is first incremented (step 41_1 ).

Subsequently, OFFRSV [ ] (see FIG. 34) is searched to see whether the note-off data to be sent at the current timing exists or not, and if positive, that note-off data is sent (steps 41_2~41_8).

Specifically, i is first set to "0" (step 41_2), and then, it is checked whether the effective note-off data is stored (0~127) or not (−1) in OFFRSV [i]. note (step 41_3). If "−1", i is incremented (step 41_7), and the search is continued until i reaches 16 (step 41_8). If the effective note-off data is stored as checked at step 41_3, the routine proceeds to step 41_4 where it is determined whether OFFRSV [i]. clock is equal to the current CLOCK. If positive, that note-off data is sent as playing data (step 41_54), and "−1 " is written in OFFRSV [i]. note where the sent note-off data was stored (step 41_6).

When the search for the note-off data is finished, a process for finding out the note-on data to be sent is performed (steps 41_9~41_17).

Specifically, it is determined whether the current CLOCK reaches NEXTCLK, that is, whether a timing for sending the note-on data is reached (step 41_9). If not reached, the routine is terminated.

On the other hand, if NEXTCLK=CLOCK, the routine proceeds to step 41_10 where a scan note-on routine is executed for scanning the key-pushing data (step 41_10). In the scan note-on routine details of which will be described later, one of the note numbers to be sent is stored in NT. NT=−1 represents that the note to be sent does not exist. If it is determined at step 41_11 that NT is not−1, that is, the note to be sent exists, the routine proceeds to step 41_12 where a note-off reservation routine is executed. In this note-off reservation routine details of which will also be described later, a note-off reservation is performed by storing the note-off data corresponding to the note-on data to be sent subsequently in OFFRSV [ ] (see FIG. 34). If OFFRSV [ ] is full, "−1 " representing that the note-off reservation is not allowed, is stored in NT.

Step 41_13 checks whether NT=−1 so as to know whether the note-off reservation was performed. If the note-off reservation is not possible, the routine returns to step 41_10 without sending the note-on data so as to search the next note-on data to be sent. If NT≠−1 at step 41_13, that is, the note-off reservation was performed normally, the routine proceeds to step 41_14 where a velocity generation routine is executed. In the velocity generation routine details of which will also be described later, a velocity of the note-on data to be sent is produced through later-described calculations. Thereafter, the note-on data is sent at step 41_15. Then, the routine returns to step 41_10 where the search is performed to see whether the note-on data to be further sent at the current timing.

If "−1 " is stored in NT at step 41_10, that is, the note-on data to be sent at the current timing does not exist (or the note-on data to be sent at the current timing were all sent), the routine proceeds to step 41_16 via step 41_11.

At step 41_16, a next clock update routine is executed. In this next clock update routine details of which will also be described later, a timing next to the note-on data sending is stored in NEXTCLK. Subsequently, the routine proceeds to step 41_17 where a scanner update routine is executed. In this scanner update routine, the scanner is updated. The scanner update routine will also be described later in detail.

Figure 42:
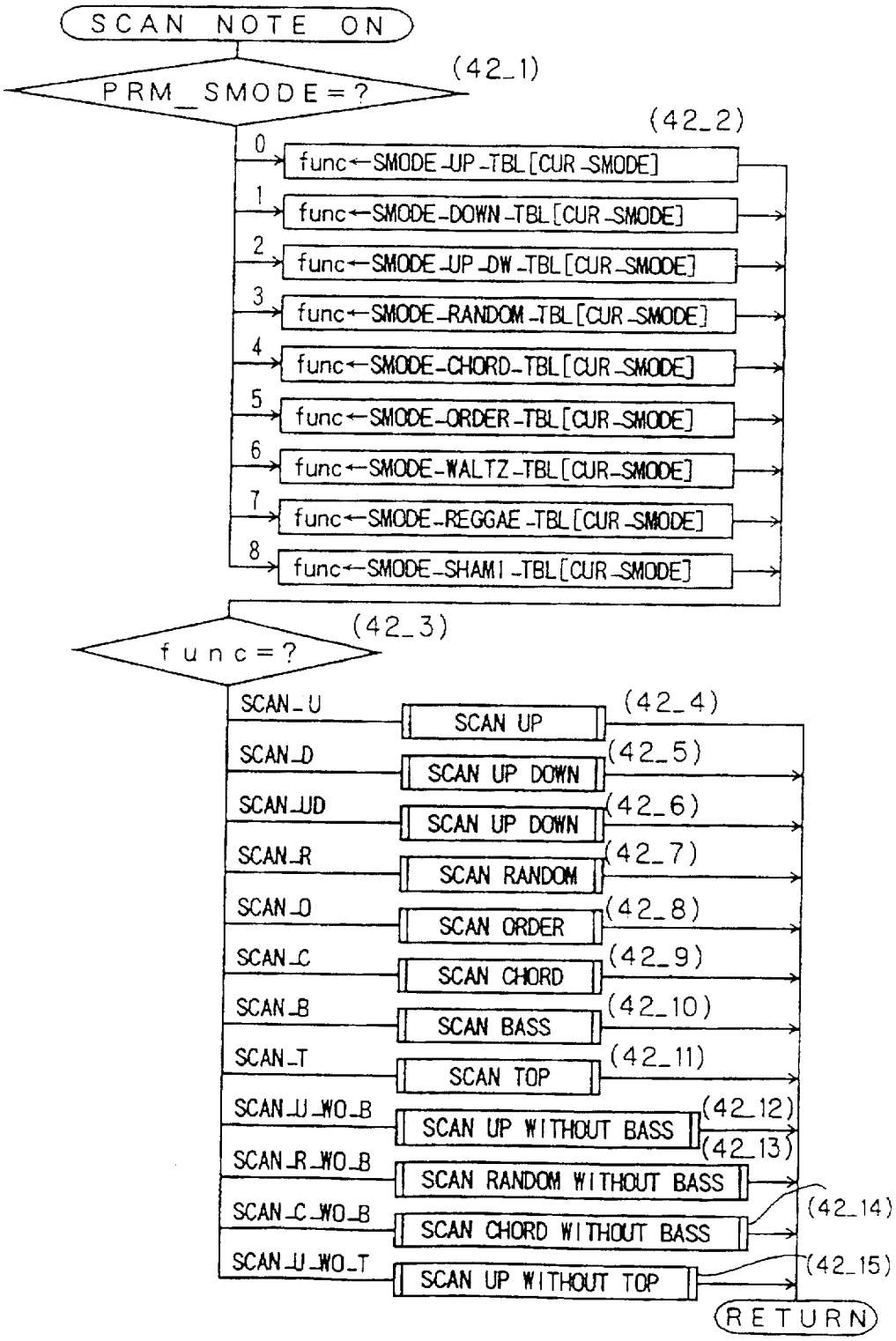
FIG. 42 is a flowchart of a scan note-on routine.

FIG. 42 is a flowchart of a scan note-on routine. The scan note-on routine is executed at step 41_10 of the clock process routine shown in FIG. 41.

In this scan note-on routine, PRM_SMODE (see FIG. 21) storing a scan mode number is first checked (step 42_1). Then, a scan function number SMODE_XXX_TBL [CUR_MODE] stored in a current step number CUR_SMODE in a scan mode table (see FIGS. 10~19) corresponding to a scan mode number stored in PRM_SMODE, is stored in a working area func (step 42_2). Subsequently, depending on which of SCAN_U, SCAN_D, SCAN_UD, . . . , SCAN_U_WO_T the scan function number stored in func designates, a scan-up routine (step 42_4), a scan-down routine (step 42_5), a scan-up/down routine (step 42_6), . . . , a scan-up without top routine (42_15) shown in the figure is executed.

Hereinbelow, the scan-up routine (step 42_4), the scan order routine (step 42_8), the scan chord routine (step 42_9), the scan bass routine (step 42_10) and the scan chord without bass routine (step 42_14) will be described.

Figure 43:
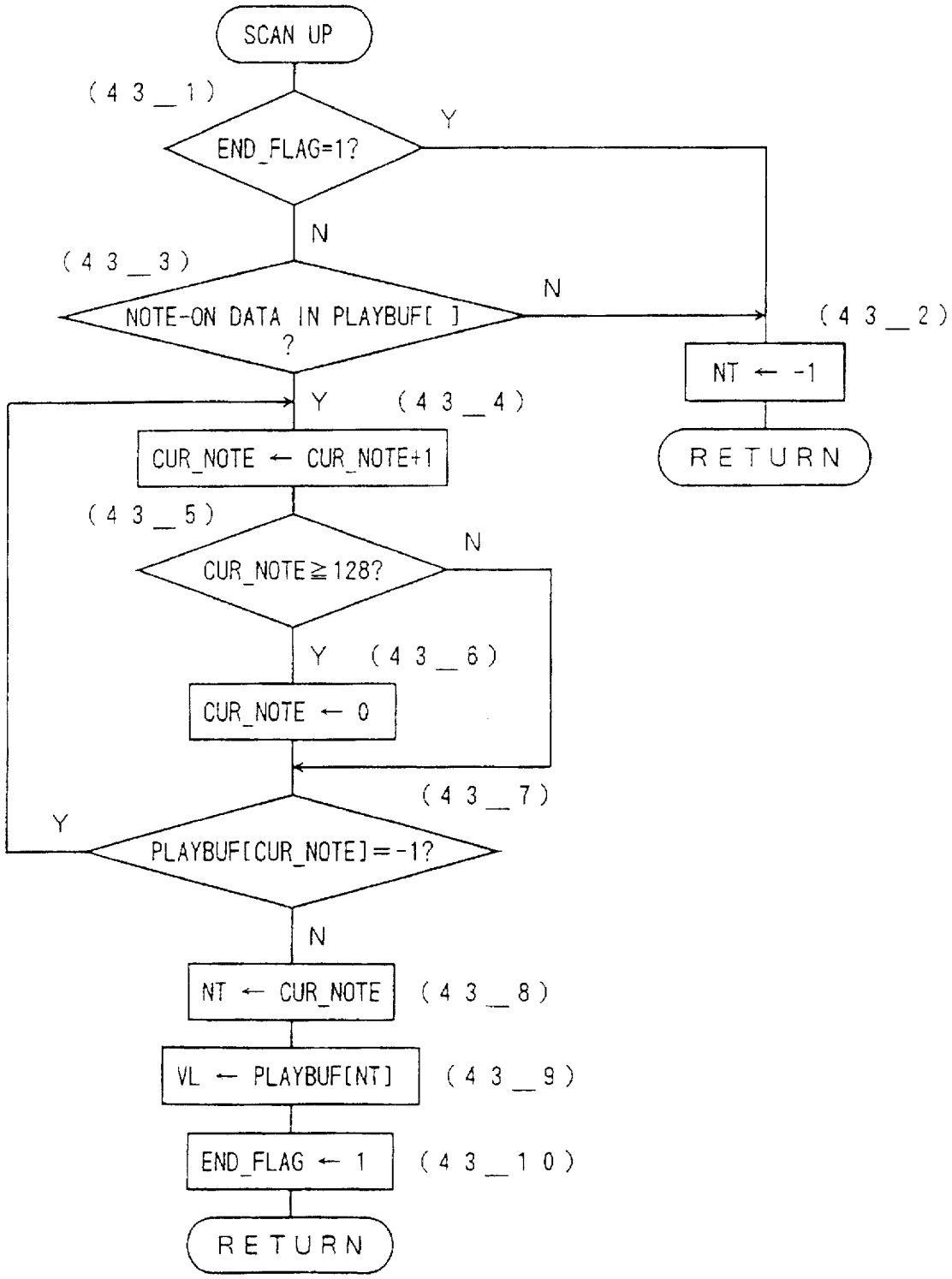
FIG. 43 is a flowchart of a scan-up routine.

FIG. 43 is a flowchart of the scan-up routine. The scan-up routine is a routine for achieving the foregoing up-scan function.

In this routine, it is determined whether END_FLG (see FIG. 35) is "1" or "0", that is, the scan for sound generation of one step at this time has been finished or not (step 43_1). If END_FLG=1, that is, the scan at this time has been finished, the routine proceeds to step 43_2 where "−1 " is stored in NT, and is terminated. When this scan-up routine is first executed at the current step, END_FLG=0 is set.

If END_FLG is not "1" at step 43_1, the routine proceeds to step 43_3 where it is determined whether at least one note-on data exists in PLAYBUF [ ] (see FIG. 24). If no note-on data exists, since sound generation is impossible, the routine proceeds to step 43_2 where "−1 " is stored in NT, and is terminated.

On the other hand, if the note-on data exists in PLAYBUF [ ], the note-on data to be sent next are scanned according to the up-scan function (steps 43_4~43_7).

Specifically, since CUR_NOTE (see FIG. 25) stores the note number of the note-on data sent immediately before, CUR_NOTE is incremented by "1" to the next note number (step 43_4). If the note number reaches 128 (step 43_5), "0" is stored in CUR_NOTE (step 43_6). Using the thus updated CUR_NOTE, it is determined whether the effective velocity data is stored in PLAYBUF [CUR_NOTE] (step 43_7). If PLAYBUF [CUR_NOTE]=−1 , that is, the effective velocity data is not stored, the routine proceeds to step 43_4 where CUR_NOTE is again incremented for achieving the scan from the lower pitch to the higher pitch to find out a region of PLAYBUF [ ] where the effective velocity is stored.

In this fashion, if PLAYBUF [ ] storing the effective velocity data is found out, CUR_NOTE at that time is stored in NT (step 43_8) and the velocity data of CUR_NOTE stored in PLAYBUF [NT] is stored in VL (step 43_9). Since only one note-on data is sent in one step in the upscan function, "1" representing the finish of scan is stored in END_FLG (step 43_10).

Figure 44:
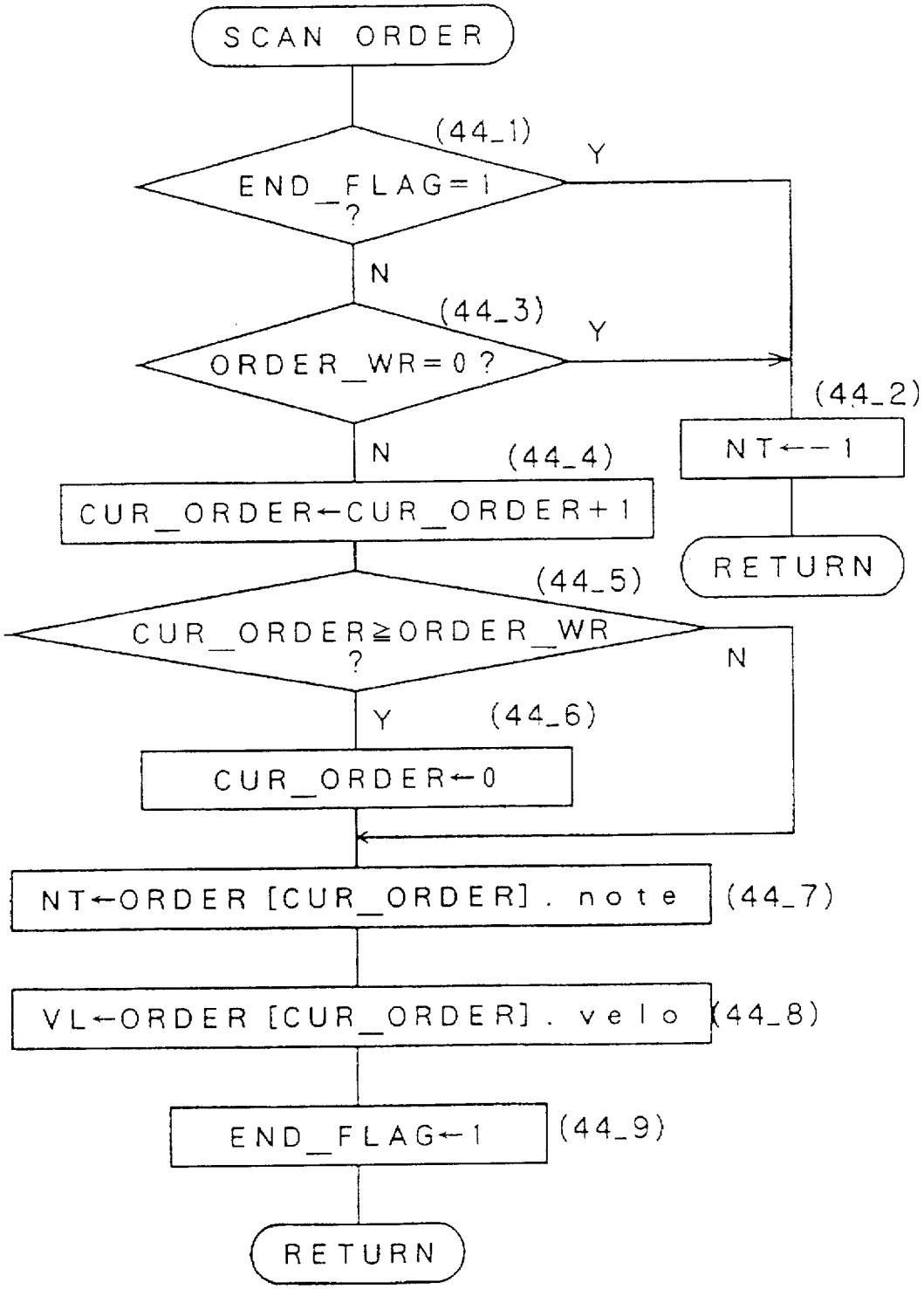
FIG. 44 is a flowchart of a scan order routine.

FIG. 44 is a flowchart of the scan order routine. The scan order routine is a routine for achieving the foregoing key-pushing order scan function.

Steps 44_1 and 44_2 are the same as steps 43_1 and 43_2 in the scan-up routine shown in FIG. 43 so that explanation thereof is omitted.

At step 44_3, it is checked whether ORDER_WR=0. As described before with reference to FIG. 28, ORDER_WR is a pointer for ORDER [ ] (see FIG. 27) storing the key-pushing data in order of key-pushing. ORDER_WR=0 represents that ORDER [ ] is vacant so that the key-pushing order arpeggio playing can not be performed. In this case, the routine proceeds to step 44_2 where "−1 " is stored in NT, and is terminated.

If step 44_3 determines that ORDER_WR is not 0, that is, ORDER [ ] is not vacant, the routine proceeds to step 44_4 where CUR_ORDER (see FIG. 29) is incremented. Subsequently, it is determined whether CUR_ORDER exceeds the maximum step written in ORDER [ ] (step 44_5). If positive, "0" is stored in CUR_ORDER (step 44_6). Using CUR_ORDER having a value thus updated, the note number ORDER [CUR_ORDER], note to be sound-generated next is stored in NT (step 44_7), and the velocity ORDER [CUR_ORDER], velo of that note number is stored in VL (step 44_8). Also in this key-pushing order scan function, only one note-on data is sent in one step so that "1" representing the finish of scan is stored in END_FLG (step 44_9).

Figure 45:
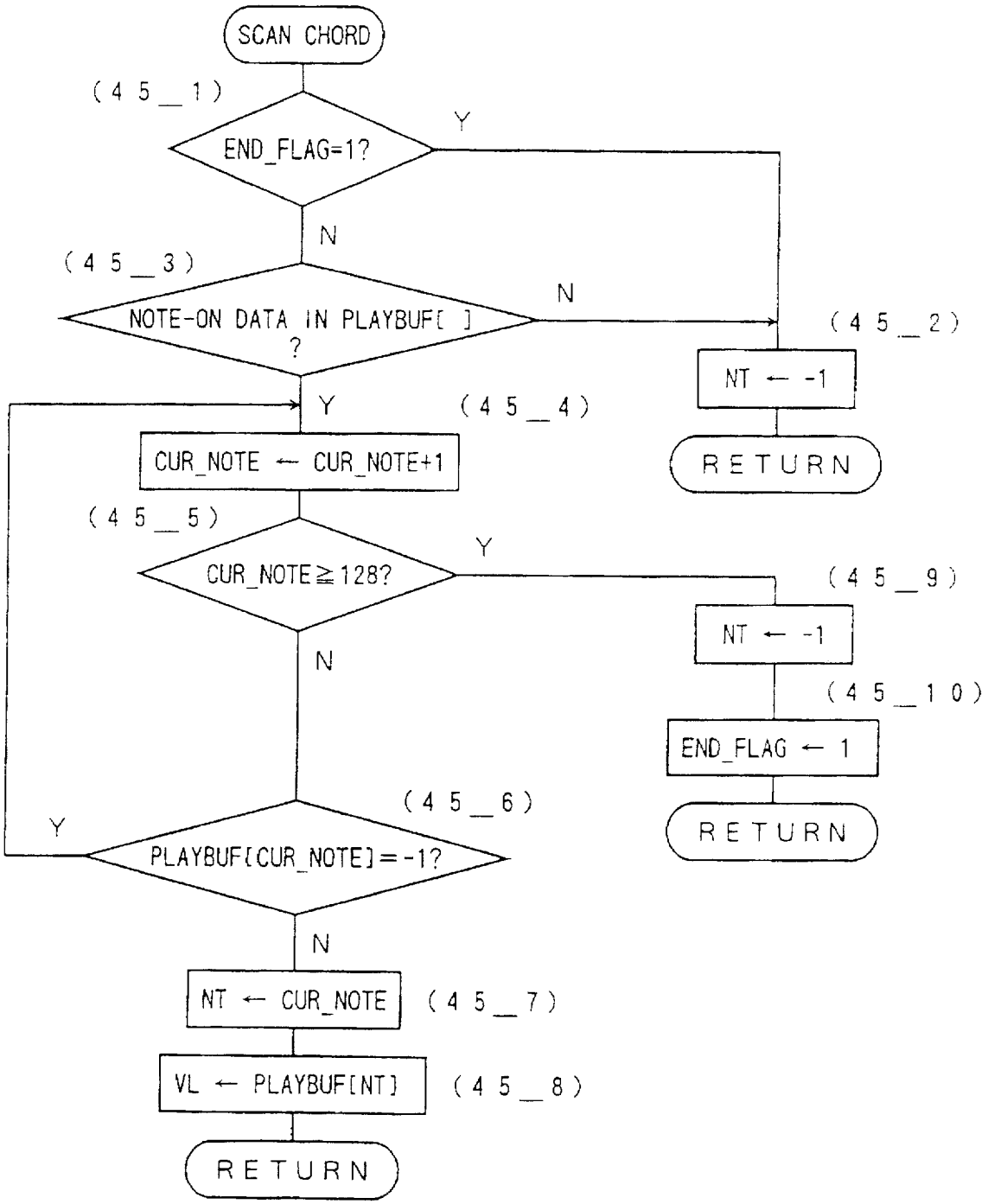
FIG. 45 is a flowchart of a scan chord routine.

FIG. 45 is a flowchart of the scan chord routine. The scan chord routine is a routine for achieving the foregoing chord scan function.

Steps 45_1, 45_2 and 45_3 are the same as steps 43_1, 43_2 and 43_3 of the scan-up routine shown in FIG. 43 so that explanation thereof is omitted.

When this scan chord routine is first executed in the current step, "−1 " is stored in CUR_NOTE. Accordingly, through a loop of steps 45_4, 45_5 and 45_6, the scan is performed from CUR NOTE=0 to CUR_NOTE=127. During the scan, if a value other than "−1 ", that is, the effective velocity data, is found to be stored in PLAYBUF [CUR_NOTE], the routine proceeds to step 45_7 where that note number CUR_NOTE is stored in NT, and the velocity data PLAYBUF [NT] of that note number is stored in VL (step 45_8). Then, this routine is temporarily passed.

In the chord scan function, it is necessary to scan all the regions of PLAYBUF [ ] and send all the note-on data storing the effective velocity data. Accordingly, when passing the scan chord routine before reaching CUR_NOTE≧128, "1" is not stored in END_FLG.

If the scan chord routine is passed, the scan note-on routine shown in FIG. 42 is also passed so that step 41_10 of the clock process routine of FIG. 41 is passed. If NT≈−1, the routine proceeds through steps 41_12, 41_13, 41_14 and 41_15 so as to send one note-on data. Then, the routine again returns to step 41_10 so that the scan chord routine of FIG. 45 is again executed via the scan note-on routine of FIG. 42. At this time, the scan is performed from a value of CUR_NOTE next to the value of CUR_NOTE upon the last passing of this routine (step 45_4). If it is determined at step 45_5 that CUR NOTE≧128, that is, the scan of PLAYBUF [ ] has been finished, the routine proceeds to step 45_9 where "−1 " is stored in NT, and further to step 45_10 where "1" is stored in END_FLG.

Figure 46:
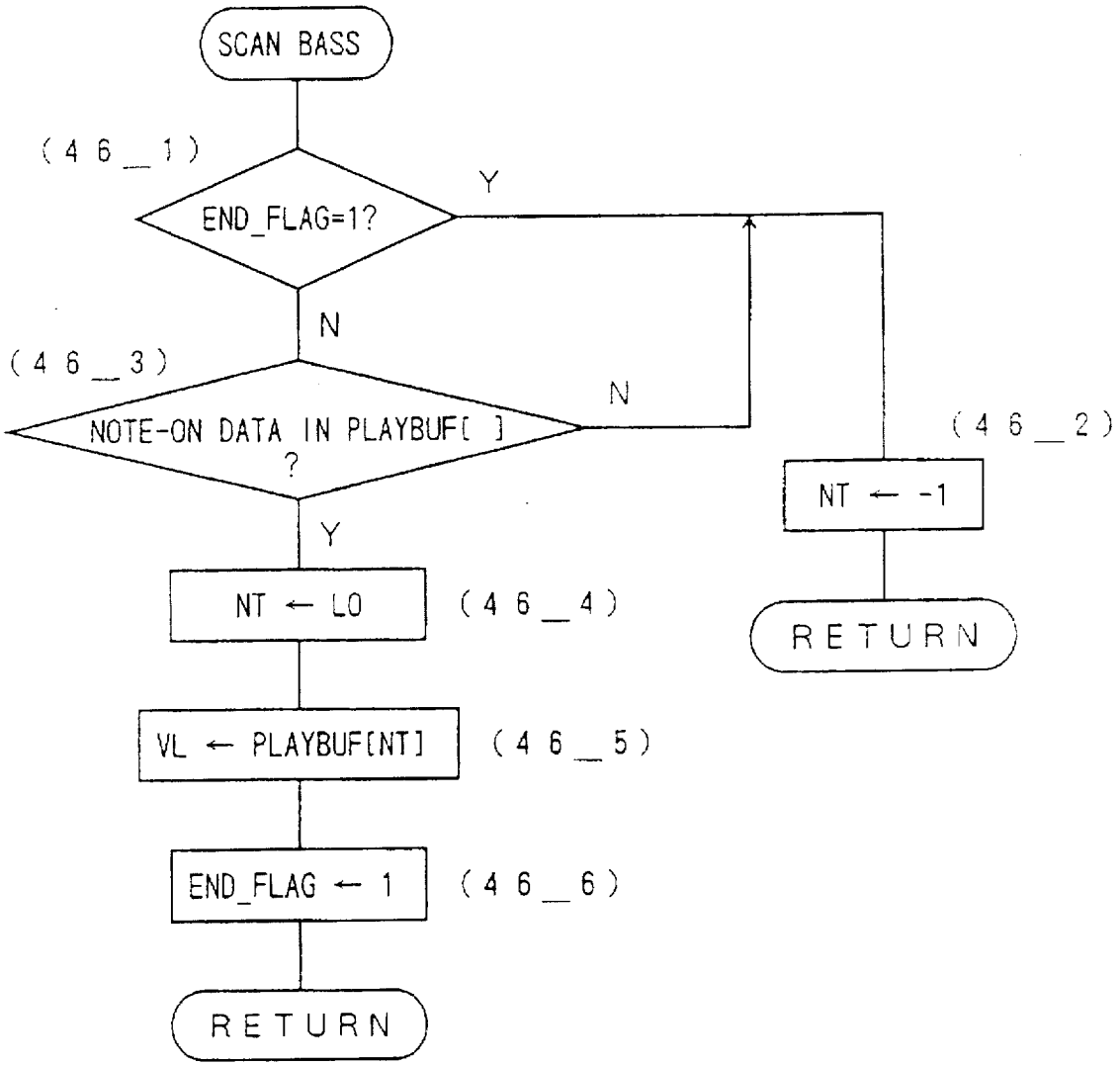
FIG. 46 is a flowchart of a scan bass routine.

FIG. 46 is a flowchart of the scan bass routine. The scan bass routine is a routine for achieving the foregoing lowest-pitched tone scan function.

Steps 46_1, 46_2 and 46_3 are the same as steps 43_1, 43_2 and 43_3 of the scan-up routine shown in FIG. 43 so that explanation thereof is omitted.

At step 46_4, the lowest-pitched tone LO (see FIG. 36) is stored in NT. The storing of the lowest-pitched tone into LO will be described later.

At step 46_5, the velocity PLAYBUF [NT] of the lowest-pitched tone LO is stored in VL. Further, at step 46_6, "1" is stored in END_FLG since the number of the lowest-pitched tone is only one.

Figure 47:
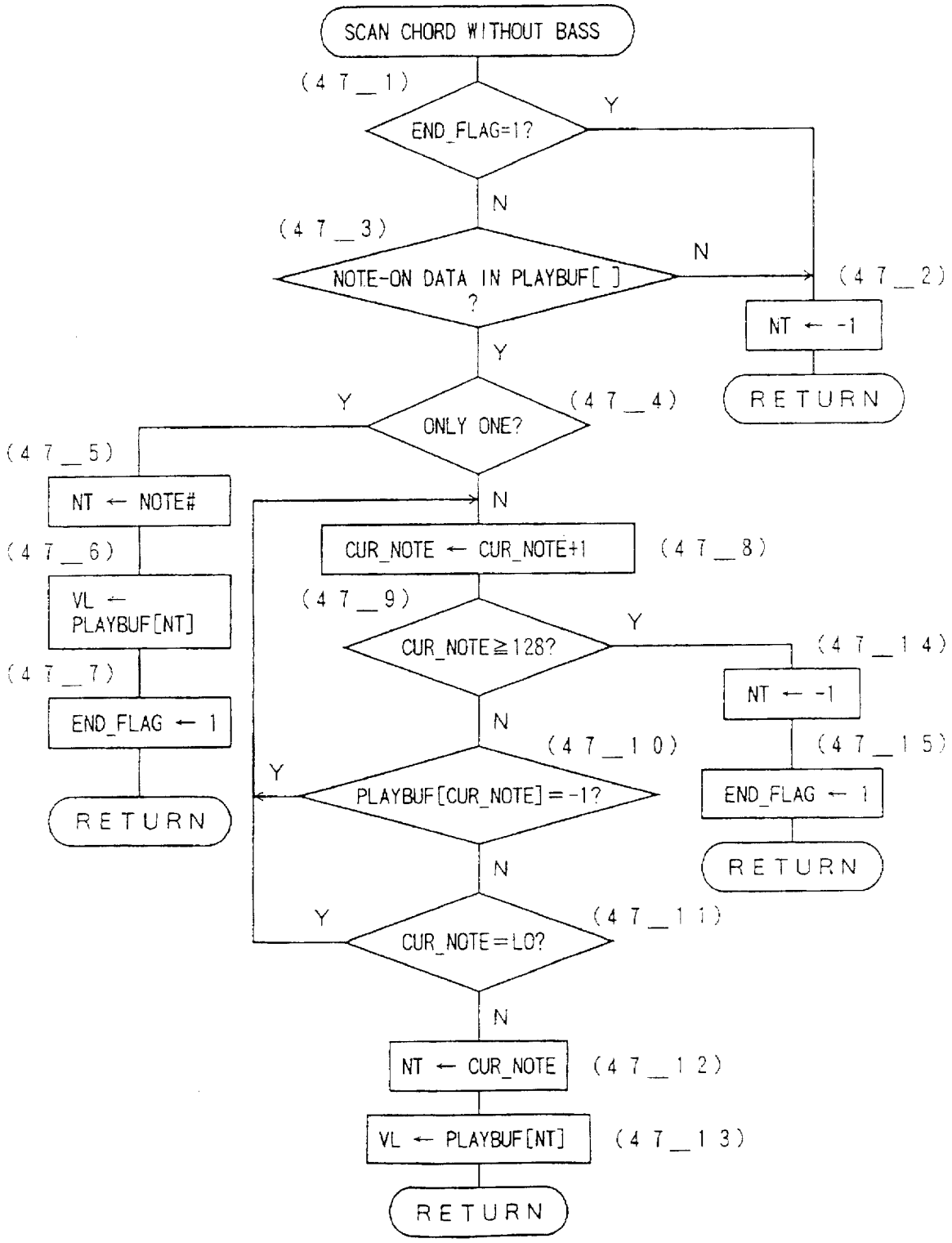
FIG. 47 is a flowchart of a scan chord without bass routine.

FIG. 47 is a flowchart of the scan chord without bass routine. This routine is a routine for achieving the foregoing chord scan function without the lowest-pitched tone.

Steps 47_1, 47_2 and 47_3 are the same as steps 43_1, 43_2 and 43_3 of the scan-up routine shown in FIG. 43 so that explanation thereof is omitted.

At step 47_4, it is determined whether only one note-on data or a plurality of note-on data exist in PLAYBUF [ ]. If only one note-on data exists, although the chord scan function without the lowest-pitched tone is actually not established, a note number of the only one note-on data is sent in this embodiment. Then, the routine proceeds to step 47_5 where the sent note number is stored in NT. Subsequently, the velocity PLAYBUF [NT] of that note number is stored in VL (step 47_6), and "1" is stored in END_FLG (step 47_7).

On the other hand, if it is determined at step 47_4 that the plurality of note-on data exist, the routine proceeds to step 47_8. When this scan chord without bass routine is first executed in the current step, "−1 " is stored in CUR_NOTE as in the scan chord routine shown in FIG. 45. The process of storing "−1 " in CUR_NOTE will be described later. Accordingly, in this routine, the scan is performed over all the regions of PLAYBUF [ ] from the lower pitch to the higher pitch. A procedure of the scan (steps 47_8~47_15) is essentially the same as the procedure of the scan (steps 45_4~45_10) in the scan chord routine shown in FIG. 45, and only differs in that it is determined at step 47_11 whether CUR_NOTE is the lowest-pitched tone LO, and if positive, that note-on data is ignored. Detailed explanation thereof is omitted. The process of storing the lowest-pitched tone in LO will be described later.

Hereinabove, the scan-up routine (step 42_4), the scan order routine (step 42_8), the scan chord routine (step 42_9), the scan bass routine (42_10) and the scan chord without bass routine (step 42_13) which are executed in the scan note-on routine shown in FIG. 42, have been explained. The scan-down routine (step 42_5), the scan-up/down routine (step 42_6), the scan random routine (step 42_7), the scan top routine (step 42_11), the scan-up without bass routine (step 42_12), the scan random without base routine (step 42_13) and the scan-up without top routine (42_14) are routines for achieving the foregoing down-scan function, up/down-scan function, random scan function, highest-pitched tone scan function, up-scan function without the lowest-pitched tone, random scan function without the lowest-pitched tone and up-scan function without the highest-pitched tone, respectively. Since these routines are obvious from the foregoing routines (FIGS. 43~47), showing on the drawings and explanation thereof are omitted.

Figure 48:
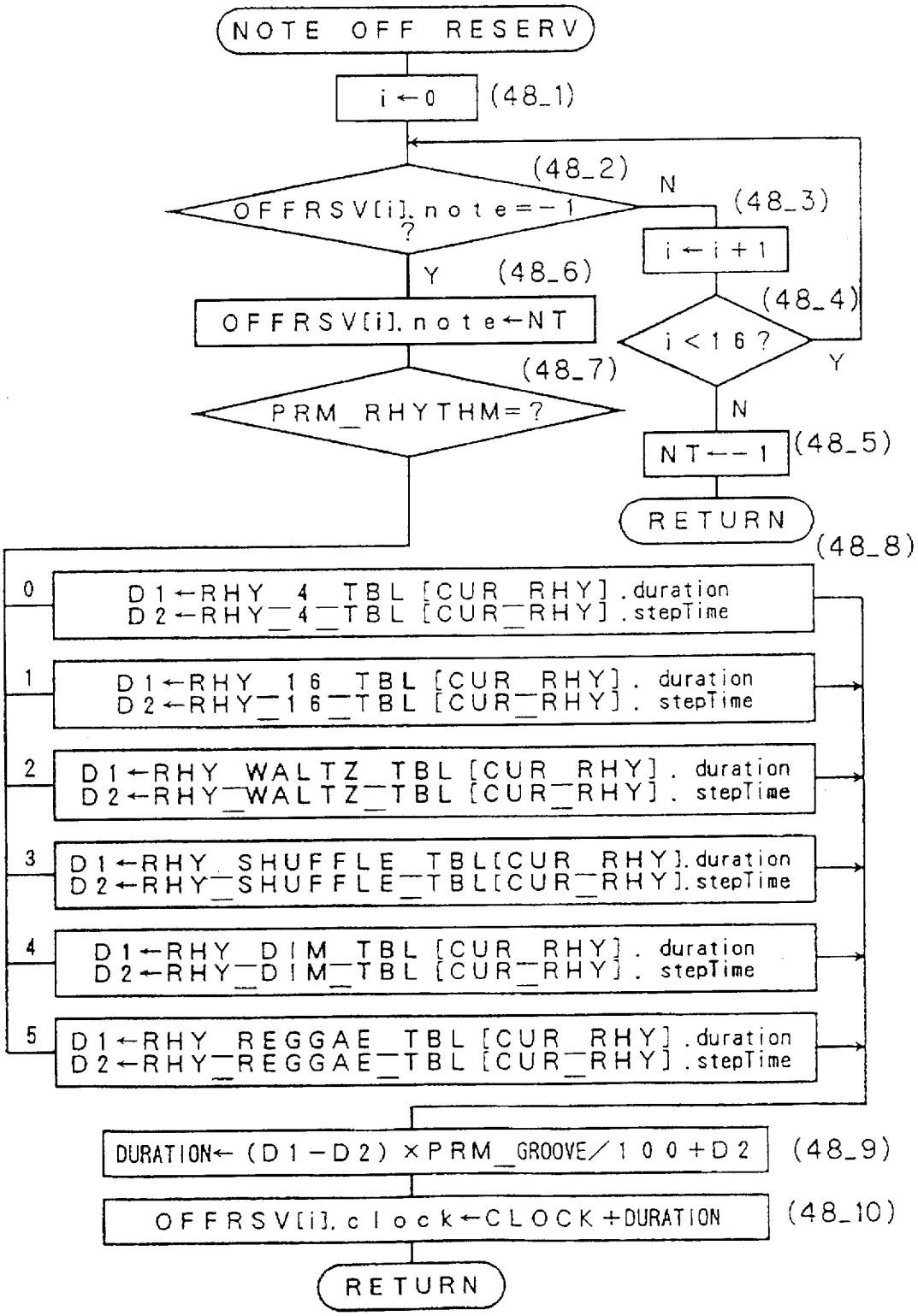
FIG. 48 is a flowchart of a note-off reservation routine.

FIG. 48 is a flowchart of the note-off reservation routine. The note-off reservation routine is executed at step 41_12 of the clock process routine shown in FIG. 41.

In the note-off reservation routine, OFFRSV [ ] (see FIG. 34) to be used in note-off reservation is searched for locating a vacant region. On the other hand, based on a duration and a step time read out from the rhythm pattern table and a groove rate PRM_GROOVE set by operating the groove rate setting operator 153 (see FIG. 2), a duration is calculated. Then, based on the calculated duration, a timing of the note-off is derived. By setting the note-off timing in the vacant region of OFFRSV [ ], the note-off reservation is achieved.

Specifically, i is set to "0" at step 48_1, and then it is determined at step 48_2 whether OFFRSV [i]. note =−1, that is, whether OFFRSV [i] is vacant or not. If OFFRSV [i]. note ≠−1, that is, OFFRSV [i] is not vacant, i is incremented (step 48_3). Subsequently, it is determined whether i exceeds a magnitude of the arrangement of OFFRSV [ ] (step 48_4). If i is within the arrangement thereof, the routine returns to step 48_2 where it is determined whether OFFRSV [i]. note =−1 relative to the new i incremented. This is repeated. If i reaches 16 (i=16) without locating the vacant region, the routine proceeds to step 48_5 where "−1 " representing that OFFRSV [ ] is full, is stored in NT, and then is terminated.

On the other hand, if OFFRSV [i]. note =−1 at step 48_2, that is, the vacant region is found, the note number NT obtained at step 41_10 of the clock process routine of FIG. 41 is stored in the vacant region OFFRSV [i] (step 48_6).

Subsequently, depending on a rhythm pattern number PRM_RHYTHM (see FIG. 20) (step 48_7), a duration RHY_XXX_TBL [CUR_RHY]. duration and a step time RHY_XXX_TBL [CUR_RHY]. stepTime stored a step of a current step number CUR_RHY (see FIG. 30) of a rhythm pattern table RHY_XXX_TBL [ ] (see FIGS. 3~9) corresponding to the rhythm pattern number PRM_RHYTHM, are read out and stored in D1 and D2, respectively (step 48_8).

At step 48_9, based on the duration D1, the step time D2 and the groove rate PRM_GROOVE (see FIG. 22), a duration DURATION of that note number is derived by the following equation:

$$\text{DURATION}=(D1-D2)\times\text{PRM_GROOVE}/100+D2$$

When PRM_GROOVE=0, then DURATION=D2, that is, DURATION becomes equal to the step time, so that an effect as tenuto is given to the arpeggio playing. On the other hand, when PRM_GROOVE=100, then DURATION=D1, that is, DURATION becomes equal to the duration stored in the rhythm pattern table RHY_XXX_TBL [ ]. If a short duration, such as staccato, is stored in the rhythm pattern table RHY_XXX_TBL [ ], by operating the groove rate setting operator 153 shown in FIG. 2, durations of the tones can be changed in a continuous fashion from the staccato-like arpeggio playing to the tenuto-like arpeggio playing. DURATION thus derived is added to CLOCK (see FIG. 32) and stored in OFFRSV [i]. clock (step 48_10).

Figure 49:
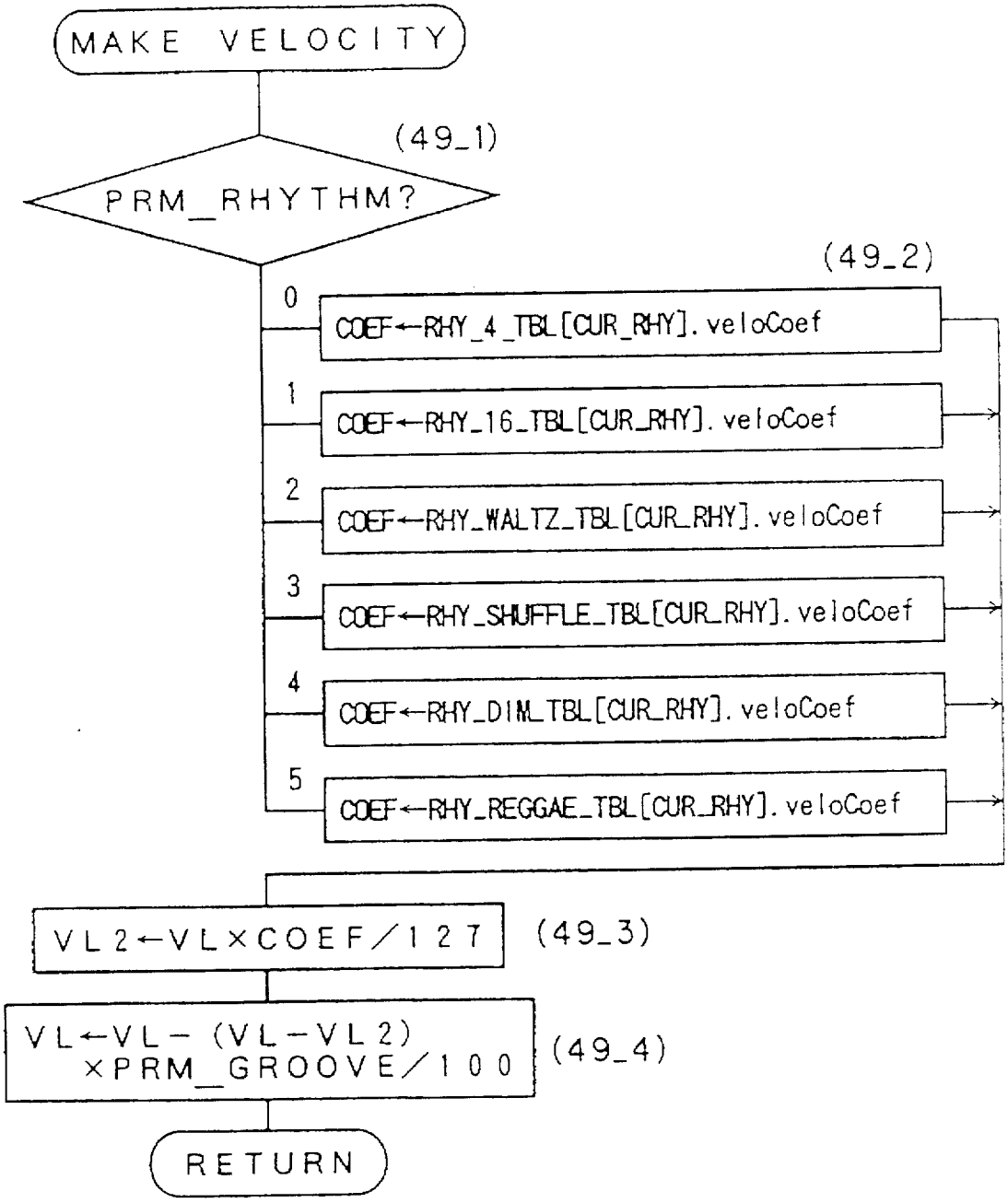
FIG. 49 is a flowchart of a velocity generation routine.
Figure 50:
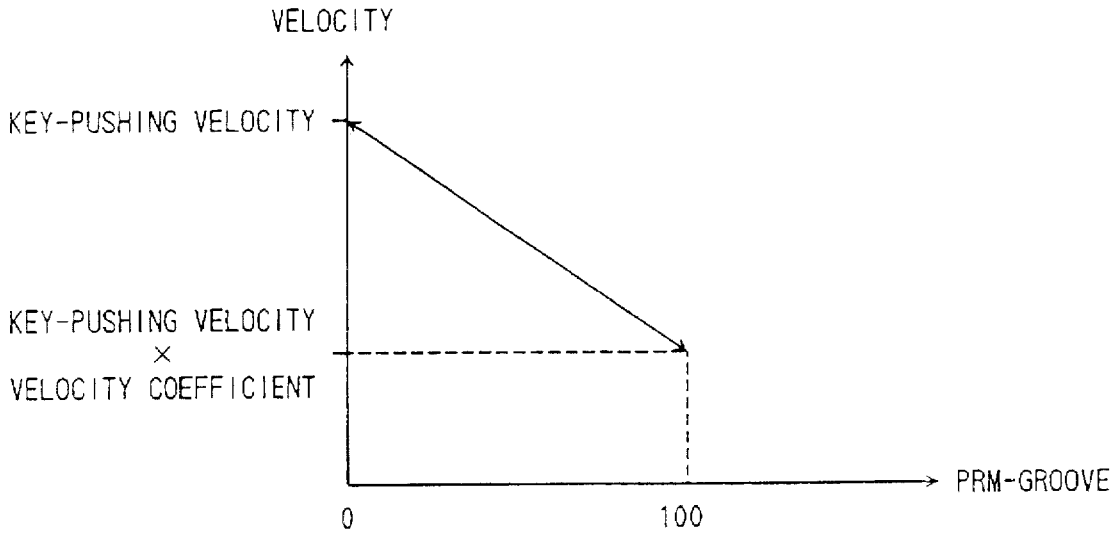
FIG. 50 is a diagram for explaining a velocity generated in the velocity generation routine shown in FIG. 49.

FIG. 49 is a flowchart of the velocity generation routine. FIG. 50 is an explanatory diagram of a velocity generated in the velocity generation routine shown in FIG. 49. The velocity generation routine shown in FIG. 49 is executed at step 41_14 of the clock process routine shown in FIG. 41.

In the velocity generation routine, the rhythm pattern number PRM_RHYTHM (see FIG. 20) is checked (step 49_1), and a velocity coefficient RHY_XXX_TBL [CUR_RHY]. veloCoef of a current step CUR_RHY (see FIG. 38) of a rhythm pattern table RHY_XXX_TBL (see FIGS. 3~9) corresponding to the rhythm pattern number PRM_RHYTHM, is read out and stored in COEF (step 49_2). Subsequently, at step 49_3, the following calculation is performed:

$$VL2=VL\times COEF/127$$

wherein COEF represents the velocity coefficient and VL represents the velocity produced by the key-pushing.

Further, at step 49_4, the following calculation is performed:

$$VL-(VL-VL2)\times\text{PRM_GROOVE}/100$$

and a derived velocity is again stored in VL.

As shown in FIG. 50, when the groove rate PRM_GROOVE set by operating the groove rate setting operator 153 shown in FIG. 2 is 0 (PRM_GROOVE=0), the key-pushing velocity is adopted as it is regardless of the velocity stored in the rhythm pattern table RHY_XXX_TBL [ ]. On the other hand, when PRM_GROOVE=100, "the key-pushing velocity×the velocity coefficient) is adopted. Further, when the groove rate PRM_GROOVE is set therebetween, the velocity which varies in a continuous fashion between the key-pushing velocity and "the key-pushing velocity x the velocity coefficient) is adopted depending on a position therebetween.

By changing the groove rate as described above, the degree of what is called "grooviness" can be changed.

At step 41_14 of the clock process routine of FIG. 41, the velocity is derived as described above, and at step 41_15, the note-on data including the thus derived velocity data is sent.

Figure 51:
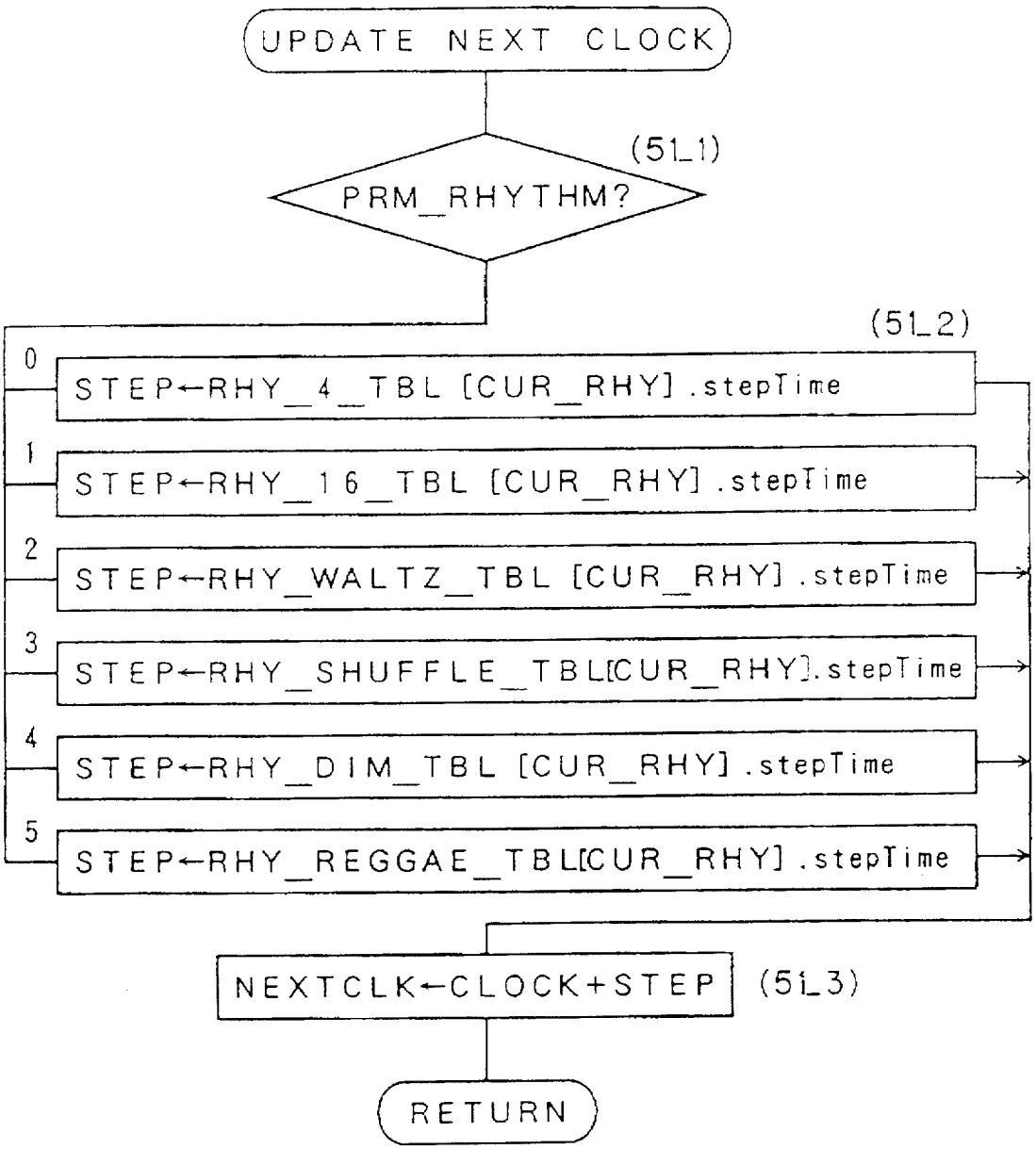
FIG. 51 is a flowchart of a next clock update routine.

FIG. 51 is a flowchart of the next clock update routine. The next clock update routine is executed at step 41_16 of the clock process routine shown in FIG. 41.

In the next clock update routine, the rhythm pattern number PRM_RHYTHM (see FIG. 20) is first checked (step 51_1), and a step time RHY_XXX_TBL [CUR_RHY]. stepTime stored in a step of a current step number CUR_RHY (see FIG. 30) of a rhythm pattern table RHY_XXX_TBL [ ] corresponding to the rhythm pattern number PRM_RHYTHM, is read out and stored in STEP (step 51_2). Then, STEP is added to CLOCK (see FIG. 32) and stored in NEXTCLK (see FIG. 33) (step 51_3) so that the next sound generation timing is set in NEXTCLK.

Figure 52:
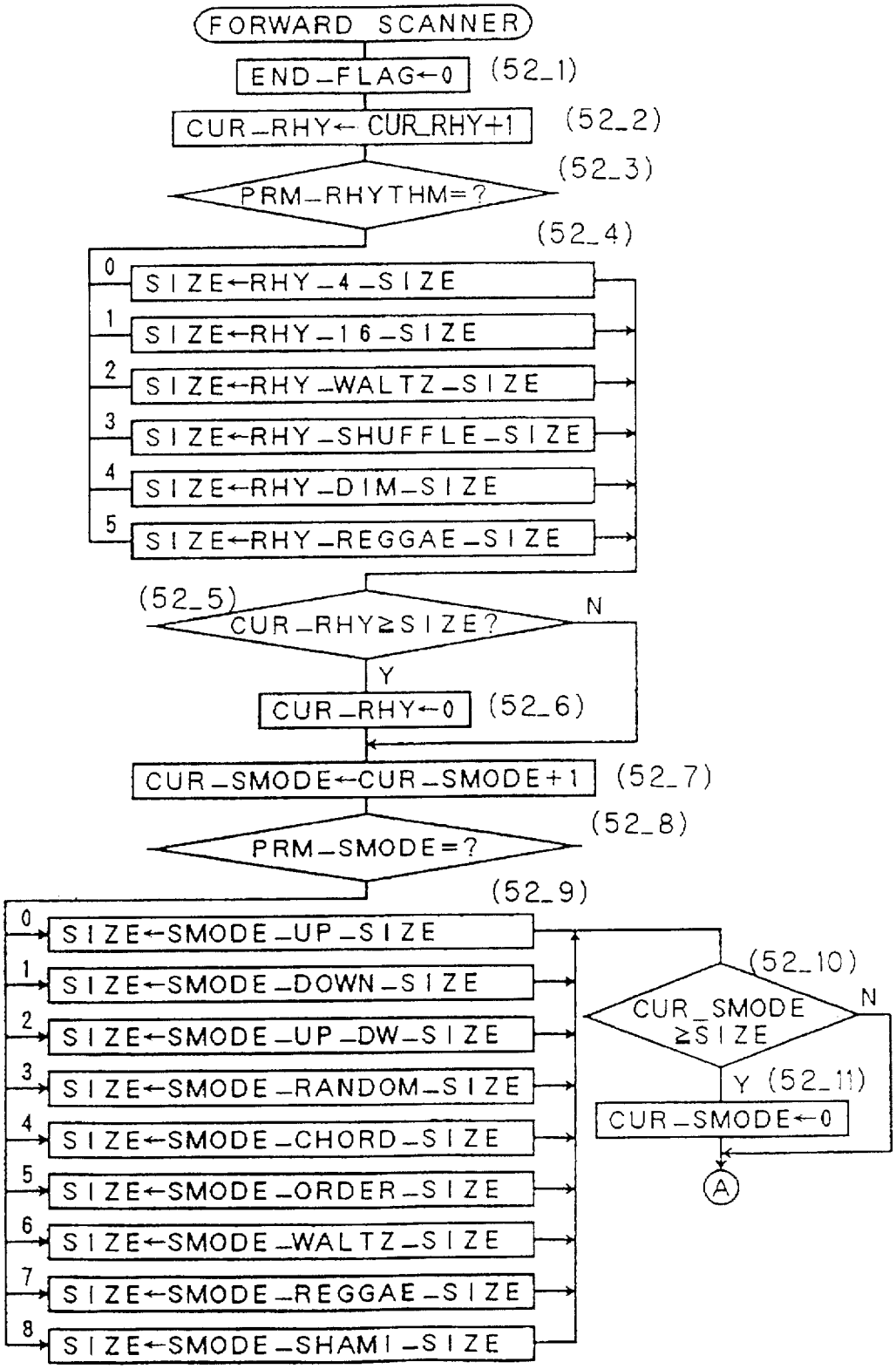
FIG. 52 is a former half of a flowchart of a scanner update routine.
Figure 53:
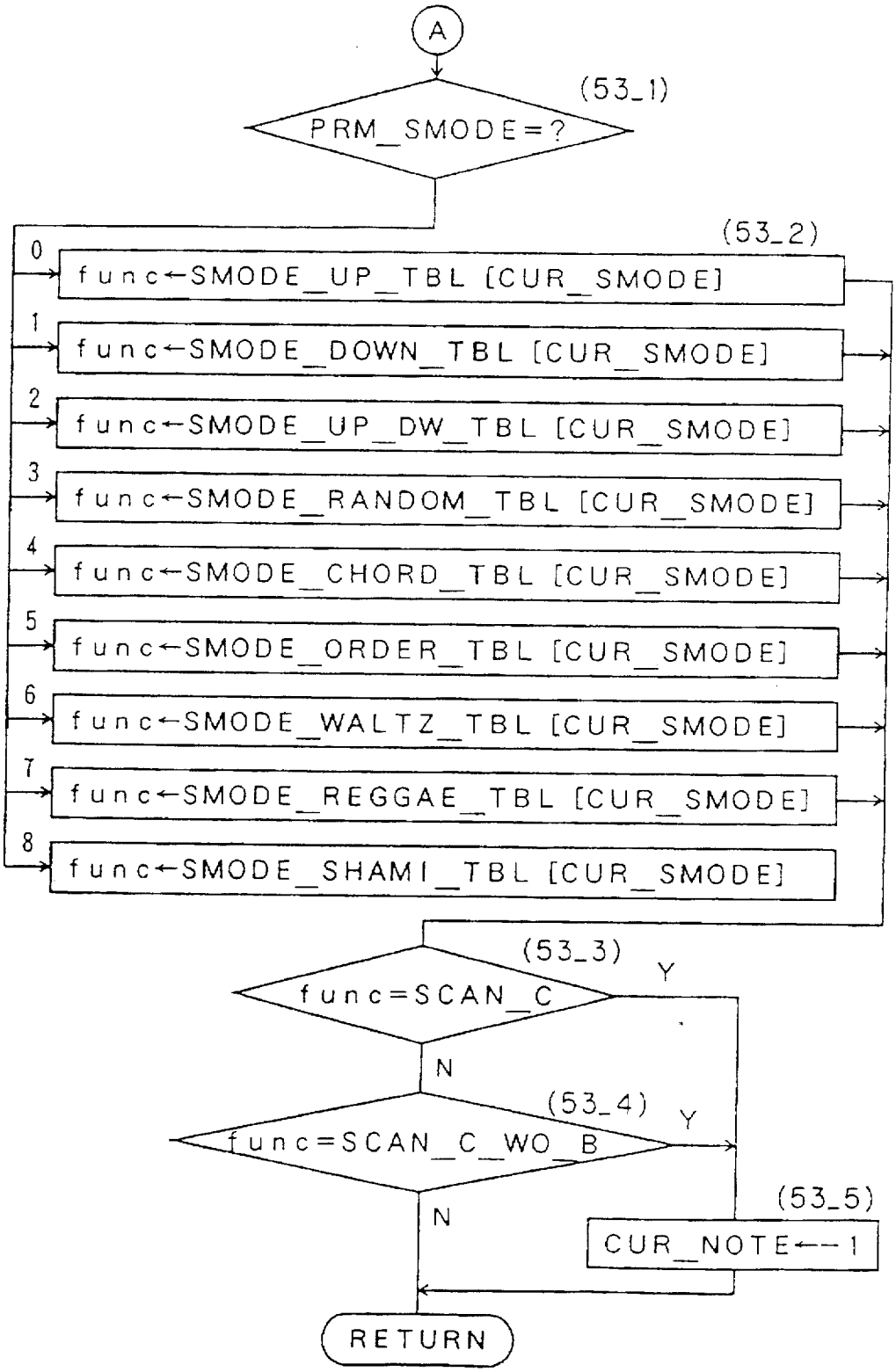
FIG. 53 is a latter half of the flowchart of the scanner update routine.

FIGS. 52 and 53 are a former half and a latter half of a flowchart of the scanner update routine, respectively. The scanner update routine is executed at step 41_17 of the clock process routine shown in FIG. 41.

In the scanner update routine, "0" is stored in END_FLG substituting "1" which was stored in the last scan of the note-on data (step 52_1). Subsequently, a current step CUR_RHY (see FIG. 30) of the rhythm pattern table is updated (steps 52_2~52_6). Specifically, at step 52_2, CUR_RHY is incremented. Then a rhythm pattern number PRM_RHYTHM (see FIG. 20) is checked (step 52_3), and the number of steps RHY_XXX_SIZE of a rhythm pattern table corresponding to the rhythm pattern number PRM_RHYTHM is read out and stored in SIZE (step 52_4). Subsequently, at step 52_5, it is determined whether CUR_RHY≧SIZE, that is, whether CUR_RHY as a result of the increment at step 52_2 exceeds the number of steps of the currently used rhythm pattern table RHY_XXX_TBL [ ]. If negative, the routine proceeds to step 52_7. On the other hand, if positive, "0" is stored in CUR_RHY (step 52_6) so as to return to the head step, and then the routine proceeds to step 52_7.

At steps 52_7~52_11, a current step CUR_SMODE (see FIG. 31) of the scan mode table is updated. Specifically, at step 52_7, CUR_SMODE is incremented. Subsequently, a scan mode number PRM_SMODE (see FIG. 21) is checked (step 52_8), and the number of steps SMODE_XXX_SIZE of the scan mode table corresponding to the scan mode number PRM_SMODE is read out and stored in SIZE (step 52_9). If CUR_SMODE≧SIZE (step 52_10), CUR_SMODE is return to the head (step 0) (step 52_11).

Then, the routine proceeds to step 53_1 shown in FIG. 53 where the scan mode number PRM_SMODE (see FIG. 21) is checked. Then, a scan function number SMODE_XXX_TBL [CUR_SMODE] of the step CUR_SMODE, updated through steps 52_7~52_11 in FIG. 52, of the scan mode table SMODE_XXX_TBL [ ] corresponding to the scan mode number PRM_SMODE, is read out and stored in rune. At step 53_3, it is determined whether func is the chord scan function SCAN_C, and at step 53_4, it is determined whether func is the chord scan function without the lowest-pitched tone SCAN_C_WO_B. If SCA_C or SCAN_C_WO_B, "−1 " is stored in CUR_NOTE (see FIG. 25) (step 53_5). By storing "−1 " in CUR_NOTE, PLAYBUF [ ] is scanned from the lower pitch to the higher pitch upon scanning of the note-on data (see FIGS. 45 and 47).

Figure 54:
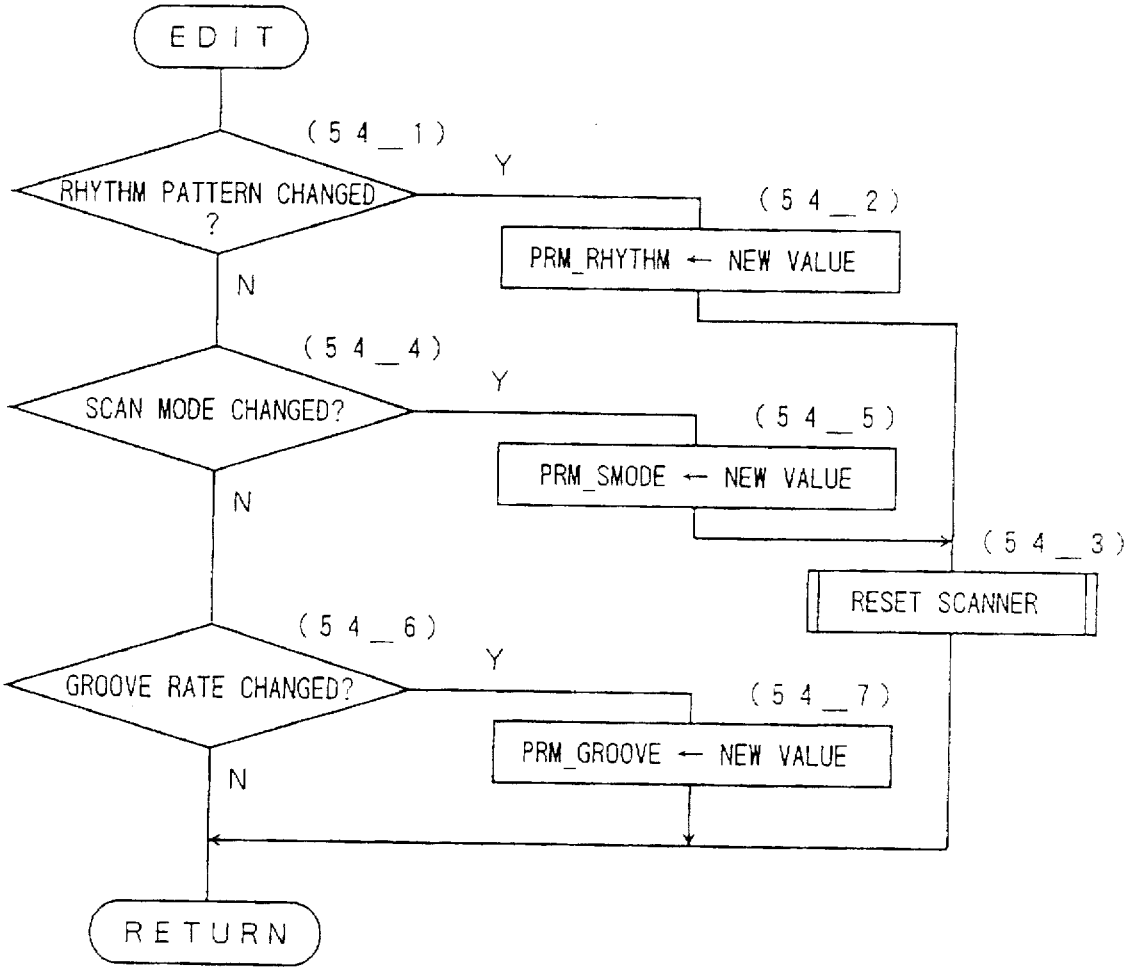
FIG. 54 is a flowchart of an edit routine.

FIG. 54 is a flowchart of the edit routine. The edit routine is executed at step 38_5 of the general program shown in FIG. 38 when the panel 15 (see FIG. 2) is operated.

At step 54_1, it is determined whether the rhythm pattern is changed. The change of the rhythm pattern is achieved by operating the rhythm pattern setting operator 15 1 shown in FIG. 2. At step 54_2, a new rhythm pattern number after the change is stored in PRM_RHYTHM (see FIG. 20). Then, the routine proceeds to step 54_3 where the reset scanner routine (see FIG. 40) is executed to reset the scanner.

At step 54_4, it is determined whether the scan mode is changed. The change of the scan mode is achieved by operating the scan mode setting operator 152 shown in FIG. 2. When the scan mode is changed by operating the scan mode setting operator 152, a new scan mode number after the change is stored in PRM_SMODE (see FIG. 21) at step 54_5, and the scanner is reset at step 54_3.

At step 54_6, it is determined whether the groove rate is changed. The change of the groove rate is achieved by operating the groove rate setting operator 153 shown in FIG. 2. When the groove rate is changed by operating the groove rate setting operator 153, the routine proceeds to step 54_7 where a new value of the groove rate after the change is stored in PRM_GROOVE (see FIG. 22).

Figure 55:
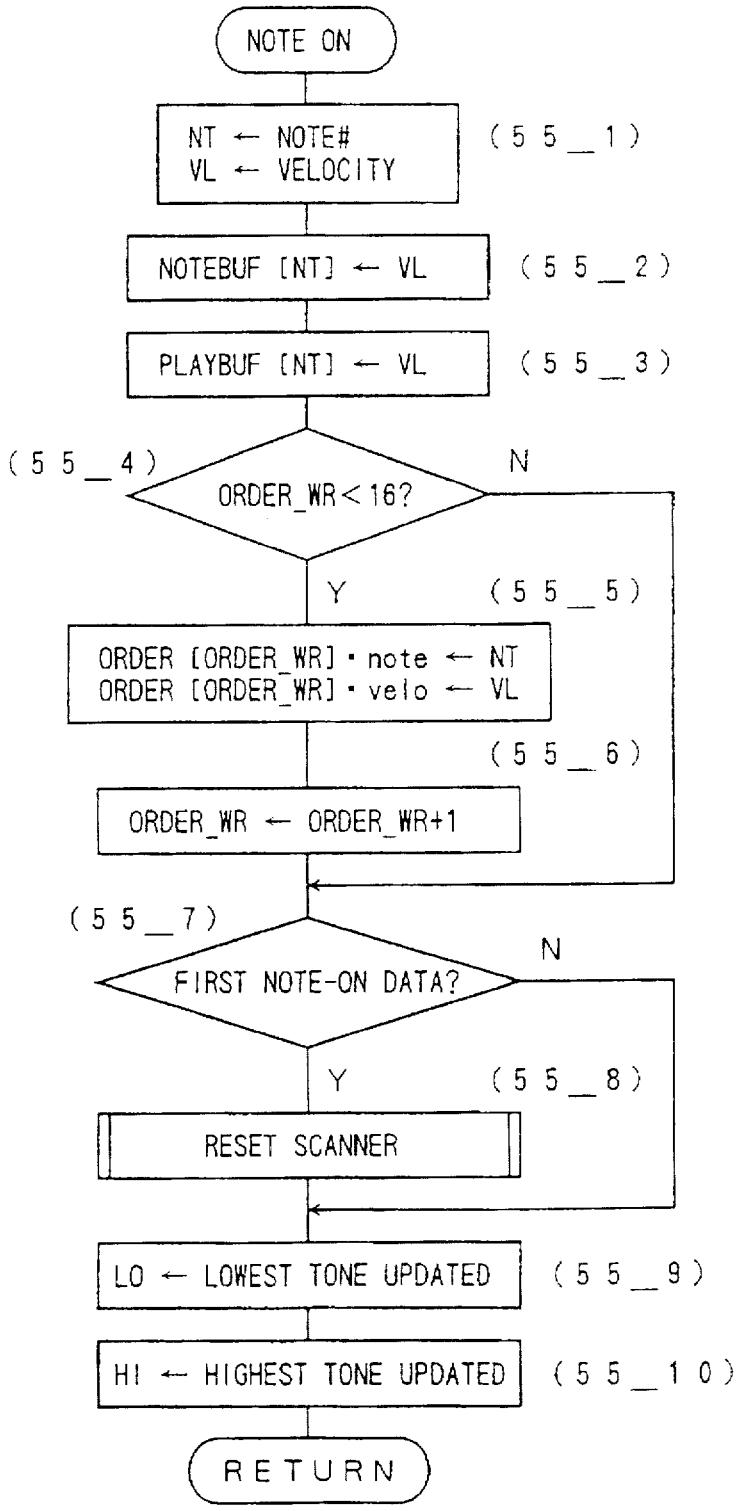
FIG. 55 is a flowchart of a note-on process routine.

FIG. 55 is a flowchart of the note-on process routine. The note-on process routine is executed at step 38_7 of the general program shown in FIG. 38 when the note-on data is received.

At step 55_1, a note number and a velocity of the received note-on data are stored in NT and VL, respectively. The velocity VL is stored in NOTEBUF [NT] (see FIG. 23) (step 55_2) and in PLAYBUF [NT] (see FIG. 24) (step 55_3). Subsequently, it is determined at step 55_4 whether ORDER_WR (see FIG. 28) is less than 16. If less than 16, since the key-pushing order buffer ORDER [ ] (see FIG. 27) has a vacant region, the note number NT is stored in ORDER [ORDER_WR]. note and the velocity VL is stored in ORDER [ORDER_WR]. velo (step 55_5). At step 55_7, it is determined whether the currently-input note-on data is note-on data which was first received in a state where all the keys are released (note-off). Specifically, it is determined whether the effective velocity data stored in PLAYBUF [ ] is only the velocity currently stored at step 55_3. If positive, the routine proceeds to step 55_8 where the scanner is reset. Thereafter, PLAYBUF [ ] is scanned so as to update the lowest-pitched tone LO and the highest-pitched tone HI (steps 55_9 and 55_10).

Figure 56:
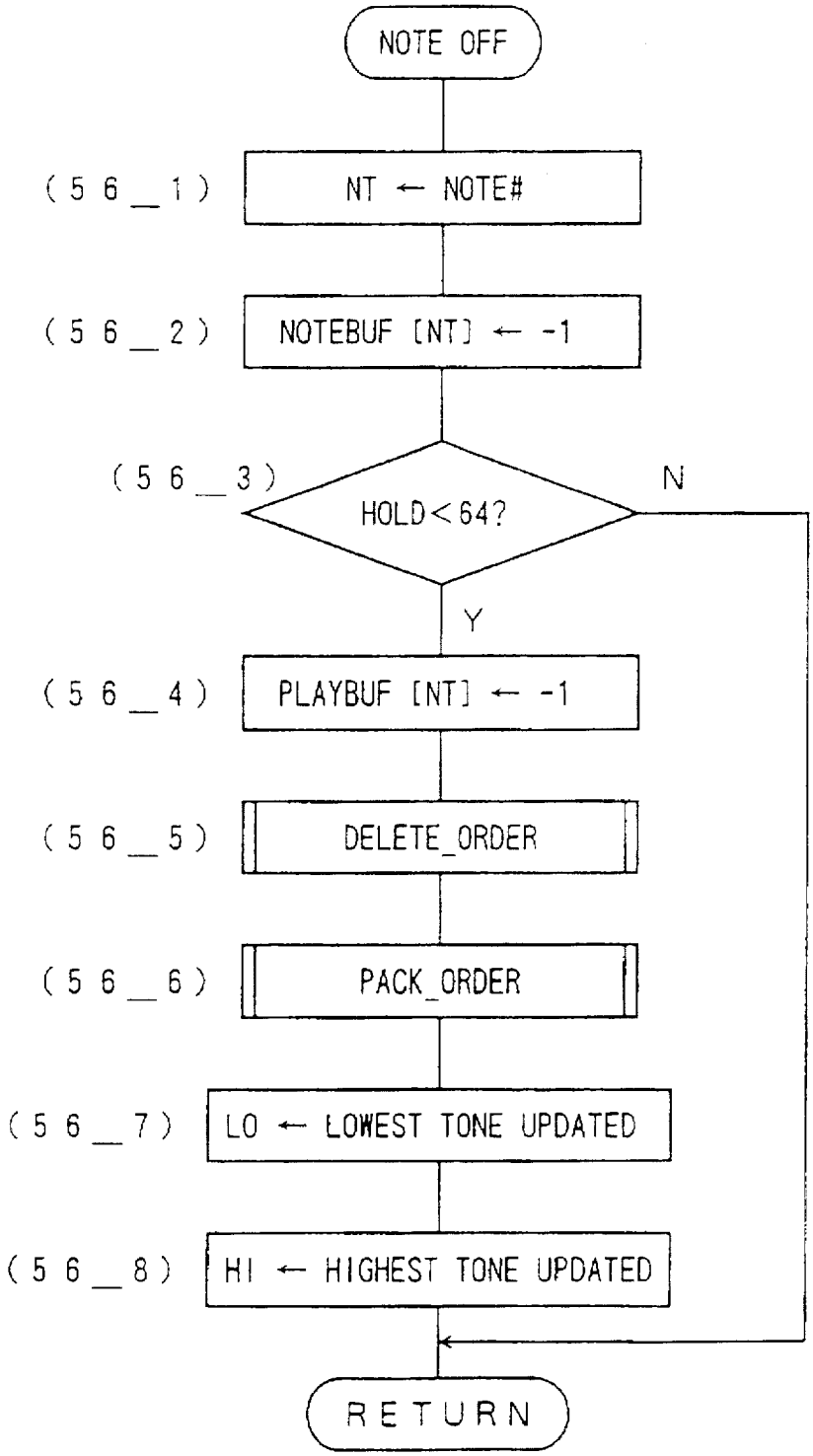
FIG. 56 is a flowchart of a note-off process routine.

FIG. 56 is a flowchart of the note-off process routine. The note-off process routine is executed at step 38_9 of the general program shown in FIG. 38 when the note-off data is received.

At step 56_1, a note number of the received note-off data is stored in NT. Then, at step 56_2, "−1 " representing that no effective data is stored, is stored in NOTEBUF [NT] (see FIG. 23). Subsequently, at step 56_3, it is determined whether HOLD (see FIG. 26) is less than 64 (hold-off). If hold-on (no less than 64), the routine is terminated. On the other hand, if hold-off (less than 64), "−1 " is stored in PLAYBUF [NT] (see FIG. 24) (step 56_4). Then, a delete order routine is executed for deleting the note-on data corresponding to the current note-off data from the key-pushing order buffer ORDER [ ] (see FIG. 27) (step 56_5), and further, a pack order routine is executed for packing forward the key-pushing order buffer ORDER [ ] whose data is partially deleted at step 56_5 (step 56_6). At steps 56_7 and 56_8, PLAYBUF [ ] is searched to update the lowest-pitched tone LO and the highest-pitched tone HI, respectively.

Figure 57:
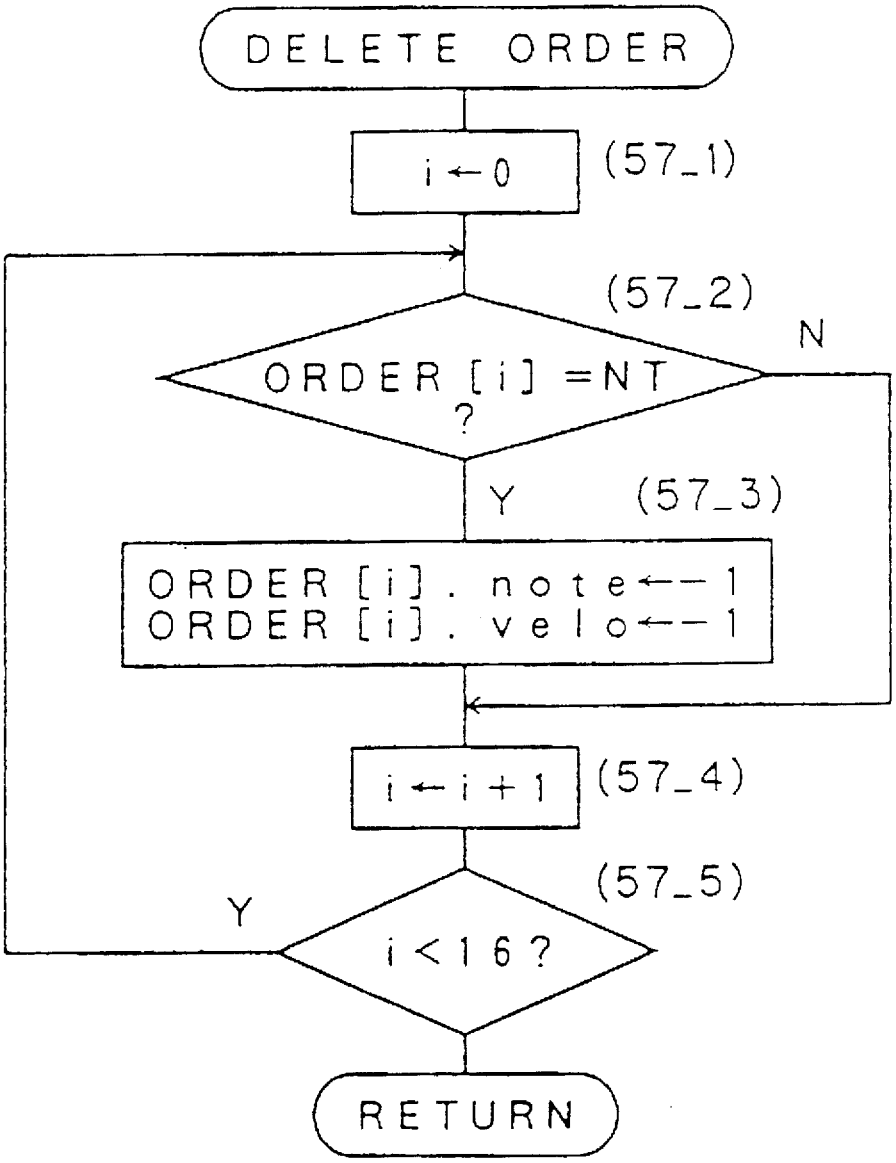
FIG. 57 is a flowchart of a delete order routine.

FIG. 57 is a flowchart of the delete order routine. The delete order routine is executed at step 56_5 of the note-off process routine shown in FIG. 56.

In this routine, ORDER [ ] is searched (see FIG. 27) for existence of the note number NT of the note-off data (steps 57_1~57_5). If ORDER [i]=NT, "−1 " is stored both in ORDER [i], note and ORDER [i] . velo. If NT is stored in a plurality of ORDER [i], "−1 " is stored in all of them.

Figure 58:
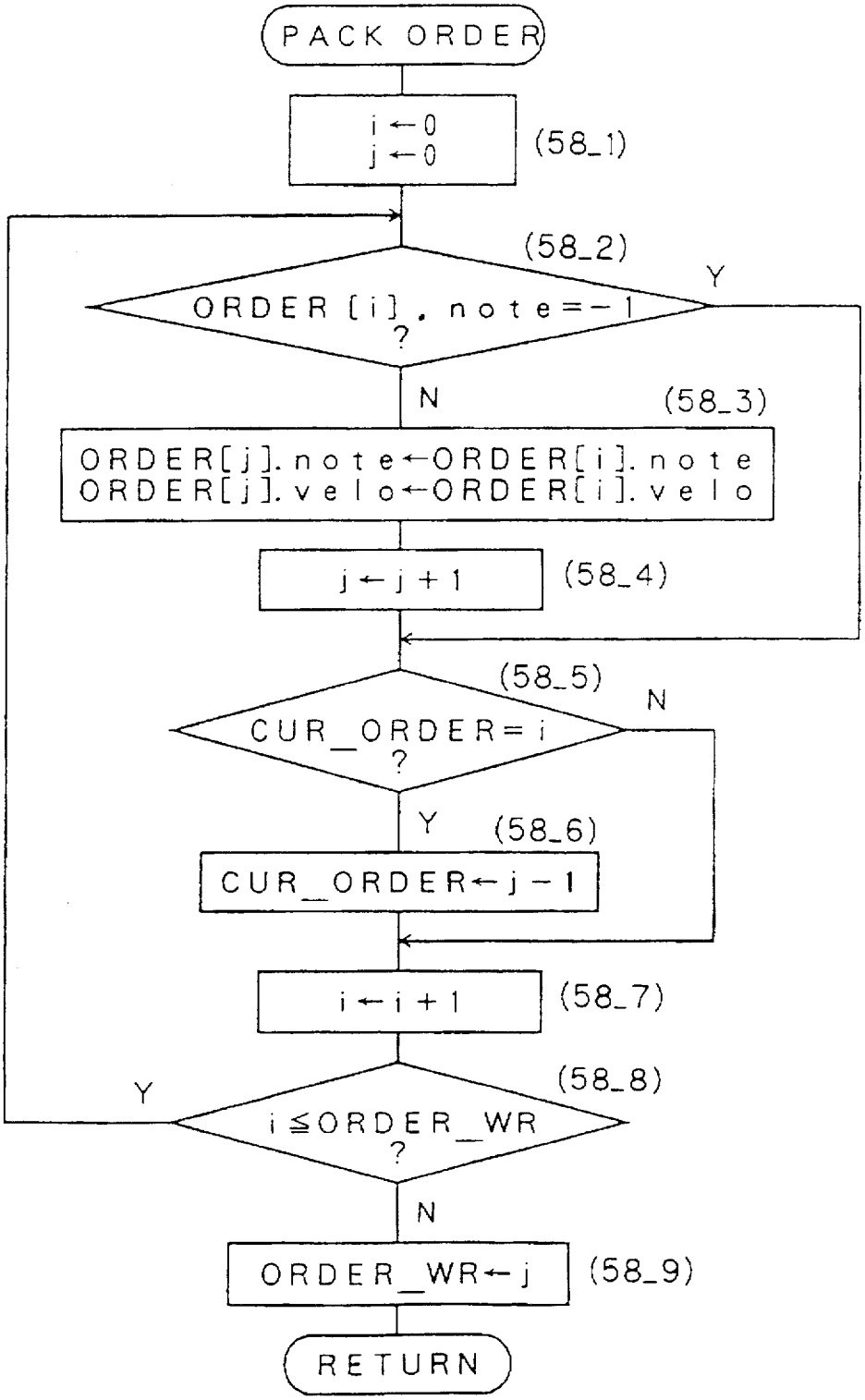
FIG. 58 is a flowchart of a pack order routine.

FIG. 58 is a flowchart of the pack order routine. The pack order routine is executed at step 56_6 of the note-off process routine shown in FIG. 56.

In this routine, the key-pushing order buffer ORDER [ ] is searched and packed forward so as to eliminate the region storing "−1 ". Specifically, at step 58_1, an initial value "0" is stored both in i and j, and then at step 58_2, it is checked whether "−1 " is stored in ORDER [i]. note. If the effective data (that is, other than "−1 ") is stored in ORDER [i]. note, the routine proceeds to step 58_3 where ORDER [i]. note and ORDER [i]. velo are set as ORDER [j]. note and ORDER [j] velo. Then, at step 58_4, j is incremented. Following the forward packing of ORDER [ ], it is also necessary to change the current step CUR_ORDER (see FIG. 29) during the key-pushing order arpeggio playing. Accordingly, step 58_5 checks whether CUR_ORDER=i. If CUR ORDER=i, "j−1 " is stored in CUR_ORDER (step 58_6).

At step 58_7, i is incremented, and at step 58_8, it is determined whether i is equal to or less than ORDER_WR (see FIG. 28). If i≦ORDER_WR, the routine returns to step 58_2 where it is checked whether ORDER [i]. note =−1 relative to the updated i.

Following the forward packing of ORDER [ ], it is also necessary to change the pointer ORDER_WR (see FIG. 28) of ORDER [ ]. Accordingly, at step 58_9, j is stored in ORDER_WR.

Figure 59:
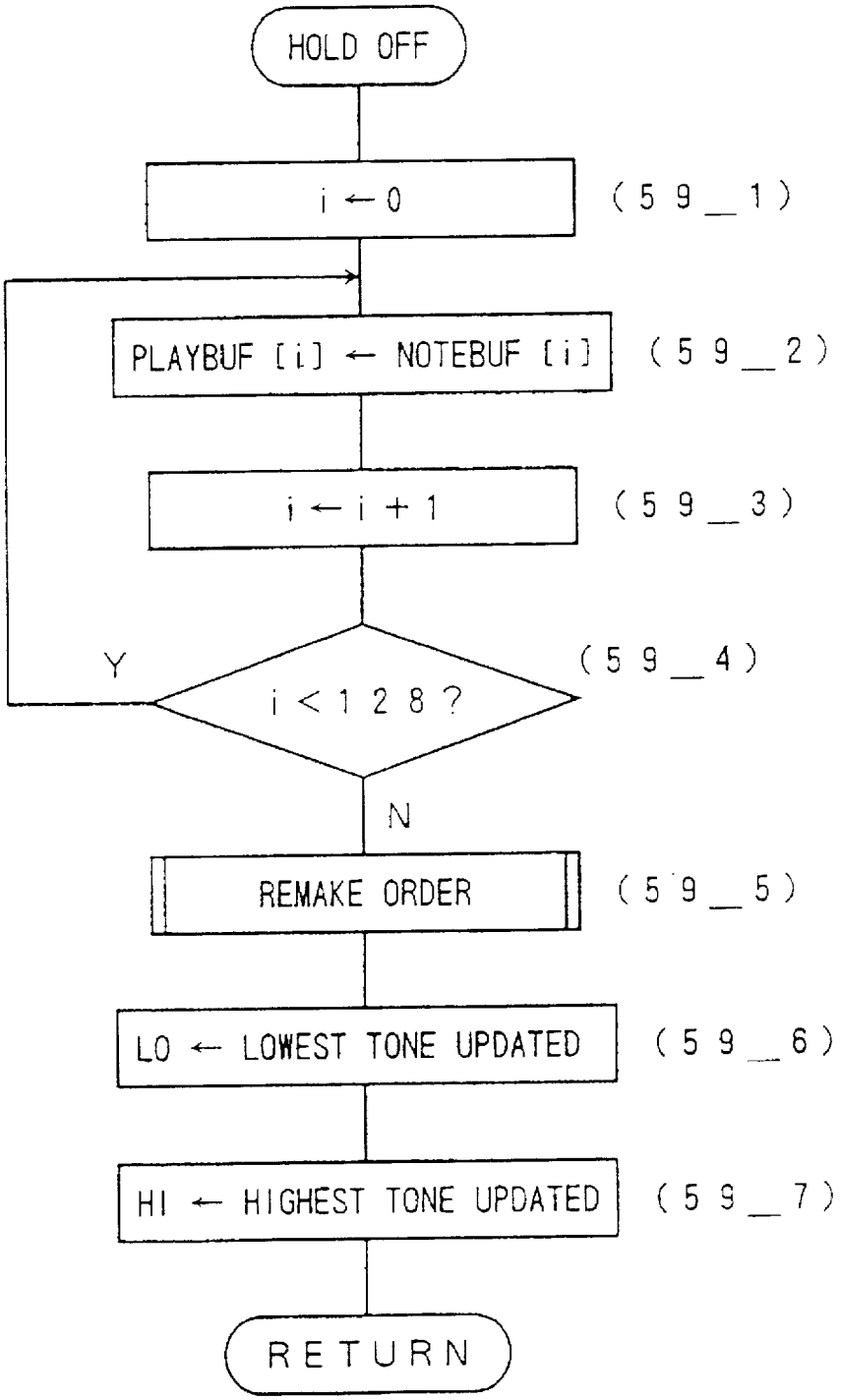
FIG. 59 is a flowchart of a hold-off process routine.

FIG. 59 is a flowchart of the hold-off process routine. The hold-off process routine is executed at step 38_13 of the general program shown in FIG. 38 when the hold-off data is received. When the holdoff process routine is executed, it is known based on the determination at step 38_12 in FIG. 38 that HOLD is less than 64 (hold-off.

When the hold-off process routine shown in FIG. 59 is executed, NOTEBUF [ ] (see FIG. 23) reflecting the key-pushing and the key-releasing as they are, are all copied into PLAYBUF [ ] (see FIG. 24) storing the key-pushing data including the hold data (steps 59_1~59_4). Subsequently, a remake order routine is executed for remaking the key-pushing order buffer ORDER [ ] (see FIG. 27) (step 59_5). After remaking ORDER [ ], PLAYBUF [ ] is searched to update the lowest-pitched tone LO and the highest-pitched tone HI (steps 59_6, 59_7).

Figure 60:
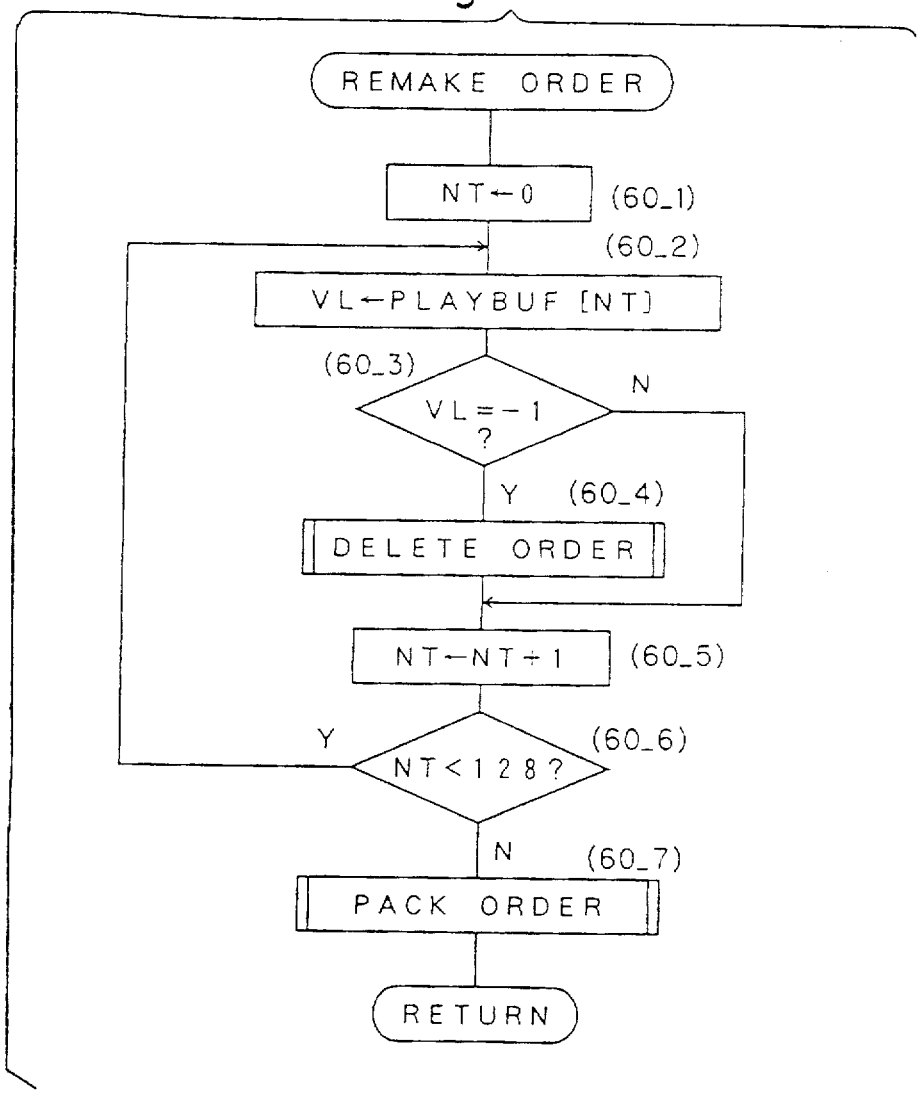
FIG. 60 is a flowchart of a remake order routine.

FIG. 60 is a flowchart of the remake order routine. The remake order routine is executed at step 59_5 of the hold-off process routine shown in FIG. 59.

In this routine, an initial value "0" is stored in NT for searching PLAYBUF [ ] from the lower pitch to the higher pitch (step 60_1).

Subsequently, PLAYBUF [NT] is read out and stored in VL (step 60_2). Then, at step 60_3, it is determined whether VL=−1 , that is, whether the effective velocity data is stored (other than −1 ) or not (−1 ) in PLAYBUF [NT]. If VL=−1 , the routine proceeds to step 60_4 where the delete order routine (see FIG. 57) is executed. In the delete order routine, if the note-on data of the note number NT is stored in ORDER [ ], it is erased (specifically, "−1 " is stored). At step 60_5, NT is incremented, and at step 60_6, it is determined whether NT<128. If NT<128, the routine returns to step 60_2 where PLAYBUF [NT] is read out relative to the new NT.

In this fashion, all the regions of PLAYBUF [ ] are searched so as to erase all the note numbers NT corresponding to PLAYBUF [NT] storing VL=−1 . Thereafter, at step 60_7, the pack order routine (see FIG. 58) is executed so as to pack forward ORDER [ ] for eliminating the region of ORDER [ ] storing "−1 " . Thus, ORDER [ ] is in the state where the key-pushing data are arranged in key-pushing order only for the currently-pushed keys.

The arpeggiator according to this preferred embodiment is structured as described above. Using the rhythm pattern tables (see FIGS. 3~9) and the scan mode tables (see FIGS. 10~19) set by the rhythm pattern setting operator 151 and the scan mode setting operator 152, various musically significant arpeggio playing can be achieved with the simple operation of pushing a plurality of keys simultaneously, pushing keys in order and holding the key-pushing, or depressing the hold pedal to store the key-pushing. Further, by operating the groove rate operator 151 shown in FIG. 2, the degree of "grooviness" can be easily changed.

Now, another preferred embodiment of an arpeggiator according to the present invention will be described. Hereinafter, showing on the drawings and explanation of those portions common to the foregoing preferred embodiment will be omitted, and only what differs from the foregoing preferred embodiment will be shown on the drawings and explained.

Figure 61:
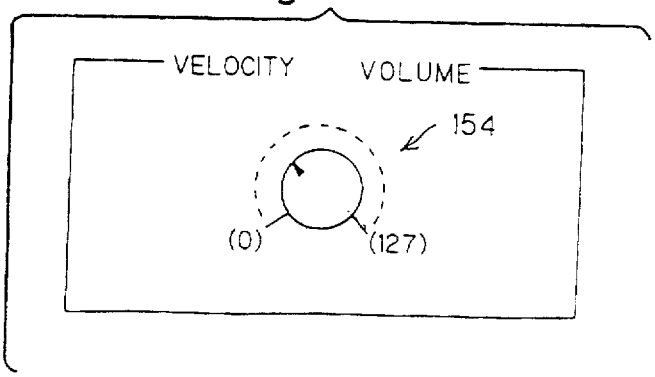
FIG. 61 is a diagram showing a velocity volume added to the panel of FIG. 2.
Figure 62:
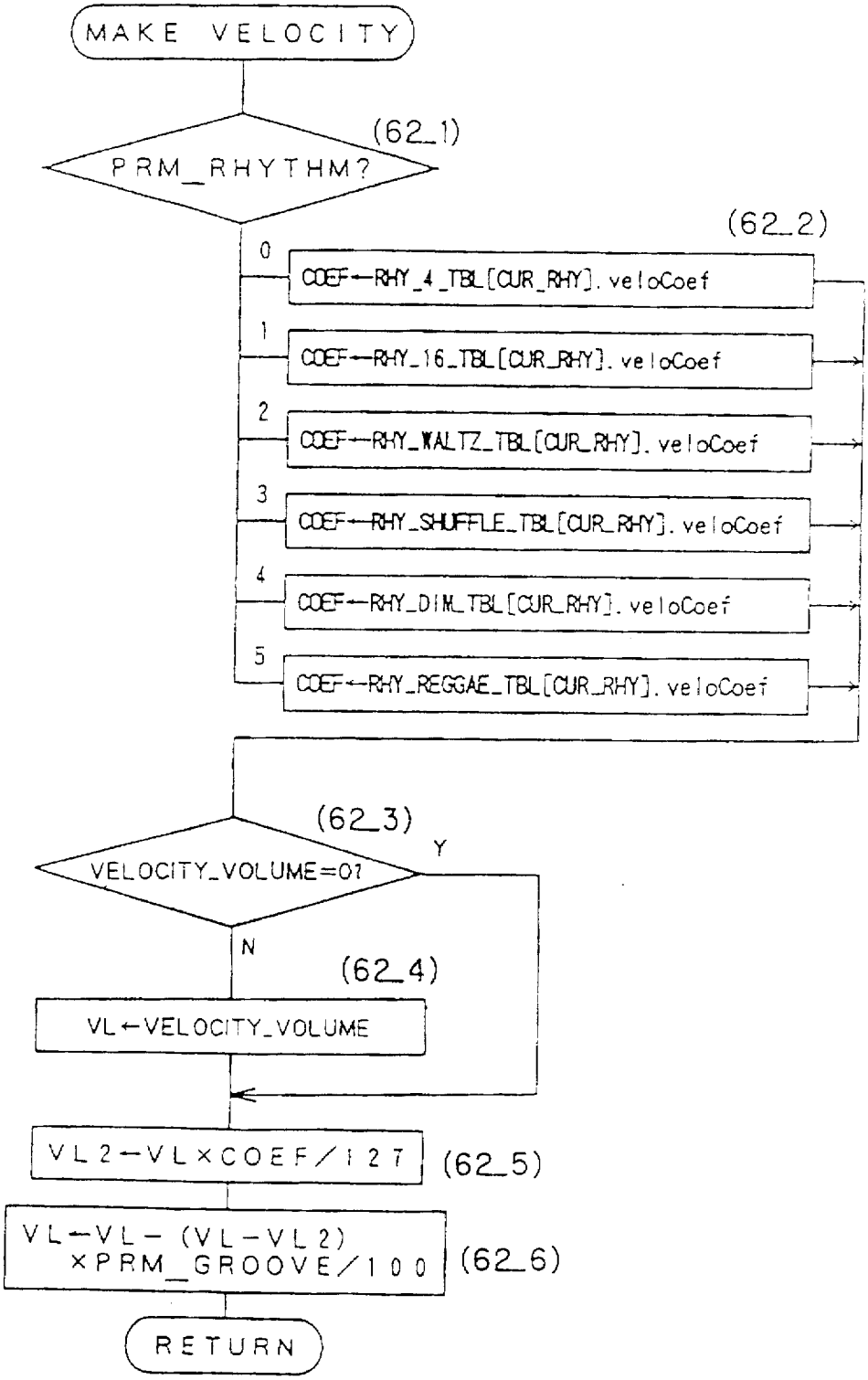
FIG. 62 is a flowchart of a velocity generation routine to be used instead of the velocity generation routine shown in FIG. 49.

FIG. 61 is a diagram showing a velocity volume added to the panel 15 shown in FIG. 2. FIG. 62 is a flowchart of a velocity generation routine to be used, instead of the velocity generation routine shown in FIG. 49, in the structure where the velocity volume shown in FIG. 61 is added to the panel shown in FIG. 2.

In this embodiment, a velocity volume 154 shown in FIG. 61 is added to the panel 15 (see FIG. 2). The velocity volume 154 can be turned by holding by hand. The velocity volume 154 outputs "0" when fully turned in the anticlockwise direction and "127" when fully turned in the clockwise direction, while outputs a value corresponding to a position therebetween. The outputted value is stored in VELOCITY_VOLUME in the RAM 13 (see FIG. 1). As explained in the flowchart of FIG. 62, VELOCITY_VOLUME is concerned in generation of velocity data in the arpeggio playing.

In the velocity generation routine shown in FIG. 62, as in the velocity generation routine of FIG. 49, a rhythm pattern number PRM_RHYTHM is checked (step 62_1 ), and a velocity coefficient RHY_XXX_TBL [CUR_RHY]. velo-Coef of a current step CUR_RHY (see FIG. 38) of a rhythm pattern table RHY_XXX_TBL (see FIGS. 3~9) corresponding to the rhythm patter number PRM_RHYTHM, is read out and stored in COEF (step 62_2).

Subsequently, as different from the velocity generation routine shown in FIG. 49, it is determined whether VELOCITY_VOLUME=0 (step 62_3).

If VELOCITY_VOLUME=0, like in the velocity generation routine of FIG. 49, the routine proceeds to step 62_5 where the following calculation is performed:

$$VL2=VL\times COEF/127$$

wherein COEF represents the velocity coefficient and VL represents the velocity produced by the key-pushing.

Further, at step 62_6, the folllowing calculation is performed:

$$VL-(VL-VL2)\times PRM_GROOVE/100$$

and a derived velocity is again stored in VL.

On the other hand, if it is determined at step 62_3 that VELOCITY_VOLUME≠0, the routine proceeds to step 62_4 where VELOCITY_VOLUME is stored in VL. Specifically, in this case, the velocity produced by the key-pushing is ignored, and VELOCITY_VOLUME set by the velocity volume 154 shown in FIG. 61 is adopted instead of the velocity produced by the key-pushing.

In this fashion, by using the fixed velocity instead of the key-pushing velocity, the arpeggio playing having a constant strength regardless of the key-pushing strength can be realized. Specifically, the reproducible arpeggio playing which is stable and not affected by the playing condition can be achieved.

Figure 63:
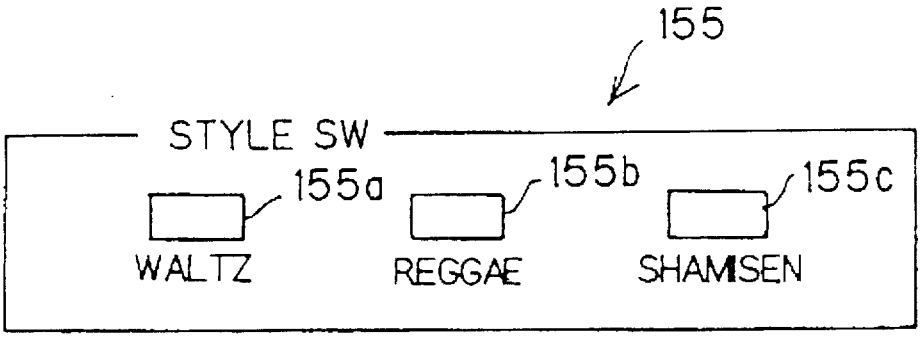
FIG. 63 is a diagram showing a style switch added to the panel of FIG. 2.
Figure 64:
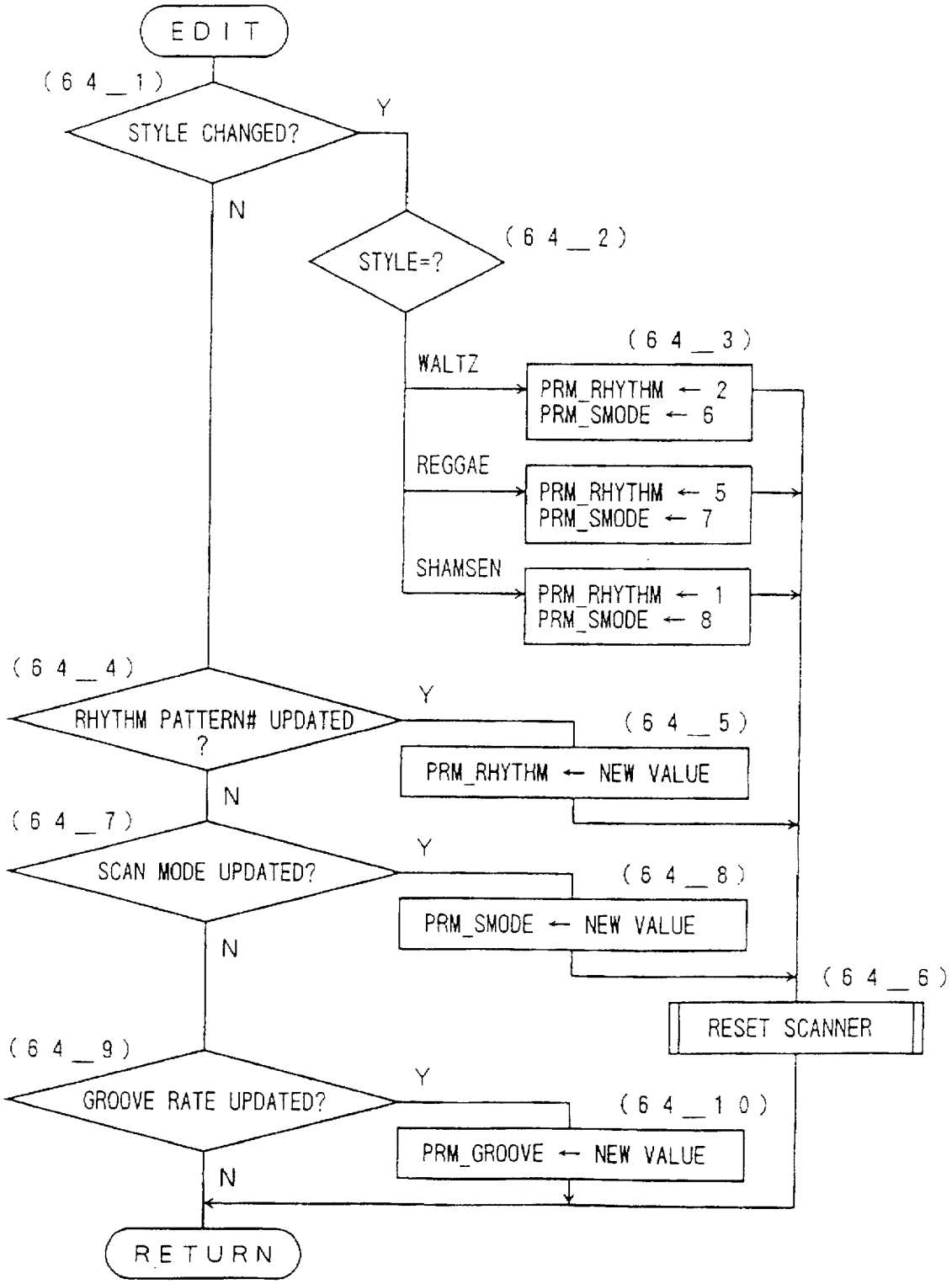
FIG. 64 is a flowchart of an edit routine to be used instead of the edit routine shown in FIG. 54.

FIG. 63 is a diagram showing a style switch added to the panel 15 shown in FIG. 2. FIG. 64 is a flowchart of an edit routine to be used, instead of the edit routine shown in FIG. 54, in the structure where the style switch shown in FIG. 63 is added to the panel shown in FIG. 2.

A style switch 155 shown in FIG. 63 includes a plurality (three in this embodiment) of buttons **155*a*, 155*b* and 155*c*** for the respective genres. When pushing one of the buttons, a set of a rhythm pattern number and a scan mode number matching an image of corresponding one of waltz (WALTS), reggae (REGGAE) and shamisen (SHAMISEN) is arranged to be selected.

In the edit routine shown in FIG. 64, at step 64_1, it is determined based on pushing of one of the buttons **155*a*, 155*b* and 155*c* of the style switch 155 (see FIG. 63**) whether the style is changed.

If the style is changed, depending on a style after the change (step 64_2), "2" (see FIG. 6) and "6" (see FIG. 17) are stored in PRM_RHYTEM (see FIG. 20) and PRM_SMODE (see FIG. 21 ), respectively, in case of waltz, "5" (see FIG. 9) and "7" (see FIG. 18) are stored in PRM_RHYTHM and PRM_SMODE, respectively, in case of reggae, and "1" (see FIG. 5) and "8" (see FIG. 19) are stored in PRM_RHYTHM and PRM_SMODE, respectively, in case of shamisen. The other steps 64_4~64_10 of the edit routine shown in FIG. 64 are the same as steps 54_1~54_7 of the edit routine shown in FIG. 54 so that explanation thereof is omitted.

As described above, in this embodiment, when, for example, the button **155*a*** for waltz is pushed, the rhythm pattern and the scan mode which are generally considered to be the most suitable for waltz are simultaneously selected and set. Accordingly, the player does not need to consider a combination of the rhythm pattern and the scan mode, but can select a desired style in a one-touch fashion.

Although a tone color used in the arpeggio playing is not referred to in the foregoing embodiment, it may be arranged that a tone color suitable for the selected style is automatically selected. For example, when the style of waltz or reggae is selected, a tone color of a musical instrument normally used on playing a tune of waltz or reggae may be selected, while, when the style of shamisen is selected, a tone color of shamisen may be selected.

In each of the foregoing embodiments, the hold data is inputted via the data input terminal 17 (see FIG. 1). On the other hand, a switch may be provided on the panel 15 for switching inputs between the hold-on data and the hold-off data, or a hold data generation pedal and a jack for connection of the pedal may be provided to the arpeggiator itself.

In each of the foregoing embodiments, the keyboard and the sound source are connected at the external. On the other hand, one or both of the keyboard and the sound source may be incorporated in or formed integral with the arpeggiator. In addition, it may be further arranged to be communicable with the exterior.

In each of the foregoing embodiments, only the one groove rate setting operator 153 is provided, and both of the duration and the velocity of each step of the arpeggio playing are changed by means of the groove rate PRM_GROOVE set by the one groove rate setting operator 153. On the other hand, it is not necessary to arrange that both can be changed. Even if only one of them can be changed, the musically significant change can be achieved. Alternatively, for allowing the player to achieve a delicate adjustment, it may be arranged that the one groove rate setting operator 153 can be operated in a switched fashion for the duration change and the velocity change, or two operators for the duration change and the velocity change are provided.

In each of the foregoing embodiments, each step of the rhythm pattern table records therein the step time, the duration and the velocity coefficient in set. On the other hand, the rhythm pattern table may be arranged to record only the step time, the duration or the velocity, and fixed values may be used for the other two. Even if the rhythm pattern table records only the step time, not only the equally time-divided simple arpeggio playing, but also the arpeggio playing with various rhythms are made possible. Even if the rhythm pattern table records only the duration, since the effect of staccato or tenuto can be independently added per step of the arpeggio playing, various nuances and articulations of the rhythm can be provided. Even if the rhythm pattern table records only the velocity coefficient, the arpeggio playing with various accents can be achieved by giving stresses per step of the arpeggio playing. Thus, in any case, the musically significant arpeggio playing can be realized. Naturally, the rhythm pattern table may record two of the three.

Further, the rhythm pattern tables for the step time, the duration and the velocity coefficient may be provided separately so that the player can use them in combination according to a player's taste.

The rhythm pattern table may record data other than the step time, the duration and the velocity coefficient. For example, if tone color designating data is stored for each step, the tone color can be switched per step so that further high-graded arpeggio playing can be achieved. In this case, the tone color is considered to be one of properties of the tone in the present invention.

Further, in each of the foregoing embodiments, the rhythm pattern tables and the scan mode tables are fixedly stored in the ROM 14 (see FIG. 1). On the other hand, they may be stored in the RAM 13 instead of or along with the ROM 14. In this case, it may be arranged that a new rhythm pattern table and a scan mode table can be loaded from the exterior. It may further be arranged that a rhythm pattern table setting operator and a scan mode table setting operator are provided on the panel 15 so as to allow the player to define a new rhythm pattern table and a new scan mode table. With this arrangement, the arpeggio playing which is more suitable for one's taste can be achieved.

Hereinbelow, a further preferred embodiment with such an arrangement will be described in detail.

In this embodiment, the rhythm pattern tables and the scan mode tables are stored in the ROM 14 as in the foregoing preferred embodiments. In addition, in this embodiment, rhythm pattern tables and scan mode tables whose storage contents can be freely defined (changed) depending on the player's operation, are stored in the RAM 13.

The number of the rhythm pattern tables definable by the player is three which are expressed as RHY_USER1_TBL, RHY_USER2_TBL and RHY_USER3_TBL. The tables are assigned rhythm pattern numbers of 6, 7 and 8, respectively. FIG. 65 shows RHY_USER1_TBL. A step time, a duration and a velocity coefficient of each step and the number of steps can be desirably defined by the player.

The number of the scan mode tables definable by the player is also three which are expressed as SMODE_USER1_TBL, SMODE_USER2_TBL and SMODE_USER3_TBL. The tables are assigned scan mode numbers of 9, 10 and 11, respectively. FIG. 66 shows SMODE_USER1_TBL. A scan function number of each step and the number of steps can be desirably defined by the player.

Figure 67:
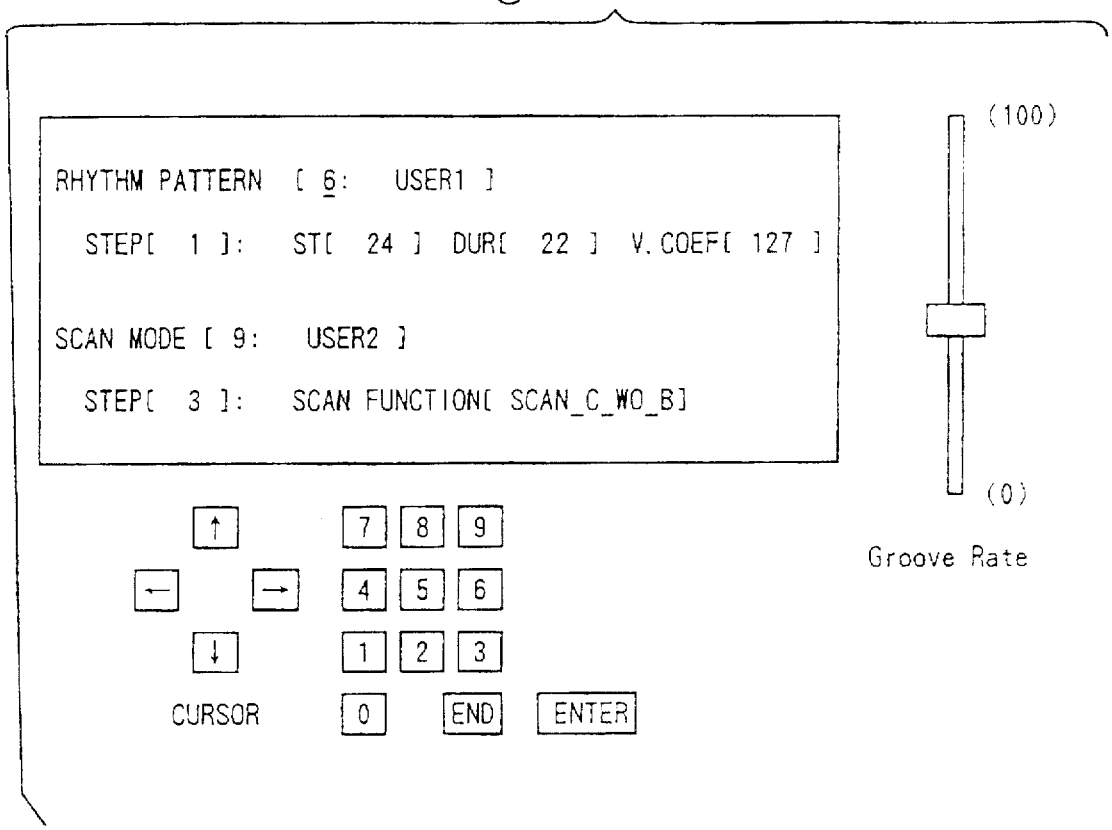
FIG. 67 is a diagram showing an operation switch for selecting one of rhythm pattern tables and one of scan mode tables stored in a ROM and a RAM, an indicator and an operator for setting a groove rate, which are provided on a panel.

FIG. 67 is a diagram showing an operation switch for selecting one of the rhythm pattern tables and one of the scan mode tables stored in the ROM 14 and the RAM 13, an indicator and an operator for setting a groove rate, which are provided on the panel 15.

When the rhythm pattern table and the scan mode table stored in the RAM 13 are selected, it is possible to define/change the contents of the tables by operating the operation switch.

FIG. 67 shows a display example, wherein RHY_USER1_TBL with the rhythm pattern number 6 which is definable by the player is selected as a rhythm pattern table, and SMODE_USER1_TBL with the scan mode number 9 which is definable by the player is selected as a scan mode table. On the indicator, a title of the rhythm pattern of the rhythm pattern number 6, and a step time, a duration and a velocity coefficient of a step number 1 of the rhythm pattern are displayed, and a title of the scan mode of the scan mode number 9 and a scan function of a step number 3 of the scan mode are displayed. The rhythm pattern number, the step number of the rhythm pattern, the step time, the duration, the velocity coefficient, the scan mode number, the step number of the scan mode and the scan function are all changeable. What is selected as an object to be changed is indicated by a position of a cursor. In the example shown in FIG. 67, the cursor is now at a position of the rhythm pattern number, and thus, it is indicated that the rhythm pattern number is selected as an object to be changed. The cursor can be moved by operating cursor buttons. The player moves the cursor to a desired position, and then operates numeric buttons to set a desired value.

An end button is used for setting a size of the table. If the end button is operated when the cursor is at a position of the rhythm pattern number, the step number of the rhythm pattern, the step time, the duration or the velocity coefficient, a value obtained by subtracting "1" from the step number of the rhythm pattern indicated at that time is set a size of the rhythm pattern table. If the end button is operated when the cursor is at a position of the scan mode number, the step number of the scan mode or the scan function number, a value obtained by subtracting "1" from the step number of the scan mode indicated at that time is set a size of the scan mode table.

When, as described above, the table is selected or the contents of the selected table are changed by the cursor buttons, the numeric buttons and the end button, an enter button is used for confirming the selected table or the changed contents. Until the enter button is pushed, the selected table or the changed contents are temporarily stored in a working area of the RAM 13 and displayed on the indicator so that the selected table or the changed contents are not reflected on the playing. Upon pushing the enter button, they are reflected on the playing.

Figure 68:
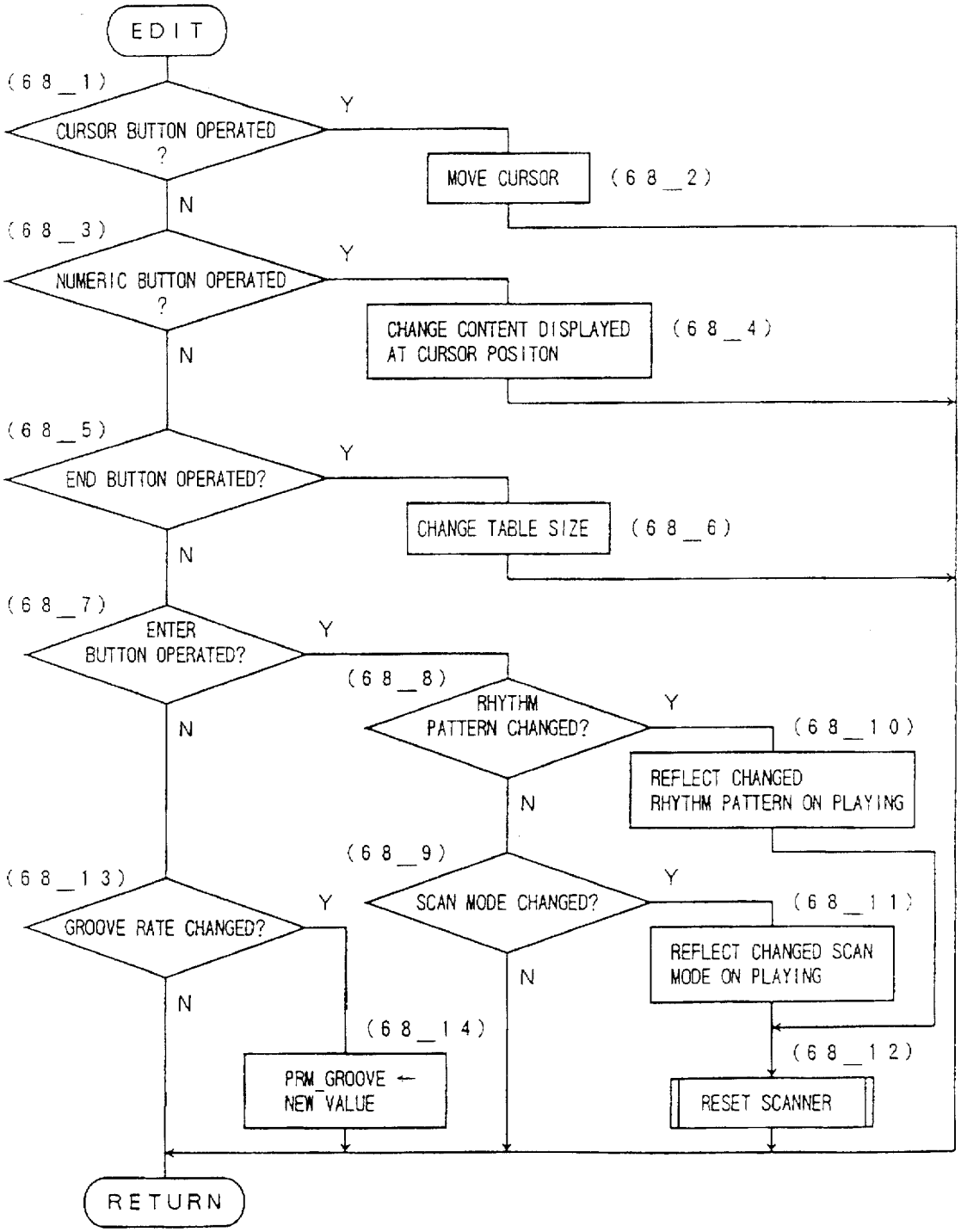
FIG. 68 is a diagram showing an edit routine.
Figure 69:
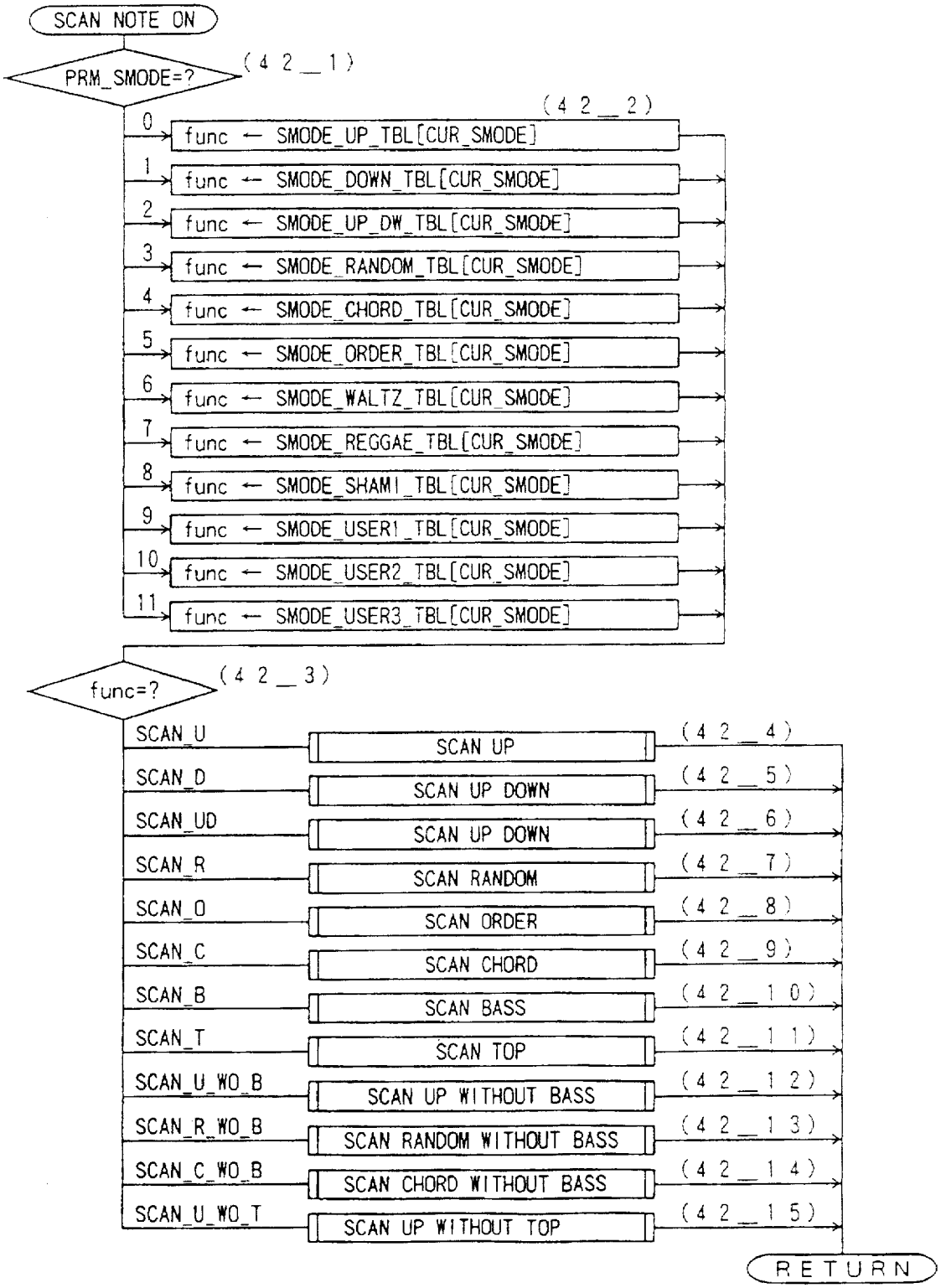
FIG. 69 is a diagram showing a flowchart of a scan note-on routine.
Figure 70:
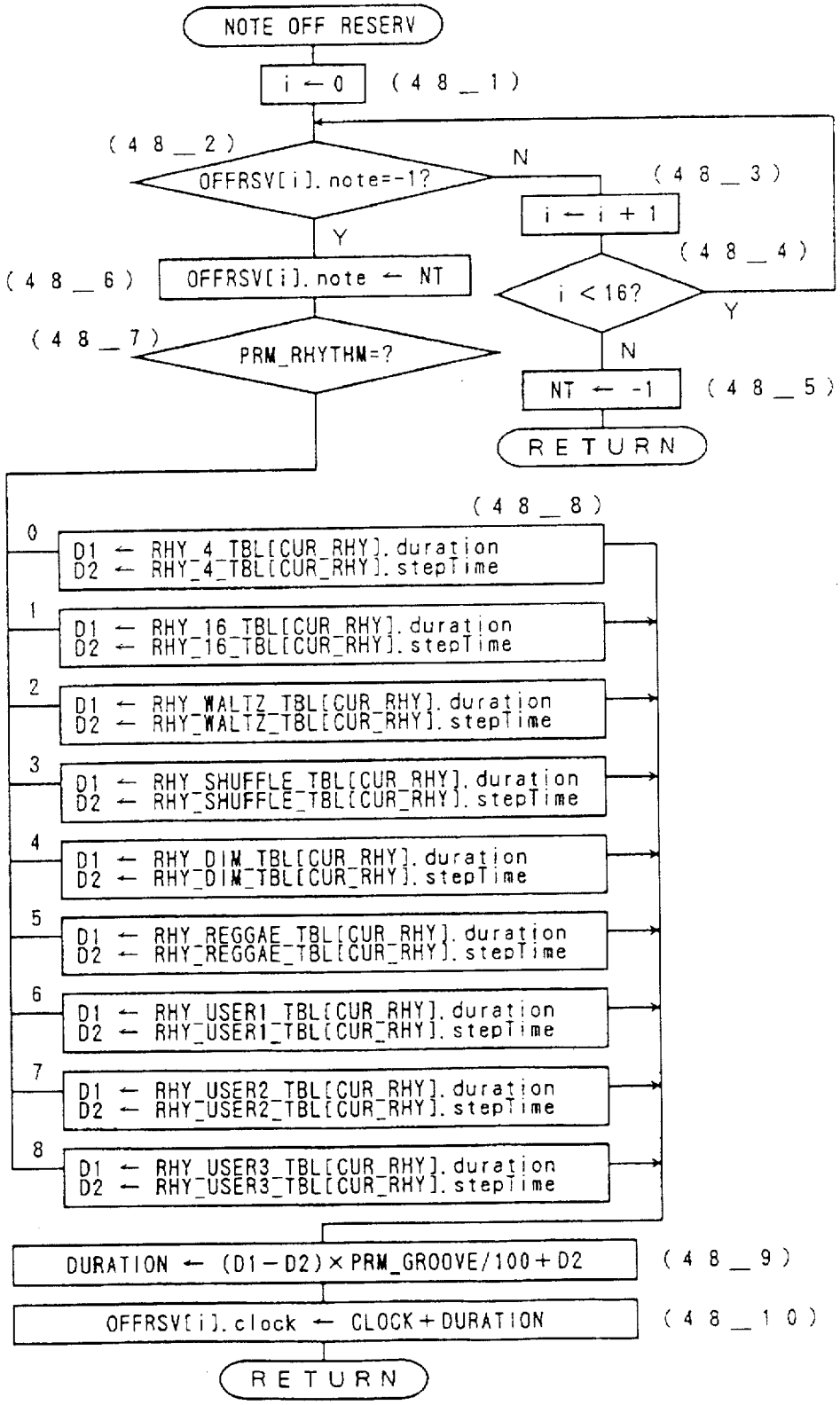
FIG. 70 is a flowchart of a note-off reservation routine.
Figure 71:
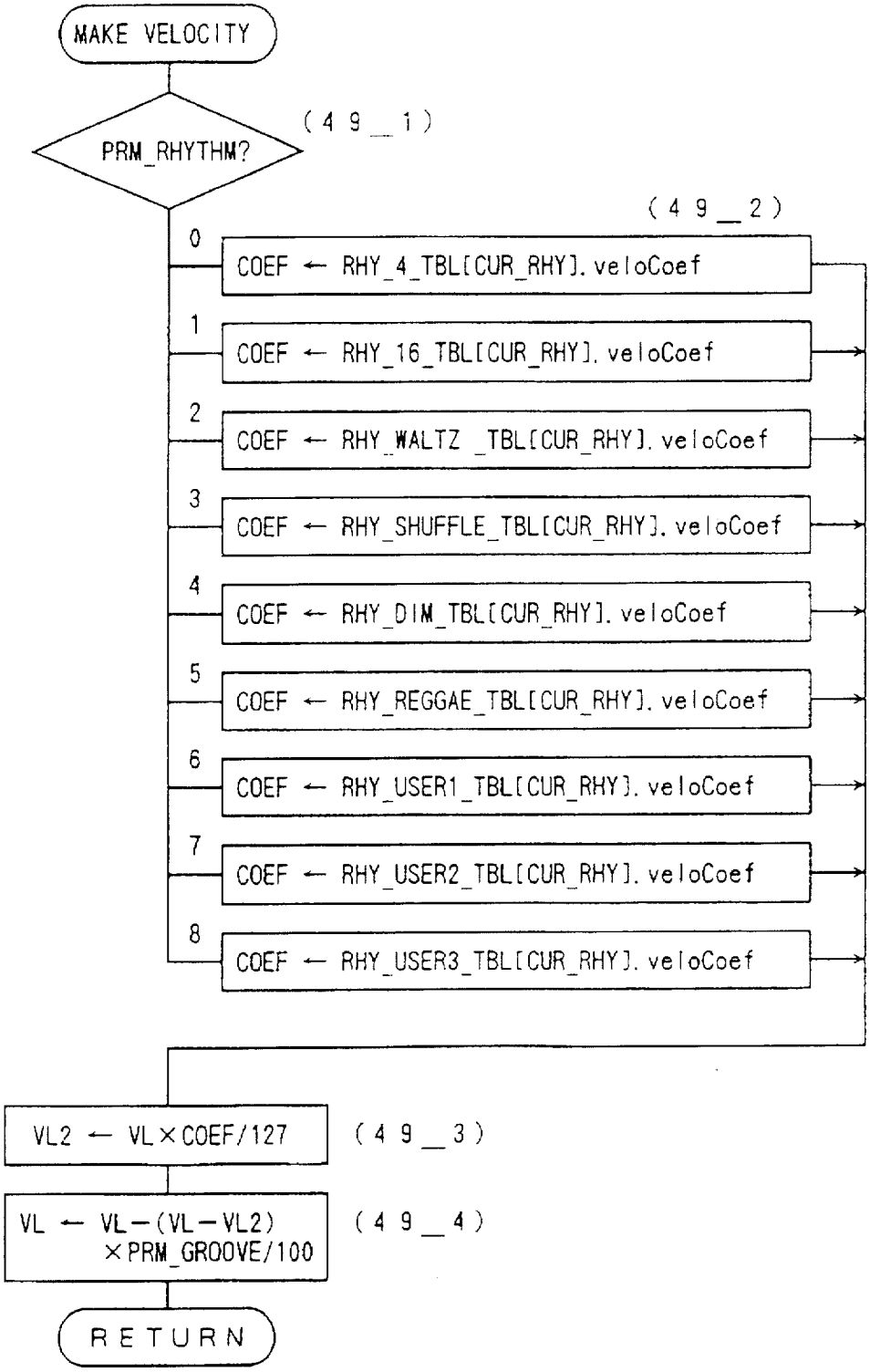
FIG. 71 is a flowchart of a velocity generation routine.
Figure 72:
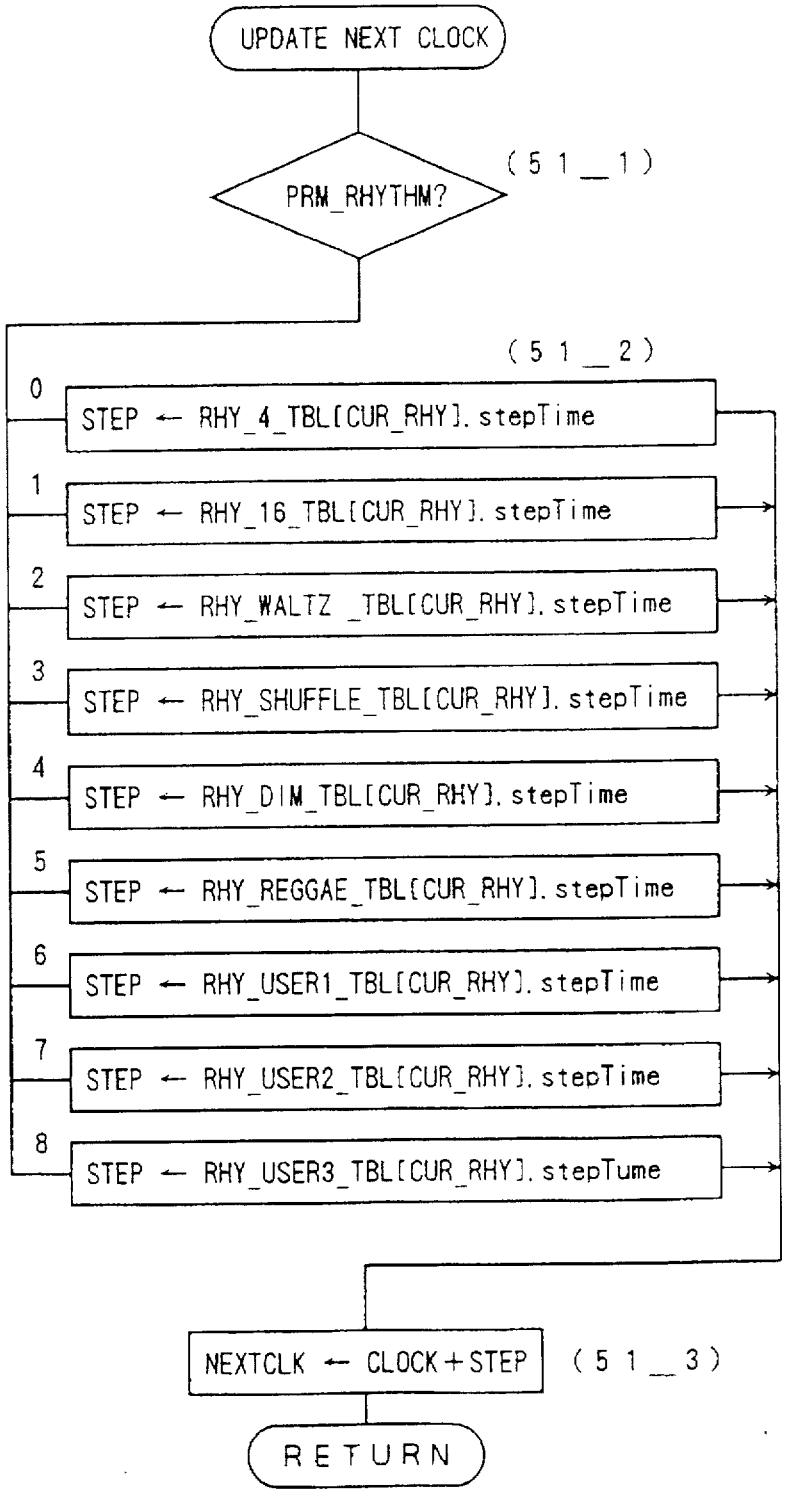
FIG. 72 is a flowchart of a next clock generation routine.
Figure 73:
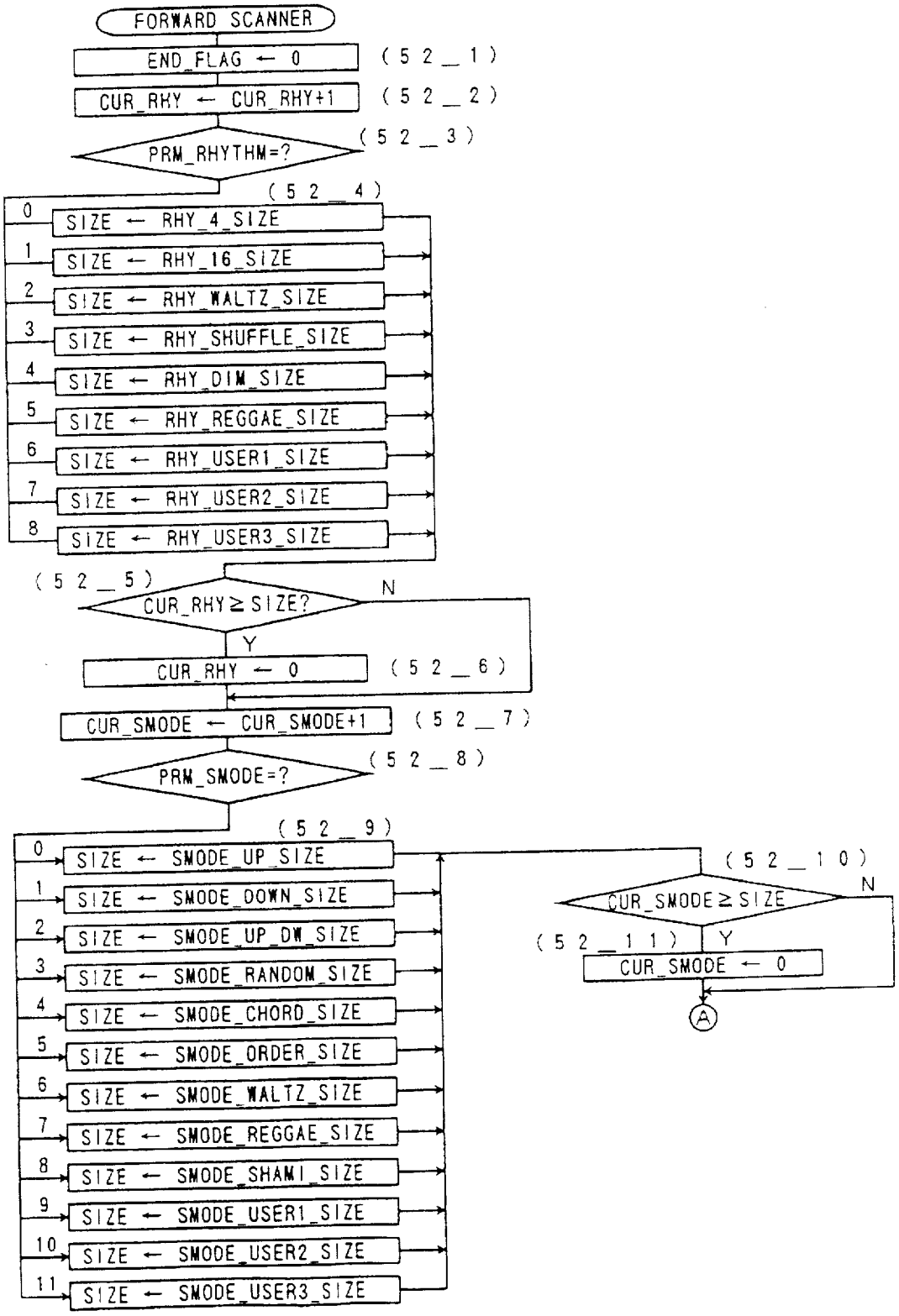
FIG. 73 is a flowchart of a scanner update routine.
Figure 74:
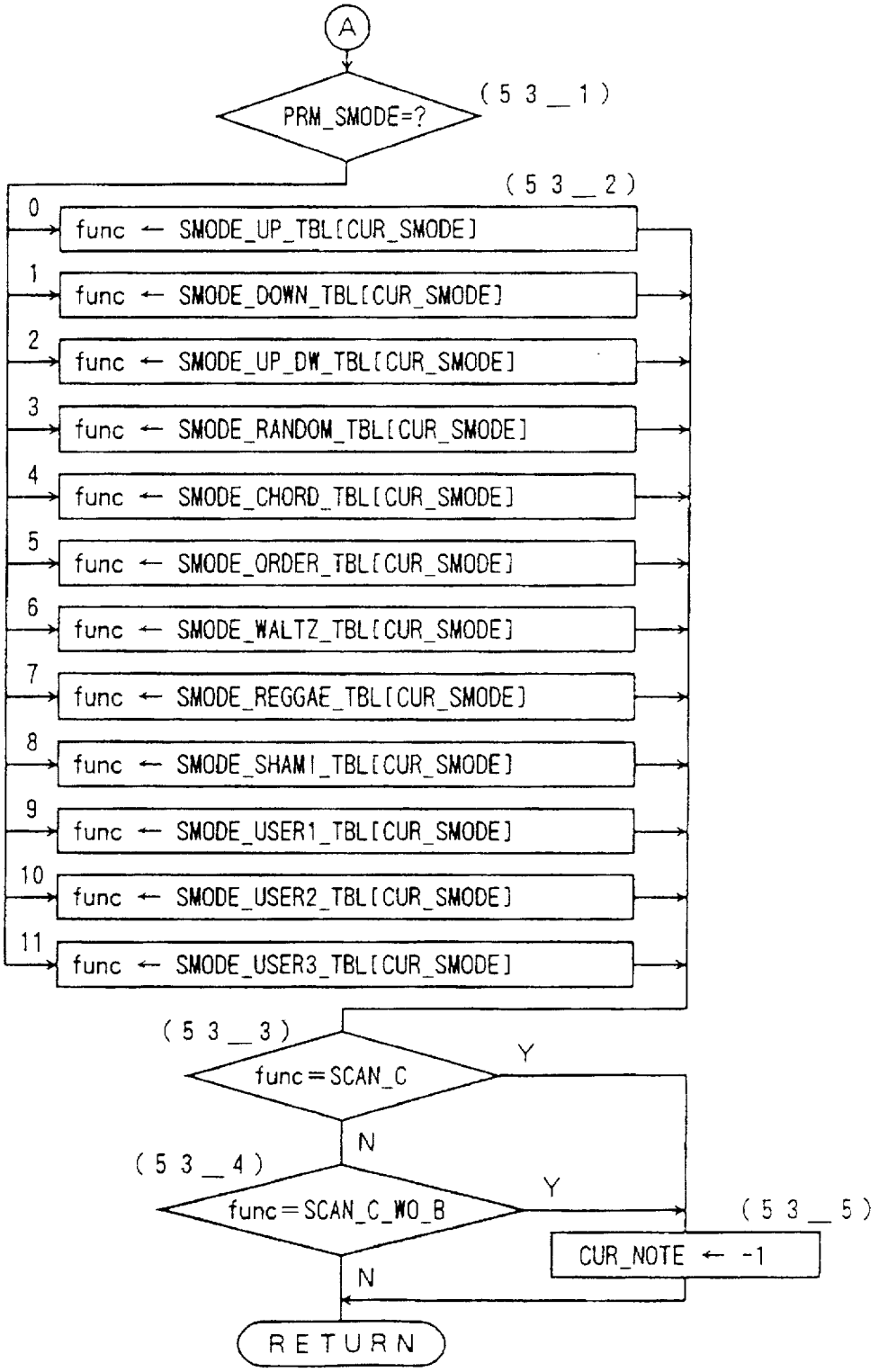
FIG. 74 is a flowchart of a scanner update routine.
Figure 75:
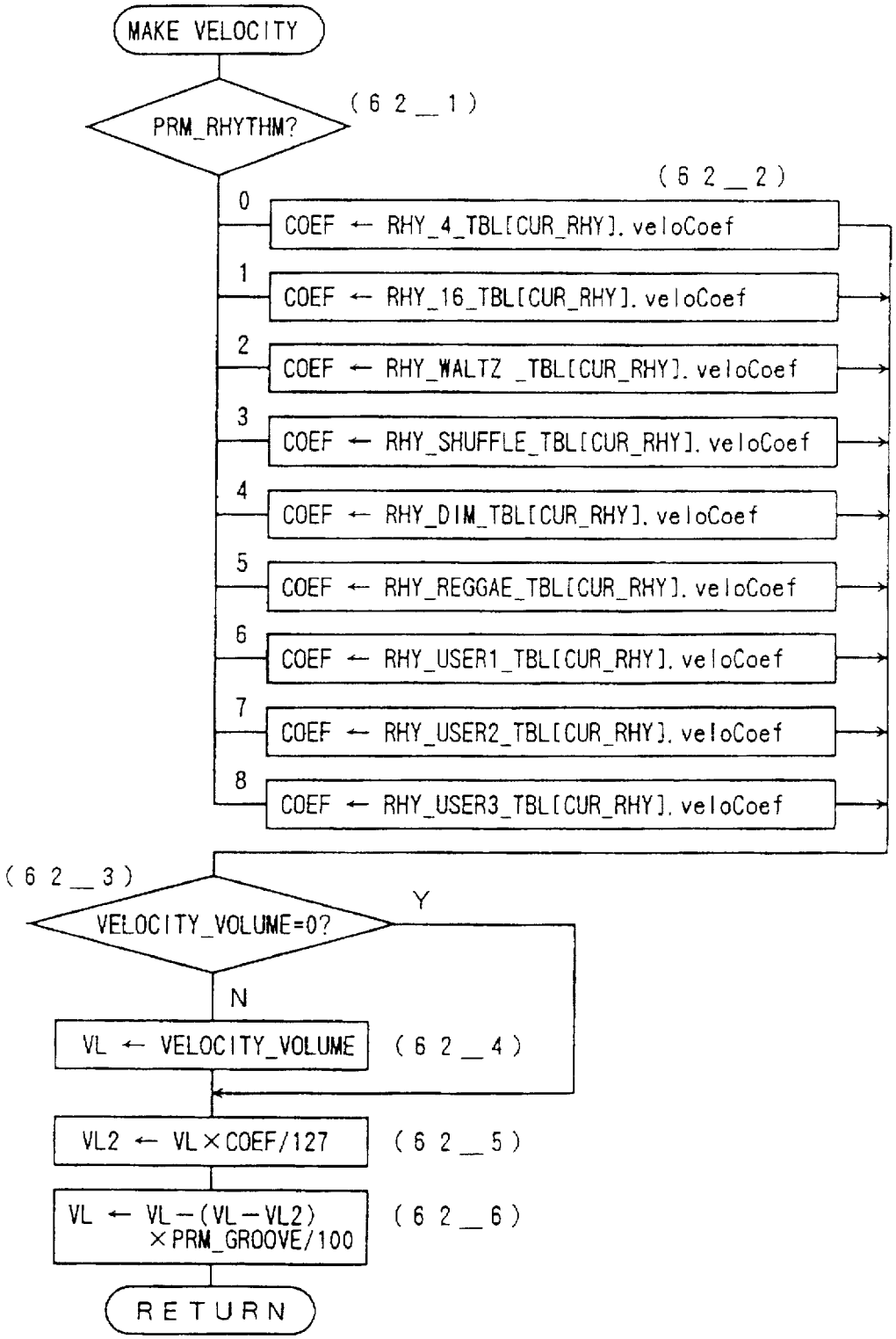
FIG. 75 is a flowchart of a velocity generation routine.

FIG. 68 is a diagram showing an edit routine of this embodiment. This routine corresponds to the routine shown in FIG. 54.

At step 68_1, it is checked whether the cursor button is operated. If positive, the routine proceeds to step 68_2 where the cursor is moved. At step 68_3, it is checked whether the numeric button is operated. If positive, the routine proceeds to step 68_4 where the contents displayed at a position of the cursor are changed. At step 68_5, it is checked whether the end button is operated. If positive, the routine proceeds to step 68_6 where a size of the currently-selected rhythm pattern table or scan mode table whichever is designated by the cursor is changed. If the currently-selected table is stored in the ROM 14, the contents or the size of the table can not be achieved.

At step 68_7, it is checked whether the enter button is operated. If positive, the routine proceeds to step 68_8 where it is checked whether the rhythm pattern is changed. If the rhythm pattern is not changed, the routine proceeds to step 68_9 where it is checked whether the scan mode is changed. In the processes at steps 68_8 and 68_9 for determining whether the rhythm pattern and the scan mode are changed, whether the rhythm pattern or the scan mode is newly selected and whether the contents of the selected rhythm pattern table or scan mode table are changed, are both determined. If it is determined that the rhythm pattern is changed, the routine proceeds to step 68_10. In step 68_10, when the rhythm pattern is newly selected, a rhythm pattern number of the newly selected rhythm pattern is stored in PRM_RHYTHM, while, when the contents of the selected rhythm pattern table are changed, the rhythm pattern table in the RAM 13 is rewritten according to the changed contents. Thus, the rhythm pattern after the change is reflected on the playing. Thereafter, the routine proceeds to step 68_12 where the reset process for the scanner shown in FIG. 40 is performed. On the other hand, if it is determined that the scan mode is changed, the routine proceeds to step 68_11. In step 68_11, when the scan mode is newly selected, a scan mode number of the newly selected scan mode is stored in PRM_SMODE, while, when the contents of the selected scan mode table are changed, the scan mode table in the RAM 13 is rewritten according to the changed contents. Thus, the scan mode after the change is reflected on the playing. Thereafter, the routine proceeds to step 68_12 where the reset process for the scanner shown in FIG. 40 is performed. At step 68_13, it is checked whether the groove rate is changed. If positive, the routine proceeds to step 68_14 where the contents of PRM_GROOVE are rewritten.

In this embodiment, in addition to the rhythm pattern tables and the scan mode tables stored in the ROM 14, the rhythm pattern tables (RHY_USER1_TBL, RHY_USER2_TBL, RHY_USER3_TBL) and the scan mode tables (SMODE_USER1_TBL, SMODE_USER2_TBL, SMODE_USER3_TBL) are stored also in the RAM 13. Following this, the scan note-on routine of FIG. 42, the note-off reservation routine of FIG. 48, the velocity generation routines of FIGS. 49 and 62, the next clock update routine of FIG. 51 and the scanner update routine of FIGS. 52 and 53 are changed as shown in FIGS. 69~75.

In each of the foregoing preferred embodiments, each step of the rhythm pattern table stores a set of the duration and the velocity coefficient, and the duration read out from the rhythm pattern table and the reflection of the velocity coefficient read out from the rhythm pattern table relative to the key-pushing velocity are changed depending on the groove rate set by the player. In this case, the manners of changing of these elements depending on the groove rate are uniform for any of the rhythm patterns and any of the steps.

Instead of this, as shown in FIG. 76, it may be arranged that each step of the rhythm pattern table stores two sets of durations and velocity coefficients, that interpolation is achieved between the durations and between the velocity coefficients in each step depending on the groove rate so as to produce a desired duration between the two durations and a desired velocity coefficient between the two velocity coefficients, and that the arpeggio playing is performed based on the produced duration and velocity coefficient. With this arrangement, the manner of changing the duration depending on the change of the groove rate and the manner of reflection of the velocity coefficient relative to the key-pushing velocity depending on the change of the groove rage can be made different per rhythm pattern or per step of the rhythm pattern.

For example, in the rhythm pattern setting the staccato-like duration and the tenuto-like duration, desired playing between the staccato-like playing and the tenuto-like playing can be achieved depending on the change of the groove rate. In this case, If the staccato-like duration and the tenuto-like duration are set only in particular steps, the duration changes between the staccato-like duration and the tenuto-like duration only in those steps depending on the change of the groove rate. Further, in the rhythm pattern setting the velocity coefficients having a large difference in accent between the steps and the velocity coefficients having a small difference in accent between the steps, desired playing between the playing with a large difference in accent and the playing with a small difference in accent can be achieved depending on the change of the groove rate. In this case, if the change in accent is provided only in particular steps, the accent changes only in those steps depending on the change of the groove rate.

Figure 77:
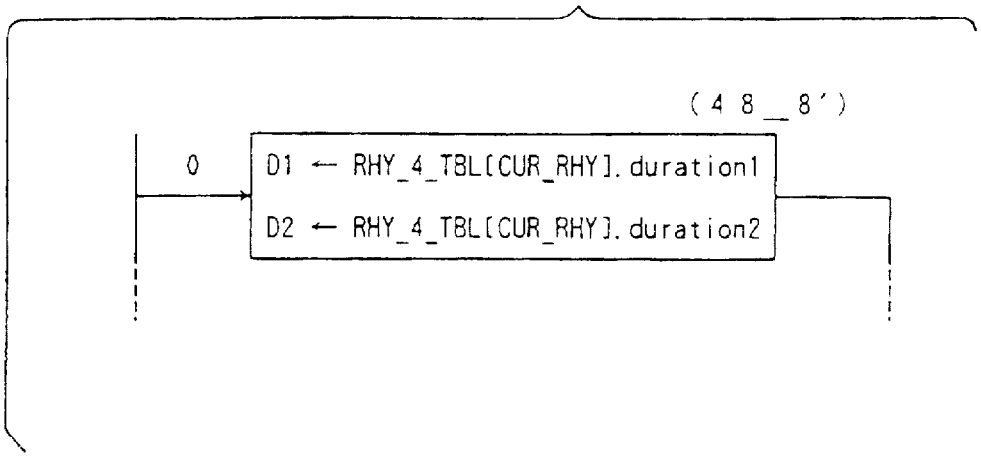
FIG. 77 is a diagram showing a changed point of the note-off reservation routine shown in FIG. 48.
Figure 78:
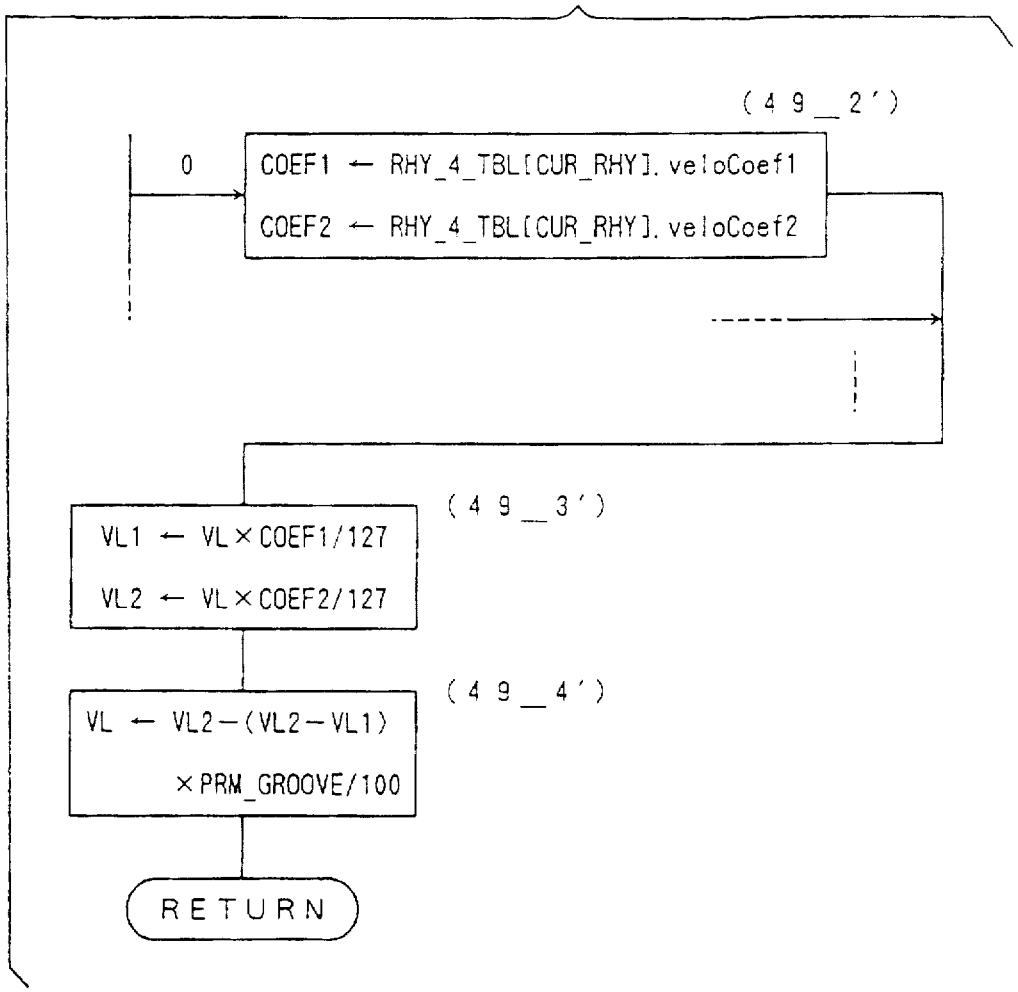
FIG. 78 is a diagram showing a changed point of the velocity generation routine shown in FIG. 49.

In this embodiment, step 48_8 of the note-off reservation routine in FIG. 48 is replaced by step 48_8' shown in FIG. 77, and steps 49_2~49_4 of the velocity generation routine in FIG. 49 are replaced by steps 49_2'~49_4' shown in FIG. 78.

At step. 48_8' shown in FIG. 77, a first duration RHY_XXX_TBL [CUR_RHY]. duration1 and a second duration RHY_XXX_TBL [CUR_RHY]. duration2 of a current step number CUR_RHY of a rhythm pattern table RHY_XXX_TBL [ ] corresponding to a rhythm pattern number PRM_RHYTHM are read out and stored D1 and D2, respectively. Although FIG. 77 shows only the rhythm pattern table RHY_4_TBL [ ], this also applies to the other rhythm pattern tables similarly.

At step 49_2' shown in FIG. 78, a first velocity coefficient RHY_XXX_TBL [CUR_RHY]. veloCoef1 and a second velocity coefficient RHY_XXX_TBL [CUR_RHY]. veloCoef2 of a current step number CUR_RHY of a rhythm pattern table RHY_XXX_TBL [ ] corresponding to a rhythm pattern number PRM_RHYTHM are read out and stored COEF1 and COEF2, respectively. At step 49_3', the following calculation is performed:

$$VL1=VL\times COEF1/127$$

$$VL2=VL\times COEF2/127$$

wherein COEF1 and COEF2 represent the velocity coefficients, respectively, and VL represents the velocity produced by the key pushing.

Further, at step 49_4', the following calculation is performed:

$$VL2-(VL2-VL1)\times PRM_GROOVE/100$$

and a derived velocity is again stored in VL. Although FIG. 78 shows only the rhythm pattern table RHY_4_TBL [ ], this also applies to the other rhythm pattern tables similarly.

In this embodiment, each step of the rhythm pattern table stores two sets of the durations and the velocity coefficients, and the interpolation is applied between the two durations and between the two velocity coefficients in each step depending on the groove rate. On the other hand, two step times may also be stored per step, and interpolation may be achieved between the two step times depending on the groove rate. In this case, for example, in the rhythm pattern setting a step time with shuffle and a step time without shuffle, the degree of shuffle can be changed depending on the groove rate. In this case, however, if the step time changes during the arpeggio playing, the playing tempo also changes. Accordingly, it is preferable to arrange that the change of the step time depending on the groove rate is only allowed in the state where the arpeggio playing is stopped, or that, when the groove rate is changed during the arpeggio playing, the change of the step time depending on the groove rate is performed in synchronism with a timing where a step to be played returns to the head of the rhythm pattern.

It may be arranged that only the durations, the velocity coefficients and the step times are provided by two in each step, and the interpolation is achieved depending on the groove rate.

While the present invention has been described in terms of the preferred embodiments, the invention is not to be limited thereto, but can be embodied in various ways without departing from the principle of the invention as defined in the appended claims. For example, the foregoing preferred embodiments may be carried out singly or in combination thereof.

What is claimed is:

1. An arpeggiator comprising:

key-pushing data storing means, having storage regions corresponding to a plurality of keys, respectively, for erasably writing key-pushing data, representing that the key is pushed, in the storage region corresponding to the pushed key;

rhythm pattern table storing means for storing a rhythm pattern table having at least one step which records therein data defining a property of a tone for every step of a rhythm; and playing data producing means for sequentially referring to said at least one step of said rhythm pattern table, scanrung said storage regions corresponding to said at least one step, and producing playing data representing a tone based on the key-pushing data detected by the scanrung of said storage regions and said data recorded in the step, corresponding to said scanning, of said rhythm pattern table and defining the property of the tone.

2. The arpeggiator according to claim 1, wherein said data deftrUng the property of the tone is data defining a sound generation continuing time of the tone.

3. The arpeggiator according to claim 1, wherein said data defining the property of the tone is data defining a strength of sound generation of the tone.

4. An arpeggiator comprising:

key-pushing data storing means, having storage regions corresponding to a plurality of keys, respectively, for erasably writing key-pushing data, representing that the key is pushed, in the storage region corresponding to the pushed key;

rhythm pattern table storing means for storing a rhythm pattern table having at least one step which records therein a time interval between a certain step and a subsequent step for every step of a rhythm; and playing data producing means for sequentially referring to said at least one step of said rhythm pattern table, scanning said storage regions corresponding to said at least one step, and producing playing data at a timing pursuant to the time interval recorded in the step, corresponding to the scanning of said storage regions, of said rhythm pattern table, said playing data representing a tone based on the key-pushing data detected by said scanning;

wherein said key-pushing data storing means erasably writes the key-pushing data in the storage region corresponding to the pushed key, said key-pushing data representing that the key is pushed and including data for a strength of the key-pushing, and wherein said playing data producing means produces the playing data including data for a strength of sound generation corresponding to said data for the key-pushing strength included in the key-pushing data detected by said scanning.

5. The arpeggiator according to claim 1, wherein said key-pushing data storing means erasably writes the key-pushing data in the storage region corresponding to the pushed key, said key-pushing data representing that the key is pushed and including data for a strength of the key-pushing, and wherein said playing data producing means produces the playing data including data for a strength of sound generation corresponding to said data for the key-pushing strength included in the key-pushing data detected by said scanning.

6. The arpeggiator according to claim 3, wherein said key-pushing data storing means erasably writes the key-pushing data in the storage region corresponding to the pushed key, said key-pushing data representing that the key is pushed and including data for a strength of the key-pushing, and wherein said playing data producing means produces the playing data including data for a strength of sound generation determined based on said data for the key-pushing strength included in the key-pushing data detected by said scanning and said data defining the strength of sound generation of the tone recorded in the step, corresponding to said scanning, of said rhythm pattern table.

7. The arpeggiator according to claim 1, wherein said rhythm pattern table storing means stores a plurality of rhythm pattern tables, and wherein said playing data producing means refers to one rhythm pattern table selected from the plurality of rhythm pattern tables.

8. An arpeggiator comprising:

key-pushing data storing means, having storage regions corresponding to a plurality of keys, respectively, for erasably writing key-pushing data, representing that the key is pushed, in the storage region corresponding to the pushed key;

rhythm pattern table storing means for storing a rhythm pattern table having at least one step which records therein a time interval between a certain step and a subsequent step for every step of a rhythm; and playing data producing means for sequentially referring to said at least one step of said rhythm pattern table, scanning said storage regions corresponding to said at least one step, and producing playing data at a timing pursuant to the time interval recorded in the step, corresponding to the scanning of said storage regions, of said rhythm pattern table, said playing data representing a tone based on the key-pushing data detected by said scanning;

wherein said rhythm pattern table storing means stores a plurality of rhythm pattern tables such that at least a portion of said rhythm pattern tables is rewritable or such a new rhythm pattern table is addable, and wherein said playing data producing means refers to one rhythm pattern tables selected from the plurality of rhythm pattern tables.

9. The arpeggiator according to claim 7, wherein said rhythm pattern table storing means stores said rhythm pattern tables such that at least a portion of said rhythm pattern tables is rewritable or a new rhythm pattern table is addable.

10. An arpeggiator comprising:

key-pushing data storing means, having storage regions corresponding to a plurality of keys, respectively, for erasably writing key-pushing data, representing that the key is pushed, in the storage region corresponding to the pushed key;

rhythm pattern table storing means for storing a rhythm pattern table having at least one step which records therein a time interval between a certain step and a subsequent step for every step of a rhythm; and playing data producing means for sequentially referring to said at least one step of said rhythm pattern table, scanning said storage regions corresponding to said at least one step, and producing playing data at a timing pursuant to the time interval recorded in the step, corresponding to the scanning of said storage regions, of said rhythm pattern table, said playing data representing a tone based on the key-pushing data detected by said scanning;

wherein said playing data producing means produces the playing data representing the tone changed based on data which defines a change depth of the property of the tone.

11. The arpeggiator according to claim 1, wherein said playing data producing means produces the playing data representing the tone changed based on data which defines a change depth of the property of the tone.

12. The arpeggiator according to claim 10, further comprising an operator for producing said data defining the change depth, said change depth determined depending on an operation degree of said operator.

13. The arpeggiator according to claim 11, further comprising an operator for producing said data defining the change depth, said change depth determined depending on an operation degree of said operator.

14. The arpeggiator according to claim 10, wherein said data defining the change depth is data which defines a degree of change of a sound generation continuing time of the tone.

15. The arpeggiator according to claim 11, wherein said data defining the change depth is data which defines a degree of change of a sound generation continuing time of the tone.

16. The arpeggiator according to claim 10, wherein said data defining the change depth is data which defines a degree of change of a strength in sound generation of the tone.

17. The arpeggiator according to claim 11, wherein said data defining the change depth is data which defines a degree of change of a strength in sound generation of the tone.

18. The arpeggiator according to claim 3, wherein said key-pushing data storing means erasably writes the key-pushing data in the storage region corresponding to the pushed key, said key-pushing data representing that the key is pushed and including data for a strength of the key-pushing, and wherein said playing data producing means produces the playing data including data for a strength of sound generation determined based on said data for the key-pushing strength included in the key-pushing data detected by said scanning, said data defining the strength of sound generation of the tone recorded in the step, corresponding to said scanning, of said rhythm pattern table and data defining a degree of change in strength of sound generation of the tone.

19. An arpeggiator comprising:

key-pushing data storing means, having storage regions corresponding to a plurality of keys, respectively, for erasably writing key-pushing data, representing that the key is pushed, in the storage region corresponding to the pushed key;

scan mode table storing means for storing a scan mode table which records at one step or a plurality of steps thereof one scan function or a plurality of scan functions of the same kind allowed to overlap with each other, said one scan function or the plurality of the scan functions selected from plural kinds of scan functions each defining a manner of scanning said storage regions; and playing data producing means for sequentially referring to the step/steps of said scan mode table for each sound generation timing, scanning said storage regions according to the scan function recorded in the referred step, and producing playing data representing a tone based on the key-pushing data detected by the scanning of said storage regions.

20. The arpeggiator according to claim 19, wherein said scan mode table storing means stores a plurality of scan mode tables, and wherein said playing data producing means refers to one scan mode table selected from the plurality of scan mode tables.

21. The arpeggiator according to claim 20, wherein said scan mode table storing means stores said scan mode tables such that at least a portion of said scan mode tables is rewritable or a new scan mode table is addable.

22. The arpeggiator according to claim 19, wherein said key-pushing data represents at least a pitch of the tone.

23. An arpeggiator comprising:

key-pushing data storing means, having storage regions corresponding to a plurality of keys, respectively, for erasably writing key-pushing data, representing that the key is pushed, in the storage region corresponding to the pushed key;

rhythm pattern table storing means for storing a rhythm pattern table having at least one step which records therein a time interval between a certain step and a subsequent step for every step of a rhythm;

scan mode table storing means for storing a scan mode table which records at one step or a plurality of steps thereof one scan function or a plurality of scan functions of the same kind allowed to overlap with each other, said one scan function or the plurality of the scan functions selected from plural kinds of scan functions each defining a manner of scanning said storage regions; and playing data producing means for sequentially referring to said at least one step of said rhythm pattern table and the step/steps of said scan mode table for each sound generation timing, scanning said storage regions according to the scan function recorded in the referred step of said scan mode table, and producing playing data at a timing pursuant to the time interval recorded in the step, corresponding to the scanning of said storage regions, of said rhythm pattern table, said playing data representing a tone based on the key-pushing data detected by said scanning.

24. An arpeggiator comprising:

key-pushing data storing means, having storage regions corresponding to a plurality of keys, respectively, for erasably writing key-pushing data, representing that the key is pushed, in the storage region corresponding to the pushed key;

rhythm pattern table storing means for storing a rhythm pattern table having at least one step which records therein data defining a property of a tone for every step of a rhythm;

scan mode table storing means for storing a scan mode table which records at one step or a plurality of steps thereof one scan function or a plurality of scan functions of the same kind allowed to overlap with each other, said one scan function or the plurality of the scan functions selected from plural kinds of scan functions each defining a manner of scanning said storage regions; and playing data producing means for sequentially referring to said at least one step of said rhythm pattern table and the step/steps of said scan mode table for each sound generation timing, scanning said storage regions according to the scan function recorded in the referred step of said scan mode table, and producing playing data representing a tone based on the key-pushing data detected by the scanning of said storage regions and said data recorded in the step, corresponding to said scanning, of said rhythm pattern table and defining the property of the tone.

25. The arpeggiator according to claim 23, wherein said rhythm pattern table storing means and said scan mode table storing means store a plurality of rhythm pattern tables and a plurality of scan mode tables, respectively, wherein style storing means is provided for storing plural kinds of styles each in combination of one of said rhythm pattern tables and one of said scan mode tables, and wherein said playing data producing means refers to the rhythm pattern table and the scan mode table corresponding to one of the styles selected based on given style selection data.

26. The arpeggiator according to claim 24, wherein said rhythm pattern table storing means and said scan mode table storing means store a plurality of rhythm pattern tables and a plurality of scan mode tables, respectively, wherein style storing means is provided for storing plural kinds of styles each in combination of one of said rhythm pattern tables and one of said scan mode tables, and wherein said playing data producing means refers to the rhythm pattern table and the scan mode table corresponding to one of the styles selected based on given style selection data.

27. An arpeggiator comprising:

key-pushing data storing means having storage regions of a given storage capacity for storing key-pushing data therein in order of key-pushing, said key-pushing data identifying a pushed key among a plurality of keys;

key-pushing data erasing means, based on key-releasing data identifying a released key among the plurality of keys, for erasing the key-pushing data of the key corresponding to the key-releasing data from the storage regions;

key-pushing data holding means responsive to given hold-on data for prohibiting erasure of the key-pushing data from said storage regions by said key-pushing data erasing means and for saving the key-pushing data, which have been already stored in the storage regions of said key-pushing data storing means, and the key-pushing data, which will be stored later, and storing newly generated key-pushing data in empty storage regions of said key-pushing data storing means so as to permit a plurality of key-pushing data as to the same key to be stored therein, and responsive to given hold-off data for releasing the prohibition of erasure of the key-pushing data from said storage regions by said key-pushing data erasing means and erasing the key-pushing data, except the key-pushing data of the key-pushed upon receipt of said given hold-off data, from the storage regions of said key-pushing data storing means; and playing data producing means for sequentially scanning the storage regions to produce playing data representing a tone based on the key-pushing data detected by the scanning of the storage regions.

28. The arpeggiator according to claim 27, further comprising an operator which outputs said hold-on data and said hold-off data depending on an operation thereof.

29. The arpeggiator according to claim 28, wherein said operator is a pedal.

30. The arpeggiator according to claim 27, further comprising hold data input means for receiving said hold-on data and said hold-off data from the exterior and feeding them to said key-pushing data holding means.

31. The arpeggiator according to claim 27, further comprising key-pushing data excess storage prohibiting means for prohibiting storage of new key-pushing data into said storage region in a state where the key-pushing data are stored over all said storage region.

* * * * *